US007717868B2

(12) United States Patent
Inada et al.

(10) Patent No.: US 7,717,868 B2
(45) Date of Patent: May 18, 2010

(54) CHAIR-TYPE MASSAGING APPARATUS, COVER FOR MASSAGING APPARATUS, COVER FOR LEG REST, AND MASSAGING APPARATUS

(75) Inventors: Nichimu Inada, Osaka (JP); Mitsunori Tago, Saihaku-gun (JP); Shiro Watanabe, Saihaku-gun (JP)

(73) Assignee: Family Co., Ltd., Osaka (JP)

( * ) Notice: Subject to any disclaimer, the term of this patent is extended or adjusted under 35 U.S.C. 154(b) by 1181 days.

(21) Appl. No.: 10/558,134

(22) PCT Filed: Apr. 30, 2004

(86) PCT No.: PCT/JP2004/006281

§ 371 (c)(1),
(2), (4) Date: Dec. 22, 2005

(87) PCT Pub. No.: WO2004/103251

PCT Pub. Date: Dec. 2, 2004

(65) Prior Publication Data

US 2007/0016119 A1 Jan. 18, 2007

(30) Foreign Application Priority Data

May 26, 2003 (JP) ..... 2003-148173
Jun. 27, 2003 (JP) ..... 2003-184464
Sep. 24, 2003 (JP) ..... 2003-331423
Nov. 10, 2003 (JP) ..... 2003-379329

(51) Int. Cl.
*A61H 7/00* (2006.01)
*A61H 19/00* (2006.01)

(52) U.S. Cl. ..... 601/90; 601/98; 601/149

(58) Field of Classification Search ..... 601/24, 601/27, 29, 49, 84, 86, 90, 93, 94, 98, 99, 601/101–103, 146, 148, 149
See application file for complete search history.

(56) References Cited

U.S. PATENT DOCUMENTS 5,741,218 A * 4/1998 Fujii ..... 601/90

(Continued)

FOREIGN PATENT DOCUMENTS

| | | |
|---|---|---|
| EP | 0992229 | 4/2000 |
| JP | SHO 58-143757 | 8/1983 |
| JP | SHO 59-197249 | 8/1984 |

(Continued)

OTHER PUBLICATIONS

ISA EPO; European Search Report of EPO4730654; Feb. 9, 2009; Germany.

*Primary Examiner*—Justine R Yu
*Assistant Examiner*—Kristen C Matter
(74) *Attorney, Agent, or Firm*—Alleman Hall McCoy Russell & Tuttle LLP

(57) ABSTRACT

Disclosed is a chair-type massaging apparatus that is capable of massaging lower legs freely and precisely in pressing angles or pressing positions with a user seated therein and allows the user to assume a desired posture without interference. The chair-type massaging apparatus of the present invention typically includes a leg rest including a support portion configured to support lower legs of a user, and massaging portions configured to protrude and retract to press the lower legs of the user. The support portion includes protrusible portions that is mounted on both sides in the rightward and leftward direction and is protrusible to rise up inward in the rightward and leftward direction and is retractable. The massaging portions are mounted on the protrusible portions. With the protrusible portions and the massaging portions retracting, the protrusible portions and the support portion located inward relative to the protrusible portion in the rightward and leftward direction and the massaging portions form a substantially flat surface.

36 Claims, 61 Drawing Sheets

U.S. PATENT DOCUMENTS

| | | | | |
|---|---|---|---|---|
| 6,984,197 | B2 * | 1/2006 | Sugiyama et al. | 482/148 |
| 7,195,604 | B2 * | 3/2007 | Nakamura et al. | 601/136 |
| 7,549,966 | B2 * | 6/2009 | Fujii et al. | 601/133 |
| 2006/0217643 | A1 * | 9/2006 | Yonekawa et al. | 601/148 |

FOREIGN PATENT DOCUMENTS

| | | |
|---|---|---|
| JP | 07-124214 | 5/1995 |
| JP | 08-052185 | 2/1996 |
| JP | 08-089540 | 4/1996 |
| JP | 08-112330 | 5/1996 |
| JP | 10-057436 | 3/1998 |
| JP | 10-080453 | 3/1998 |
| JP | 10-295753 | 11/1998 |
| JP | 2000-102577 | 4/2000 |
| JP | 2000-140054 | 5/2000 |
| JP | 2002-301125 | 10/2002 |
| JP | 2002-360645 | 12/2002 |
| JP | 2002-369847 | 12/2002 |

* cited by examiner (a)

(b)

(a)

(b)

(a)

(b)

(a)

(b)

CHAIR-TYPE MASSAGING APPARATUS, COVER FOR MASSAGING APPARATUS, COVER FOR LEG REST, AND MASSAGING APPARATUS

CROSS-REFERENCE TO RELATED APPLICATIONS

This is a national phase of PCT Application No. PCT/JP2004/006281 filed Apr. 30, 2004, which claims priority to Japanese Application No. 2003-148173 filed May 26, 2003, Japanese Application No. 2003-184464 filed Jun. 27, 2003, Japanese Application No. 2003-331423 filed Sep. 24, 2003, and Japanese Application No. 2003-379329 filed Nov. 10, 2003, the entire disclosures of each of which are hereby incorporated by reference into the present application.

TECHNICAL FIELD

The present invention relates to a chair-type massaging apparatus configured to massage a body of a user. More particularly, the present invention relates to a chair-type massaging apparatus provided with a leg rest on which lower legs of the user are supported. The present invention also relates to a cover for the massaging apparatus or the leg rest that is configured to massage legs and other areas of the body, and a massaging apparatus provided with these covers.

BACKGROUND

Massaging apparatuses configured to apply stimulation to a body of a user, such as kneading, tapping, finger pressure, and rolling, are widely known. There are a variety of massaging apparatuses, such as chair-types and mattress-types, among which the chair-type massaging apparatus has been highly demanded and widely used because it is capable of massaging the user in a relaxed posture and its installation area is smaller than that of the mattress-type.

Most of the conventional chair-type massaging apparatuses are typically configured to apply pressing stimulation to a back and a shoulder of the user. In order to enable the user to efficiently obtain effects such as facilitation of blood circulation, recovery from fatigue, or relaxation, it is important to massage physical parts such as the legs and arms of the user. In recent years, chair-type massaging apparatuses capable of massaging arms and legs have been developed.

One type of chair-type massaging apparatus comprises a chair body (massage chair) and a leg rest (lower leg massager) provided with two concave receiver portions on which fight and left lower legs of the user are supported (see Japanese Patent No. 3012127). This chair-type massaging apparatus is constructed such that air bags are provided on opposite side surfaces of each concave receiver portion, and the air bags expand and contract to allow a calf of a leg of the user to be massaged with the calf sandwiched from right and left sides.

The chair-type massaging apparatus disclosed in Japanese Patent No. 3012127 is constructed such that the chair body is separated from the leg rest, while in Japanese Patent No. 3012780, the leg rest is attached to the chair body. In the latter construction, the leg rest is attached to a front side of a seat portion of the chair body. The user is seated in the chair body and thereby the lower legs of the user are placed on the leg rest. In the chair-type massaging apparatus disclosed in Japanese Patent No. 3012780, as in the chair-type massaging apparatus disclosed in Japanese patent No. 3012127, the leg rest is provided with concave receiver portions and right and left lower legs are placed on the concave portions to be massaged (see Japanese Patent Publication No. 3012780).

Some mattress-type massaging apparatuses are capable of massaging lower legs of the user. One type of such mattress-type massaging apparatus provides double air bags on both sides of each of right and left calves of the legs of the user lying on his or her back (see Japanese Laid-Open Patent Application Publication No. Hei. 10-57436 and Japanese Laid-Open Patent Application Publication No. Hei. 10-118143). This mattress-type massaging apparatus is capable of massaging the right and left calves of the user by expansion and contraction of the air bags with the calves sandwiched and retained from right and left sides; this mattress-type massaging apparatus is also capable of increasing the force to sandwich and retain the calves by expanding the dual air bags simultaneously.

However, in the chair-type massaging apparatuses disclosed in Japanese Patent Nos. 3012127 and 3012780, when the user puts his or her calves into the concave receiver portions, the posture of the user is restricted and obstructed by side walls of the concave receiver portions. This makes it difficult for the user to assume a desired posture.

In the chair-type massaging apparatus disclosed in Japanese Patent No. 3012780, the lower legs can remain outside the concave receiver portions with the user seated therein. In this case, the leg rest may become an obstruction, making it difficult for the user to assume a desired posture.

It is known that there exist a plurality of acupuncture points called "sanri" and "horyu" in an outer region of a shin of a lower leg of a body, i.e., in a front outer region of the lower leg, and function to provide adjustment of various internal organs as well as to provide effects such as facilitation of blood circulation, recovery from fatigue, or relaxation by applying stimulation to these regions. But, the chair-type massaging apparatuses disclosed in above Japanese Patent Publications Nos. 3012127 and 3012780 are incapable of massaging the outer region of the shin.

The inventions disclosed in Japanese Laid-Open Patent Application Publication Nos. Hei. 10-57436 and 10-118143 are applicable to the leg rest of the chair-type massaging apparatus. Since the front surface of the leg rest is substantially flat when each air bag is contracted, the user easily assumes a desired posture. However, the chair-type massaging apparatus of such a construction is incapable of massaging the outer region of the shin.

Since the invention disclosed in Japanese Laid-Open Patent Application Publication No. Hei. 10-57436 is not a chair-type massaging apparatus but a mattress-type massaging apparatus, the user must lie on a mattress, and the lower leg is incapable of being massaged with the user seated in the chair.

In the inventions disclosed in Japanese Laid-Open Patent Application Publication Nos. Hei. 10-57436 and 10-118143, since the mattress portion is substantially flat with the air bag contracted, there is no protruding portion that restricts or obstructs the posture of the user in such a contracted state. However, since a protrusible and retractable system of the massaging apparatus is constructed such that the air bag, substantially flat in a retracted state, protrusively expands from the lower side of the lower leg, setting a pressing angle or a pressing position with respect to the lower leg in a limited range, and therefore, a massage pattern is very limited. In addition, since the air bags or cloth covers which cover these air bags protrude and are flexible, the precision of the pressing position or the pressing angle is not high.

Some massaging apparatuses are configured to massage the body of the user in such a manner that a massaging system such as massaging elements protrudes and retracts with respect to the body of the user to apply pressure to the body.

A cover that covers a massaging system provided with the protrusible and retractable system is disclosed in Japanese Laid-Open Patent Application Publication No. Hei. 8-112330. The cover covers a side surface of a massaging system causing a pressing drive plate having a pressing element to protrude and retract by expansion and contraction of air cells (air bags). One sheet (continuous sheet without seams or joints) is bent in a bellows-like manner, and an elastic material such as rubber is stitched inside. The bellows-like sheet expands with extension of the elastic material during expansion of the air cell and is folded by contraction of the elastic material during contraction of the air cell (see Japanese Laid-Open Patent Application Publication No. Hei. 8-112330).

The cover disclosed in Japanese Laid-Open Patent Application Publication No. 8-112330 is configured not to cover a body side of the massaging system but to cover a side surface of the massaging system so as not to interfere with the body side. On the other hand, the cover disclosed in Japanese Laid-Open patent Application Publication No. Hei-10-295753 is configured to cover the body side of the massaging system and is made of an elastic material such as an elastic cloth or rubber sheet. Such an elastic material enables the cover to expand and contract according to protrusion and retraction of the massaging system with respect to the body of the user (see Japanese Laid-Open patent Application Publication No. 10-295753).

In the massaging apparatus disclosed in Japanese Laid-Open Patent Application Publication No. Hei. 8-112330, a foldable portion of the cover which is folded during contraction of the air cell (retraction of the massaging system) is not located on the side of a support surface on which a body of the user who is being massaged is supported, but at a position of the side surface which is away from the support surface side. Therefore, this cover does not cover the support surface on which the body of the user is supported. This cover is not configured for protrusion and retraction operation of a massaging apparatus that protrudes and retracts within the support surface on which the body of the user is supported.

Japanese Laid-Open Patent Application Publication No. Hei. 10-295753 discloses a cover made of an elastic material as a cover which is capable of covering the body side of the massaging system having the protrusible and retractable system and is configured for protrusion and retraction operation. However, the elastic material decreases elasticity after repeated expansion and compression during use. As a result, the cover becomes deformed, and its external appearance degrades.

SUMMARY OF THE INVENTION

The present invention has been made in view of the above circumstances, and an object of the present invention is to provide a chair-type massaging apparatus that enables a user to assume a desired posture without restriction of the lower legs in a seated state.

Another object of the present invention is to provide a chair-type massaging apparatus that enables pressing angles or pressing positions with respect to the lower legs to be set freely and precisely.

Another object of the present invention is to provide a chair-type massaging apparatus that is capable of massaging the outer regions of shins of the lower legs of the user.

A further object of the present invention is to provide a cover configured to accommodate protruding and retracting operations within a support surface on which a body of the user is supported while maintaining its external appearance, and a massaging apparatus using this cover.

In order to achieve the above mentioned objects, a chair-type massaging apparatus of the present invention comprises a leg rest including a support portion configured to support a lower leg of a user; and an expandable portion which is protrusible forward from the support portion to press the lower leg of the user and is retractable; wherein the leg rest is configured such that the support portion and the expandable portion form a substantially flat surface with the expandable portion retracting.

In the above invention, the expandable portion may include a massaging portion which is protrusible to press the lower leg of the user and is retractable; and protrusible portions which are mounted at sides in the rightward and leftward direction of the support portion and are configured to be protrusible to rise up inward in the rightward and leftward direction and to be retractable. The massaging portion may be mounted on each of the protrusible portions; and with the protrusible portion and the massaging portion retracting, elements of the support portion which are located inward relative to the protrusible portion in the rightward and leftward direction and the massaging portion may form a substantially flat surface.

In the chair-type massaging apparatus, the lower legs are massaged with the user seated therein. With the protrusible portion and the massaging portion retracted, since the protrusible portion, elements of the support portion which are located inward relative to the protrusible portion in the rightward and leftward direction, and the massaging portion form a substantially flat surface, the protrusible portions located on both sides in the rightward and leftward direction and the elements located inward in the rightward and leftward direction are substantially flat, and hence do not disturb the user. Furthermore, since the massaging portion, which is configured to protrude and retract, is mounted on the protrusible portions protrusible to rise up inward in the rightward and leftward direction, the pressing angles or the pressing positions with respect to the lower legs of the user can be set quite freely. By combining protruding angles of the protrusible portion, protruding angles or positions of the massaging portion in various ways, the pressing angles or the pressing positions with respect to the lower legs of the user which are set quite freely. Since the protrusible portion, which is a base of the massaging portion, is a part of the support portion, and since the support portion is deformable, positional or angular displacement of the massaging portion is minimized. As a result, the pressing angles or the pressing positions are set with high precision.

Preferably, in the above invention, each of the protrusible portions may include a receiver plate; and the receiver plate may be rotatable around a first rotational axis positioned on the inner side thereof in the rightward and leftward direction and may be configured to rotate by expansion and contraction of an air bag placed on a rear surface side of the receiver plate.

In such a construction, the structure of the protrusible portion, which is protrusible to rise up inward in the rightward and leftward direction and is retractable, is simplified. As a result, a small-sized and lightweight chair-type massaging apparatus is achieved, and manufacturing costs or component costs may be reduced.

Preferably, the massaging portion may include a massaging plate; and the massaging plate may be rotatable around a second rotational axis positioned on inner side thereof in the rightward and leftward direction, and may be configured to rotate by expansion and contraction of an air bag placed between the receiver plate and the massaging plate. In such a construction, a structure of the massaging portion which is positioned on the protrusible portion and configured to protrude inward in the rightward and leftward direction to press the lower leg and is retractable is simplified. As a result, a small-sized and lightweight chair-type massaging apparatus is achieved, and manufacturing costs or component costs may be reduced.

Preferably, the first rotational axis and the second rotational axis may be provided at different positions.

In this case, because of the positional relationship between these axes, the position or the protruding angle of the massaging plate is set more freely, and the pressing angles or the pressing positions with respect to the lower legs of the user which are set quite freely.

In this case, preferably, the air bag configured to cause the receiver plate or the massaging plate to protrude and retract is expandable in a substantially fan-shaped form in cross-section, and is placed in such a manner that a center of the fan-shaped form is positioned on the inner side in the rightward and leftward direction of the support portion. In such a construction, since the rotational axis (first or second rotational axis) of the receiver plate or the massaging plate and the center of the fan-shaped form of the air bag are positioned on the same side in the rightward and leftward direction to be close to each other, the plates are caused to rotate very efficiently by expansion and contraction of the air bag.

In the above invention, the support portion may further comprise an intermediate massaging portion including an intermediate air bag that is mounted in an intermediate region in the rightward and leftward direction of the support portion and is configured to protrude and retract, and with the protrusible portion, the massaging portion, and the intermediate massaging portion retracted, the elements of the support portion which are located inward relative to the protrusible portion in the rightward and leftward direction and the massaging portion may form a substantially flat surface. In such a construction, since the lower leg is sandwiched between the massaging portion mounted on the protrusible portion and the intermediate massaging portion, it is massaged effectively or strongly. Furthermore, in retraction of the intermediate massaging portion or other elements, the protrusible portion and the elements located inward relative to the protrusible portion in the rightward and leftward direction become substantially flat, and as a result, the user is not disturbed.

In this case, the intermediate massaging portion may include air bags. The air bags may be positioned to be symmetric in the rightward and leftward direction with respect to an axis located at a center in the rightward and leftward direction of the support portion. The air bags may be each expandable in a substantially fan-shaped form in cross-section and are each placed in such a manner that a center of the fan-shaped form is positioned on the outer side in the rightward and leftward direction of the support portion.

In such a construction, since the air bags are configured to expand to fall toward the right and left legs, the intermediate massaging portion is capable of efficiently pressing the right and left lower legs from inward in the rightward and leftward direction. The center massaging portion is simply constructed of the air bags, and becomes substantially flat in retraction of the intermediate massaging portion and other elements.

In the above invention, the support portion may have a support surface on which the lower leg of the user is supported, the expandable portion may include a massaging portion configured to press the lower leg of the user, the massaging portion may include an air bag configured to expand and contract by inflowing and outflowing air with respect to the air bag, the air bag in a contracted state and the support surface may form a substantially flat surface, and the air bag in an expanded state may be configured to press an outer region of a shin of the lower leg of the user substantially backward.

In such a construction, since the front side of the leg rest is substantially flat with the air bag expanded, the user may take a desired posture without restriction of the lower legs of the user in a seated state. In addition, the massaging portion may massage the outer region of the shin of the lower leg of the user.

In this case, preferably, the massaging portion may include massaging portions which are respectively mounted on both end portions of the support portion so as to correspond to fight and left lower legs of the user.

In this case, the support portion may have a mounting surface which is located outside the support surface and is substantially parallel to the support surface, the massaging portion may include a rear air bag which is mounted to the mounting surface in such a manner that one end portion thereof which is expandable in a bellows-like manner is distant from the support surface and an opposite end thereof which is unexpandable is closer to the support surface, the rear air bag being configured to expand in a fan-shaped form from a substantially flat state by inflowing air thereto, a receiver plate positioned in front of the rear air bag and mounted to a region of the support portion between the support surface and a mounting position of the rear air bag, the receiver plate being configured to be pivotable around a pivot extending substantially vertically; and a front air bag which is positioned in front of the receiver plate in such a manner that one end portion thereof which is expandable in a bellows-like manner is distant from the pivot and an opposite end thereof which is unexpandable is closer to the pivot, the front air bag being configured to expand in a fan-shaped form from a substantially flat state by inflowing air thereto.

In this case, preferably, the support portion may be configured in such a manner that the mounting surface is lower than the support surface to form a step between the mounting surface and the support surface.

In the above invention, preferably, the massaging portion may be configured to be controlled to operate in such a manner that the front air bag repeats expansion and contraction with the rear air bag expanded.

In the above invention, the massaging portion may further include a convex massaging element that is mounted in front of the front air bag and configured to press the lower leg of the user in contact with the lower leg of the user.

In the above invention, preferably, the receiver plate may be configured such that an outer end portion thereof is curved forward.

In the above invention, preferably, the support portion may have two support surfaces arranged rightward and leftward and configured to allow the right and left lower legs of the user to be supported thereon, and an intermediate mounting surface which is located between the two support surfaces and is substantially parallel to the support surface, and the massaging apparatus may further comprise an intermediate massaging portion that is mounted to the intermediate mounting surface and is configured to contract to form a substantially flat surface with the support surface and to expand to protrude forward further than the support surface.

In this case, the support portion may be configured in such a manner that the intermediate mounting surface is lower than the support surface to form a step between the intermediate mounting surface and the support surface.

In the above case, the intermediate air bag may be configured to have a width that increases in a downward direction.

In the above invention, preferably, the support portion may have two support surfaces arranged rightward and leftward and configured to allow the right and left lower legs of the user to be supported thereon, and an intermediate mounting surface that is located between the two support surfaces and is substantially parallel to the support surface, and the massaging apparatus may further comprise an intermediate massaging portion including one or a plurality of pairs of intermediate air bags that are mounted to the intermediate mounting surface in such a manner that corresponding first ends of the intermediate air bags, which are expandable in a bellows-like manner, are positioned closer to each other, and opposite ends of the intermediate air bags, which are unexpandable, are positioned distant from each other, the air bags being each configured to expand in a fan-shaped form from a substantially flat state by inflowing air thereto.

In this case, preferably, the one or the plurality of pairs of the intermediate air bags of the intermediate massaging portion may be mounted to the intermediate mounting surface in such a manner that a distance between the air bags forming the pair increases in a downward direction.

In the above invention, preferably, the massaging portion and the intermediate massaging portion may be configured to be controlled to operate in such a manner that the front air bag and the intermediate air bag repeat expansion and contraction in synchronization with each other.

In the above invention, preferably, the massaging portion and the intermediate massaging portion may be configured to be controlled to operate in such a manner that the rear air bag expands, then the front air bag and the intermediate air bag respectively expand in synchronization with each other, and then the rear air bag contracts while maintaining expansion of the front air bag and the intermediate air bag.

In the above invention, preferably, the support portion may include an upper support portion and a lower support portion which are arranged in a vertical direction, the massaging portion may be mounted to each of the upper support portion and the lower support portion, and the leg rest may further include a distance changing device configured to change a distance between the upper support portion and the lower support portion.

In the above invention, preferably, the support portion may have two support surfaces arranged rightward and leftward and configured to allow fight and lower legs of the user to be supported thereon, and a support protrusion mounted between the support surfaces to protrude forward further than the support surfaces and configured to support inner regions of calves of legs of the user, the expandable portion may include a massaging portion configured to press the lower leg of the user.

Further, the massaging portion may include an air bag configured to expand and contract by inflow and outflow air, and the air bag in a contracted state and the support surface may form a substantially flat surface, while the air bag in an expanded state is configured to press an outer region of a shin of the lower leg of the user substantially backward.

In such a construction, since the front side of the leg rest is shaped such that the support protrusion protrudes from an intermediate region in the width direction of the substantially flat surface with the air bags contracted, the user may assume a desired posture in a seated state without restriction of the legs. In addition, the user has only to find the position at which the inner region of the calf of the leg of the user contacts the support protrusion to enable to lower leg of the user to be guided to a proper massage position. Furthermore, the massaging portion is capable of massaging the outer region of the shin of the lower leg of the user.

In this case, preferably, the support protrusion may be configured to have a width that increases in a downward direction.

In the above case, preferably, the massaging portion may include massaging portions that are mounted at both end portions of the support portion so as to correspond to the fight and left lower legs of the user.

In this case, preferably, the support portion may have mounting surfaces positioned outside the support surfaces to be substantially parallel to the support surface, the massaging portion may include a rear air bag which is mounted to the mounting surface in such a manner that one end portion thereof which is expandable in a bellows-like manner is distant from the support surface and an opposite end thereof which is unexpandable is closer to the support surface, the rear air bag being configured to expand in a fan-shaped form from a substantially flat surface by inflowing air thereto, a receiver plate that is positioned in front of the rear air bag and mounted to a region of the support portion between the support surface and a mounting position of the rear air bag, the receiver plate being configured to be pivotable around a pivot extending substantially vertically; and a front air bag which is positioned in front of the receiver plate in such a manner that one end thereof which is expandable in a bellows-like manner is distant from the pivot and an opposite end thereof which is unexpandable is closer to the pivot, the front air bag being configured to expand in a fan-shaped form from a substantially flat state by inflowing air thereto.

In this case, preferably, the support portion may be configured in such a manner that the mounting surface is lower than the support surface to form a step between the mounting surface and the support surface.

In the above invention, preferably, the massaging portion may be configured to be controlled to operate in such a manner that the front air bag repeats expansion and contraction with the rear air bag expanded.

In the above invention, preferably, the massaging portion may further include a convex massaging element that is mounted in front of the front air bag and configured to contact and press the lower leg of the user.

In the above invention, preferably, the receiver plate may be configured such that an outer end portion thereof is curved forward.

In the above invention, preferably, the support portion may include an upper support portion and a lower support portion which are arranged in a vertical direction, the massaging portion may be mounted to each of the upper support portion and the lower support portion, and the leg rest may further include a distance changing device configured to change a distance between the upper support portion and the lower support portion.

In order to achieve the above object, a cover of the present invention for a massaging apparatus including a support surface on which a body of a user is supported and a protrusible and retractable system configured to protrude and retract with respect to the body within the support surface, the cover being configured to cover the support surface, comprises a foldable portion configured to expand according to the protrusion of the protrusible and retractable system and to be folded according to the retraction of the protrusible and retractable system. Since the cover is expandable and foldable according to the protruding and retracting operations within the support surface on which the body of the user is supported, it may be employed as the cover that covers the support surface. Because of the presence of the foldable portion, the cover need not be made of an elastic material. If the cover is made of the elastic material, its elasticity decreases. As a result, external appearance of the cover is maintained.

A cover of the present invention is a cover for a massaging apparatus including a protrusible and retractable system configured to protrude and retract, comprising a foldable portion configured to expand according to the protrusion of the protrusible and retractable system and to be folded to be substantially parallel to a cover surface according to the retraction of the protrusible and retractable system. In this construction, the foldable portion is configured for the protruding and retracting operations, and as a result, the external appearance is maintained as described above. Since the foldable portion is foldable to be substantially parallel to the cover surface, the protruding amount of the foldable portion is minimized. Thereby, when a cover is used to cover the support surface on which the body is supported, the foldable portion does not substantially disturb the user. As a result, the external appearance is improved.

In the cover that covers the support surface on which the body of the user is supported, preferably, the support surface may be substantially flat in retraction of the protrusible and retractable system, and the foldable portion may be configured to be folded to be substantially parallel to a cover surface in retraction. In this construction, since the foldable portion is folded to be substantially parallel to the cover surface, it does not substantially degrade the flatness of the support surface. As a result, the external appearance of the cover is improved, and the cover does not substantially disturb the body of the user.

Preferably, the foldable portion may have a plurality of coupled portions formed by coupling cover elements superimposed in a folded state to be substantially parallel to the cover surface in a thickness direction thereof in regions in the vicinity of the coupled portions. In this construction, the foldable portion is not merely folded but the superimposed cover elements are coupled in the thickness direction. The coupled state causes a restricting force, allowing the foldable portion that has expanded according to the protrusion of the protrusible and retractable system to return to its folded state of retraction of the protrusible and retractable system.

Preferably, the foldable portion may be configured such that expansion at an end portion in a direction of a line formed by the coupled portion is restricted. In this construction, since the restricting force for causing the foldable portion to return to its folded state is generated by the restriction in the foldable portion that has expanded by the protrusion of the protrusible and retractable system, the foldable portion easily returns to its folded state during the retraction.

A cover of the present invention for a leg rest including a support surface on which right and left legs are supported, and a protrusible and retractable system configured to protrude and retract with respect to the legs within the support surface, comprises an expandable and contractable portion which is positioned on an intermediate region in a rightward and leftward direction of the support surface and configured to expand and contract according to protrusion and retraction of the protrusible and retractable system. Since the cover has the expandable and contractable portion capable of expanding and retracting according to the protruding and retracting operations at the intermediate regions in the rightward and leftward direction of the support surface, it is employed as the cover that covers the leg rest. Since the expandable and contractable portion contracts during retraction of the protrusible and retractable system, the cover does not substantially interfere with the system during the retraction. Since the protrusible and retractable system is positioned at the intermediate region in the rightward and leftward direction of the support surface of the leg rest so that the system is protrusible between the right and left legs, the legs are suitably massaged.

In the cover for a leg rest, preferably, the protrusible and retractable system provided in the leg rest may be configured such that the support surface is substantially flat when the system is in retraction.

Further, the expandable and contractable portion may be a foldable portion configured to expand according to protrusion of the protrusible and retractable system and to be folded to be substantially parallel to the cover surface by retraction of the protrusible and retractable system. In this construction, since the expandable and contractable portion is the foldable portion which is foldable to be substantially parallel to the cover surface, the cover does not substantially reduce the flatness of the support surface, which is substantially flat in retraction. As a result, the expandable and contractable portion does not substantially disturb the user, and the external appearance of the cover is improved.

A massaging apparatus of the present invention comprises a support surface on which a body of a user is supported; a protrusible and retractable system configured to protrude and retract with respect to the body within the support surface; and a cover configured to cover the support surface and to include a foldable portion configured to expand by protrusion of the protrusible and retractable system and to be folded by retraction of the protrusible and retractable system. In this construction, since the cover is capable of covering the support surface on which the body of the user is supported and the protrusible and retractable system is mounted. Furthermore, since the cover is provided with a foldable portion that is expandable and foldable by the protruding and retracting operations, the external appearance of the massaging apparatus is maintained.

The above and further objects and features of the invention will more fully be apparent from the following detailed description and accompanying drawings.

DETAILED DESCRIPTION OF THE PREFERRED EMBODIMENTS

Hereinafter, embodiments of the present invention will be described with reference to the drawings.

Embodiment 1

Figure 1:
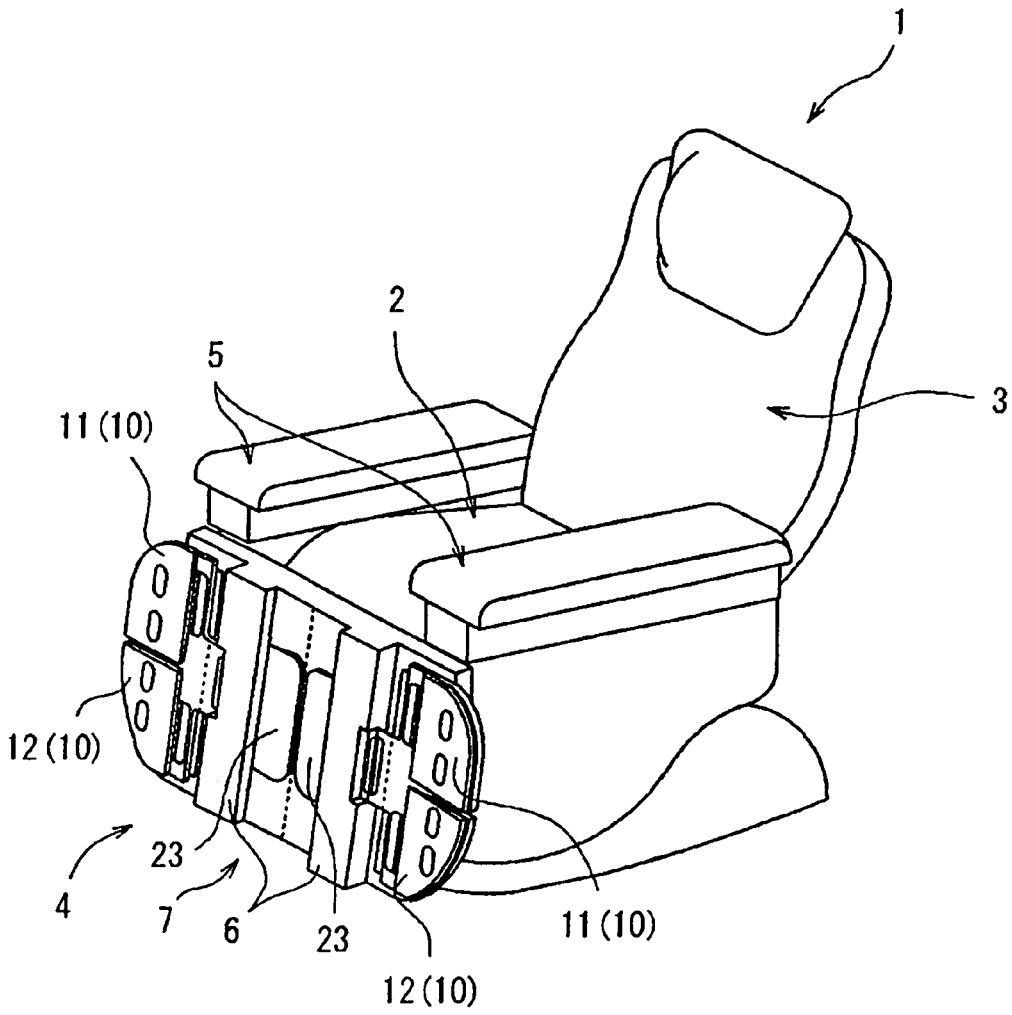
FIG. 1 is a perspective view of a chair-type massaging apparatus according to a first embodiment of the present invention.

FIG. 1 is a perspective view of a chair-type massaging apparatus 1 according to a first embodiment of the present invention. The chair-type massaging apparatus 1 comprises a seat portion 2, a back rest 3, a leg rest 4 and arm rests 5. The leg rest 4 is attached to a front portion of the seat portion 2 and is rotatable around an axis located at and extending along an upper end of the leg rest 4. Thereby, the leg rest 4 is attached at a variable angle to the seat portion 2 and is configured for change in a bending angle of a leg of a user seated therein. The back rest 3, the seat portion 2, and the arm rest 5 may be provided with massaging elements that massage body parts of the user, although not shown. While the leg rest 4 is covered with a cover made of a cloth or the like, the cover covering the leg rest 4 is omitted in FIG. 1.

Figure 2:
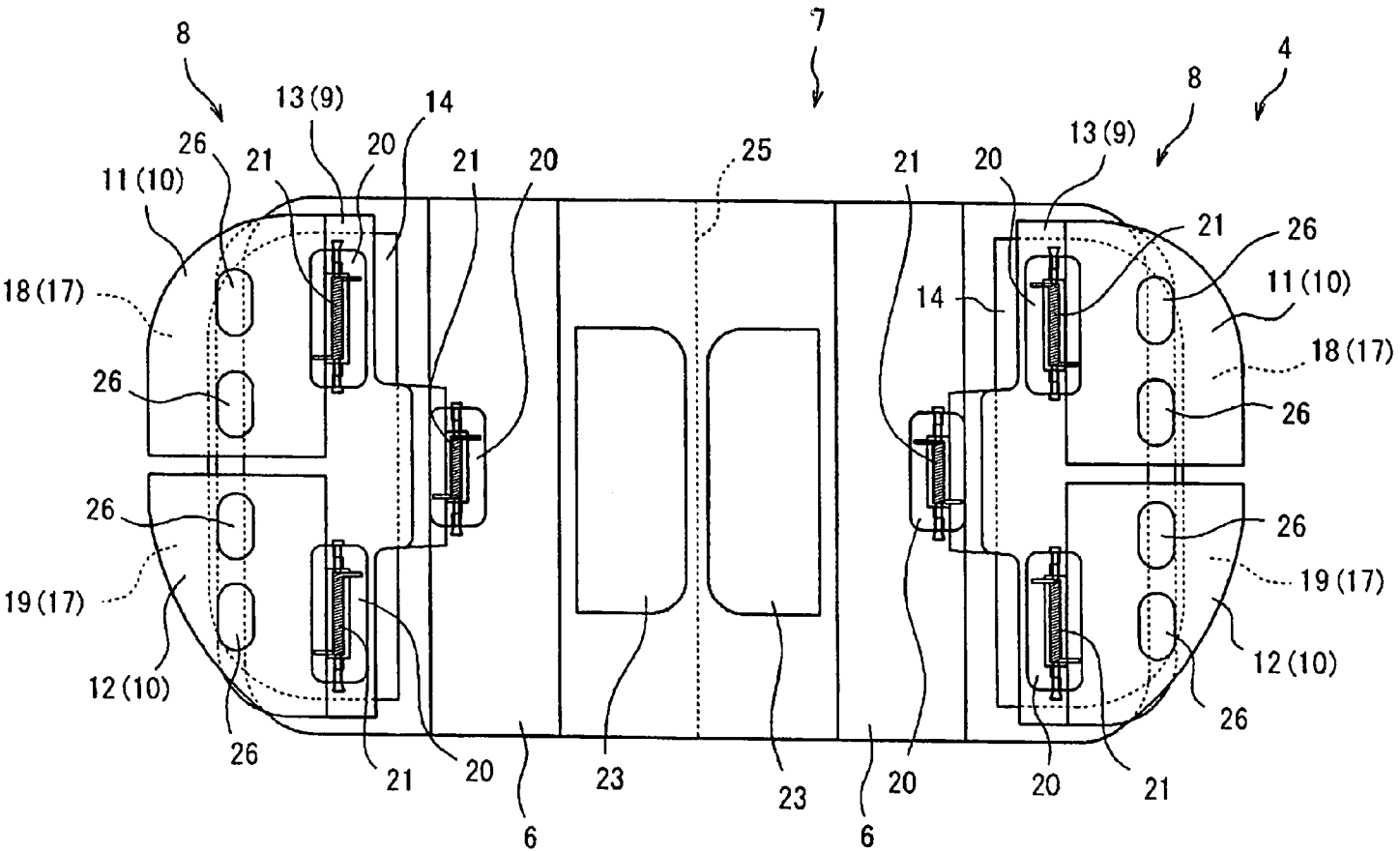
FIG. 2 is a front view of a leg rest of the chair-type massaging apparatus of FIG. 1.
Figure 3:
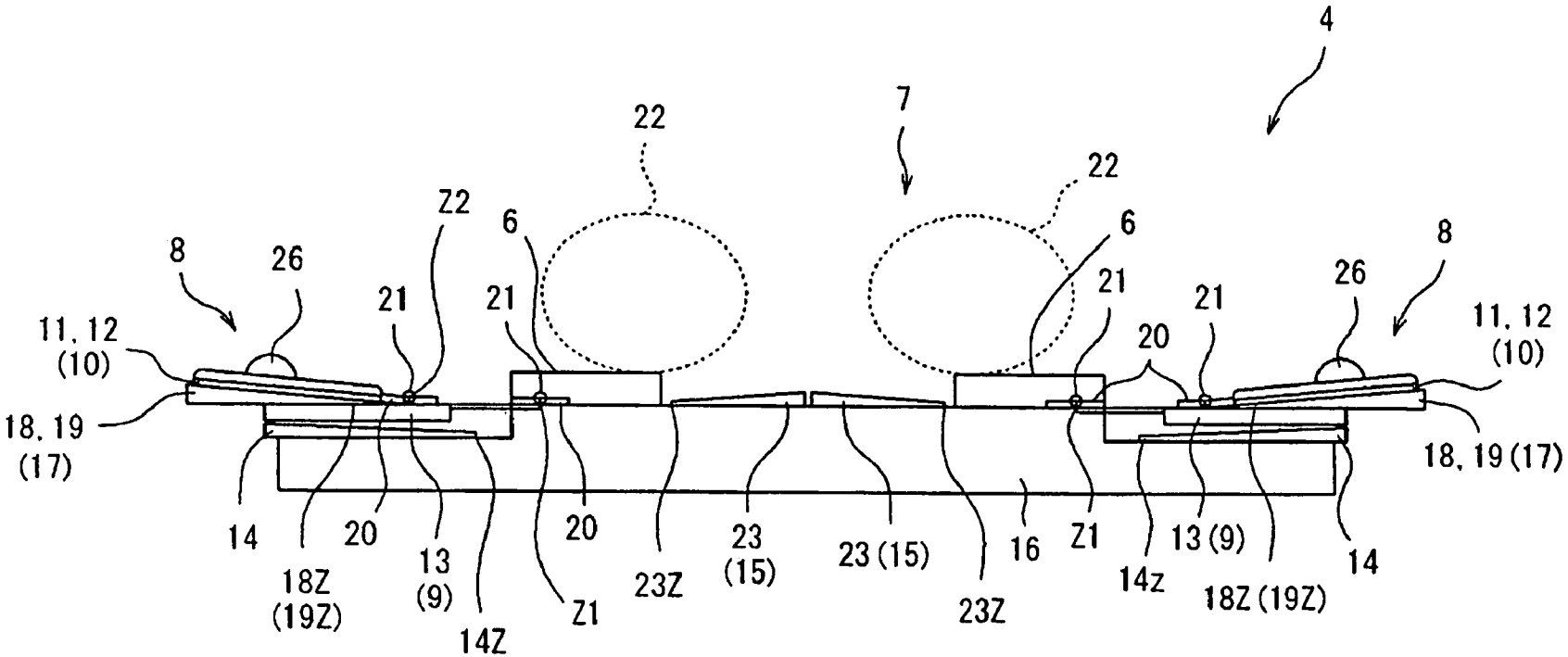
FIG. 3 is a plan view of the leg rest of FIG. 2, showing a state in which air cells (air bags) contract.
Figure 4:
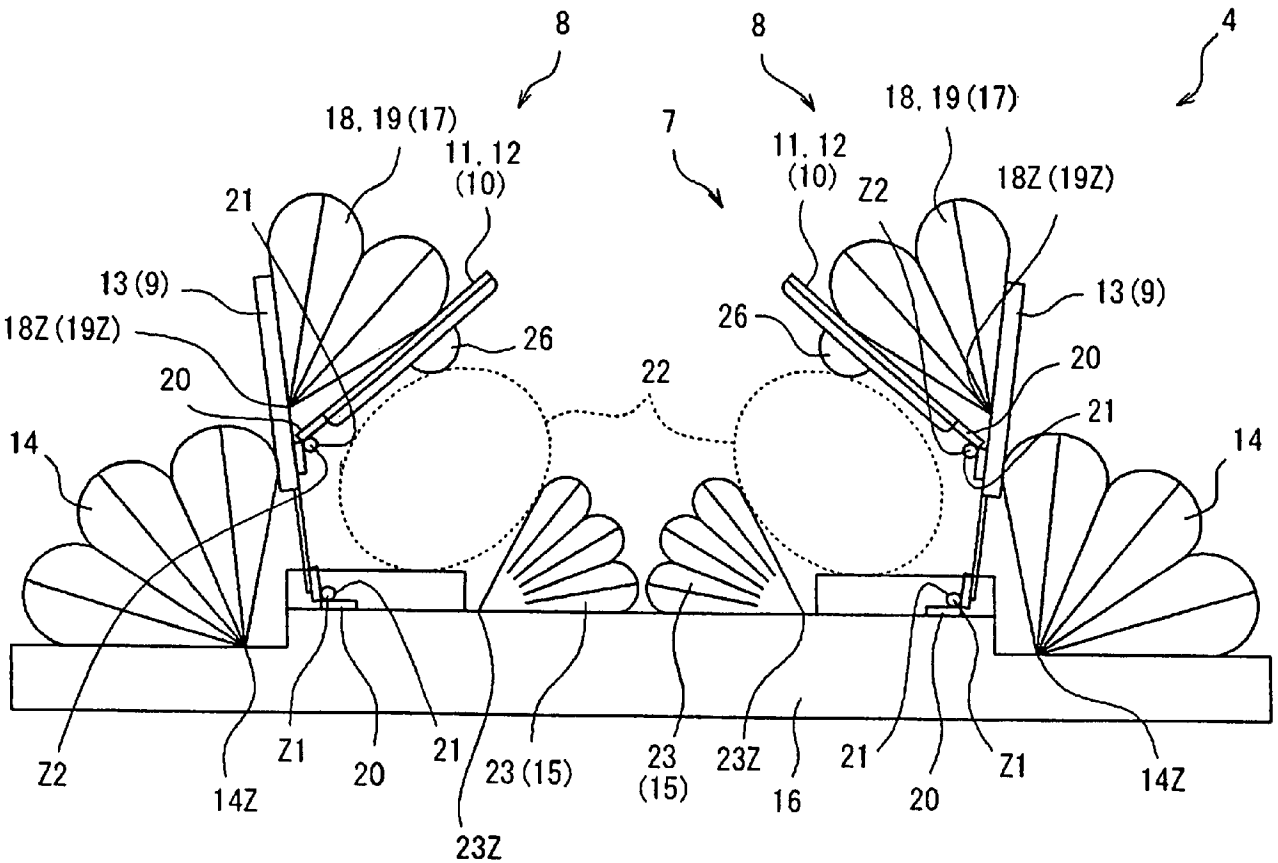
FIG. 4 is a plan view of the leg rest of FIG. 2, showing a state in which the air cells expand.

FIG. 2 is a front view of the leg rest 4. FIGS. 3 and 4 are plan views of the leg rest 4. FIG. 3 shows a state in which air cells (air bags) described later contract and FIG. 4 shows a state in which the air cells expand. The leg rest 4 includes a support portion 7 having support surfaces 6 on which lower legs of the user are supported. The leg rest 4 is symmetric in structure in the rightward and leftward direction and is capable of uniformly massaging right and left lower legs of the user.

As used herein, the terms "rightward and leftward direction" and "forward and backward direction" mean directions from the perspective of the user seated in the chair-type massaging apparatus 1, and "vertical direction" means the direction perpendicular to the "rightward and leftward direction" on a plane parallel to the support surfaces 6.

The support portion 7 has a substantially flat base 16 (see FIG. 3), and protrusible portions 9 which are protrusible to rise up inward in the right and leftward direction and are retractable. Each protrusible portion 9 includes a receiver plate 13 which is constructed of a plate element of a substantially rectangular shape which is elongate in the vertical direction of the leg rest 4. Each receiver plate 13 is mounted at an inner peripheral region thereof in the rightward and leftward direction to the base 16 (see FIG. 3) of the support portion 7 by a hinge 20. A torsion spring 21 is mounted to the hinge 20 and is configured to bias the receiver plate 13 outward in the rightward and leftward direction (in the direction to retract the receiver plate 13). A rotational axis Z1 of each hinge 20 is mounted to be oriented vertically. Each lower cell 14 is provided between the receiver plate 13 and the base 16 on the rear surface side of the receiver plate 13.

A massaging plate 10, which serves as a massaging element 8, is mounted on each receiver plate 13. As shown in FIGS. 1 and 2, each massaging plate 10 is comprised of an upper massaging plate 11 and a lower massaging plate 12. As shown in FIGS. 2 and 3, the upper massaging plate 11 and the lower massaging plate 12 are mounted at inner peripheral regions thereof to the receiver plate 13 by the hinges 20. A rotational axis Z2 of each hinge 20 is oriented vertically as in the rotational axes Z1. The torsion spring 21 is mounted to each hinge 20 and is configured to bias each of the upper massaging plate 11 and the lower massaging plate 12 outward in the rightward and leftward direction (in the direction to retract these plates 11 and 12).

Air cells 17 are each provided between the upper massaging plate 11 and the lower massaging plate 12, and the receiver plate 13 on the rear surface side of the upper massaging plate 11 and the lower massaging plate 12. Each air cell 17 is divided in two in the vertical direction, as is each massaging plate 10. Each air cell 17 includes an upper massaging air cell 18 located between the upper massaging plate 11 and the receiver plate 13 and a lower massaging air cell 19 located between the lower massaging plate 12 and the receiver plate 13. It shall be appreciated that, in FIG. 2, contours of the upper massaging air cell 18 and the lower massaging air cell 19 overlap with contours of the upper massaging plate 11 and the lower massaging plate 12.

Pressing elements 26 are mounted at appropriate positions on the upper massaging plate 11 and the lower massaging plate 12 and are configured to have convex curved surfaces protruding toward the user. In this manner, the massaging portion 8 and the protrusible portion 9 form an expandable portion of the present invention.

Now, protruding and retracting operation of the massaging plate 10 and the receiver plate 13 will be described.

The above mentioned air cells (lower air cell 14, upper massaging air cell 18, and lower massaging air cell 19) and an intermediate air cell 23 described later are connected to an air inflow and outflow device (not shown) through air hoses or the like, and are capable of repeated expansion and contraction by air inflow and outflow by the air inflow and outflow device.

As shown in FIG. 4, when the lower air cell 14 expands, the receiver plate 13 is pushed by the lower air cell 14 from its rear surface side and protrudes to rise up inward in the rightward and leftward direction. Conversely, when the lower air cell 14 contracts, the receiver plate 13 retracts outward in the rightward and leftward direction by a bias force applied from the torsion spring 21.

When the air cells 17, including the upper massaging air cell 18 and the lower massaging air cell 19, expand, the massaging plate 10 (including upper massaging plate 11 and the lower massaging plate 12) is pushed from the side of its rear surface side by the air cell 17, causing the upper massaging plate 11 and the lower massaging plate 12 to collapse inward in the rightward and leftward direction (toward the lower leg 22 of the user). Conversely, when the air cell 17 contracts, the upper massaging plate 11 and the lower massaging plate 12 retract outward in the rightward and leftward direction by the bias force applied from the torsion spring 21. Since the upper massaging air cell 18 and the lower massaging air cell 19 are capable of expansion and contraction independently of each other, the upper massaging plate 11 and the lower massaging plate 12, which are pushed by the air cells, are capable of protrusion and retraction (rotation) independently of each other.

Two intermediate air cells 23, which serve as intermediate massaging portions 15, are mounted at an intermediate region in the rightward and leftward direction of the support portion 7 and are located to be symmetric in the rightward and leftward direction with respect to a center line 25 (imaginary broken line in FIG. 2) of the support portion 7. As shown in FIG. 4, when the intermediate air cell 23 expands to push the lower leg 22 from inward, the lower leg 22 is sandwiched between the intermediate air cell 23 and the massaging plate 10 (or pressing element 26).

In this manner, when all of the air cells included in the leg rest 4, i.e., air cells 14, 18, 19, and 23, expand and contract, the massaging plate 10, the receiver plate 13, and the intermediate air cell 23, which serves as the intermediate massaging portion 15, protrude and retract. When all the air cells contract to cause the massaging plate 10, the receiver plate 13, and the intermediate massaging portion 15 to retract, the receiver plate 13, the elements of the support portion 7 which are located inward of the receiver plate 13 and include the intermediate air cell 23, and the massaging plate 10 form a substantially flat surface. Furthermore, the front surface of the leg rest 4 is substantially flat (see FIG. 3).

Figure 5:
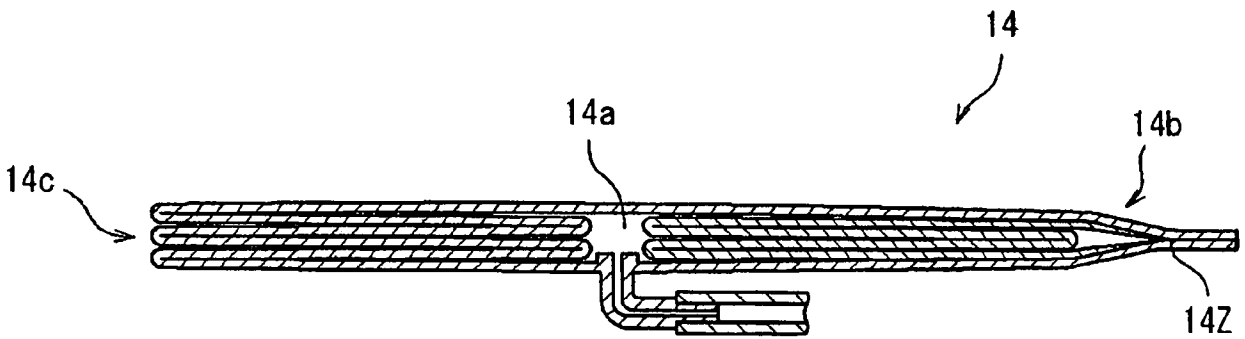
FIG. 5 is a cross-sectional view of a lower air cell in a contracted state.
Figure 6:
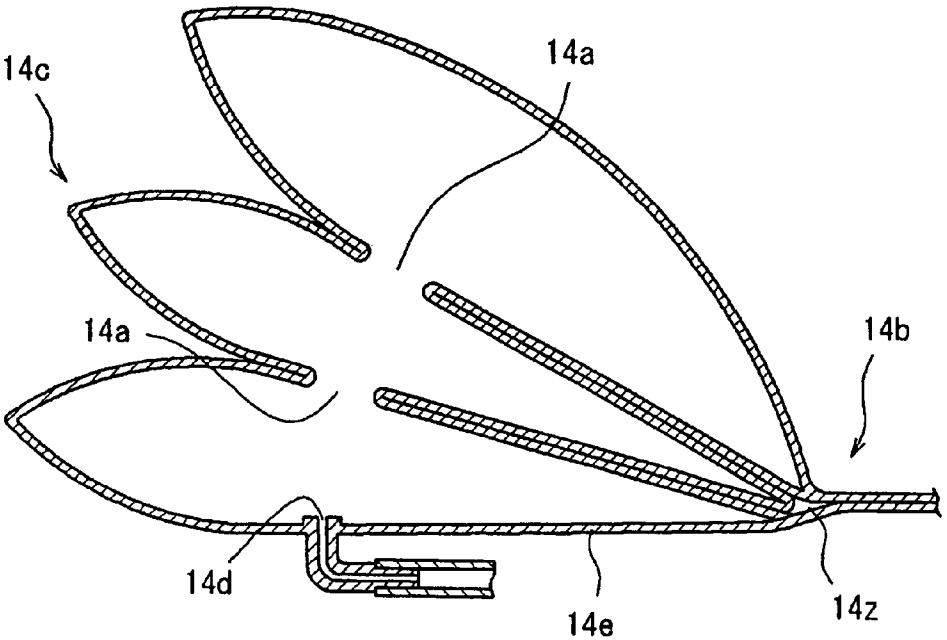
FIG. 6 is a cross-sectional view of the lower air cell in an expanded state.

Here, a structure of each air cell will be described in detail. FIG. 5 is a cross-sectional view of the lower air cell 14 in a contracted state and FIG. 6 is a cross-sectional view of the lower air cell 14 in an expanded state. The other cells (upper massaging air cell 18, lower massaging air cell 19, and intermediate air cell 23) have structures similar to that of the lower air cell 14 and will not be further described.

As shown in FIG. 6, the lower cell 14 is comprised of a plurality of (in this embodiment, three) air bags, and air spaces of the plurality of air bags communicate with each other through a through hole 14*a* to permit air communication between them. The plurality of air bags are coupled at one end side 14*b* of the lower air cell 14 so as not to expand. On the other hand, the air bags are not coupled at an opposite end side 14*c* and are therefore capable of expanding. With such a structure, when air is inflowed from the air inflow and outflow device (not shown) and flows into the lower air cell 14 through an air inlet 14*d*, the air flows through the through hole 14*a* and fills all the air bags, causing the lower cell 14 to expand (see FIG. 6). Since the air bags are configured not to expand at one end 14*b* and to be able to expand at the opposite end 14*c*, the opposite end 14*c* expands in a bellows-like manner, and thus, the lower air cell 14 expands in a substantially fan-shaped form in cross-section, as shown in FIG. 6. An end portion of the one end side 14*b* configured not to expand becomes a center 14*z* of a fan-shaped form of the substantially fan-shaped form in cross-section.

The air inlet 14*d* is desirably provided at a position which is not displaceable after the expansion and contraction (only at a bottom portion 14*e* which is located lowermost in the lower cell 14 of this embodiment). In this structure, the air inlet 14*d* does not limit the expansion of the lower air cell 14.

Thus, in the leg rest 4 of this embodiment, all the air cells 14, 18, 19 and 23 are capable of expanding in the substantially fan-shaped form in cross-section. Furthermore, placement of these air cells is devised.

The lower cell 14 is placed such that the center 14*z* is positioned inward in the rightward and leftward direction of the support portion 7 (see FIGS. 3 and 4). The center 14*z*, which is an expansion axis of the lower air cell 14, extends vertically. In this structure, since the center 14*z* of the lower air cell 14 and the first rotational axis Z1 which is a rotational axis of the receiver plate 13 which is pushed by the lower air cell 14 to rotate and is placed inward in the rightward and leftward direction of the receiver plate 13 (identical to a rotational axis of the hinge 20 mounted to the receiver plate 13) are disposed close to each other on the same side in the rightward and leftward direction, the lower air cell 14 and the receiver plate 13 are greatly movable at outward regions in the rightward and leftward direction (see FIG. 4). As a result, the receiver plate 13 rotates very efficiently by the expansion and contraction of the lower cell 14.

The same relationship is established between the massaging plate 10 and the air cells 17 (upper massaging air cell 18 and lower massaging air cell 19).

Each of the upper massaging air cell 18 and lower massaging air cell 19 is placed such that a center 18Z, 19Z of the fan-shaped form is positioned inward in the rightward and leftward direction of the support portion 7 when the upper massaging air cell 18 and lower massaging air cell 19 are in the contracted position (see FIGS. 3 and 4). The center 18Z, 19Z, which is a respective expansion axis of the upper massaging air cell 18 and lower massaging air cell 19, extends vertically. Thereby, since the respective centers 18Z, 19Z of the upper massaging air cell 18 and lower massaging air cell 19 and a second rotational axis Z2, which is a rotational axis (rotational axis of the hinge 20 mounted to the massaging plate 10) of the massaging plate 10 (including upper massaging plate 11 and the lower massaging plate 12) which is pushed by the upper massaging air cell 18 and lower massaging air cell 19 to rotate, are disposed close to each other on respective same sides in the rightward and leftward direction, the upper massaging air cell 18 and lower massaging air cell 19 are greatly movable at outward regions in the rightward and leftward direction. As a result, the massaging plate 10 (including upper massaging plate 11 and lower massaging plate 12) rotate very efficiently by the expansion and contraction of the upper massaging air cell 18 and lower massaging air cell 19.

It shall be understood that the first rotational axis Z1 and the second rotational axis Z2 are not shafts forming the respective shafts Z1 and Z2, but are imaginary axes which are the centers of rotation. Therefore, elements including the rotational axes Z1 and Z2 are meant to include elements which do not form shafts but have imaginary axes which become rotational centers, for example, thin hinges, as well as the hinges 20 having shafts.

In the above construction, the structure of the massaging portion 8 or the protrusible portion 9 becomes very simple. As a result, the chair-type massaging apparatus (especially leg rest 4) becomes small-sized and lightweight, and a manufacturing costs and component costs are reduced.

The intermediate air cells 23 which serve as the intermediate massaging portions are placed as described below. As described previously, the intermediate air cells 23 are provided on right and left sides to be symmetric in the rightward and leftward direction with respect to a center line 25 in the rightward and leftward direction (see FIG. 2). The right and left intermediate air cells 23 are placed such that their centers 23Z of fan-shaped form are positioned outward in the rightward and leftward direction (see FIGS. 3 and 4). The center axes 23Z which are expansion axes of the intermediate air cells 23 extend vertically. As shown in FIG. 4, since the right and left intermediate air cells 23 expand toward the right and left lower legs 22 of the user, the intermediate massaging portions 15 are able to efficiently press the right and left lower legs 22 from inward in the rightward and leftward direction. Since each lower leg 22 is sandwiched and massaged by the corresponding intermediate air cell 23 and massaging plate 10 (including upper massaging plate 11 and lower massaging plate 12), it is reliably and strongly pressed or massaged.

The chair-type massaging apparatus 1 of this embodiment constructed as described above makes it possible that the lower legs 22 are massaged with the user seated therein. In addition, when the massaging portion 8, the protrusible portion 9, and the intermediate massaging portion 15 retract, the protrusible portion 9, the elements of the support portion 7 which are located inward of the protrusible portion 9 in the rightward and leftward direction, and the massaging portion 8 form a substantially flat surface, so that the user can assume a posture freely without any interference. Furthermore, the chair-type massaging apparatus 1 has a relatively simple design and improves its external appearance.

The protrusible portions 9 are located on both sides in the rightward and leftward direction. The protrusible portions 9 protrude to rise up inward in the rightward and leftward direction, while they retract leftwardly and rightwardly. Therefore, in a retracted state of the protrusible portion 9, the lower leg 22 is not disturbed by the protrusible portion 9 and the support portion 7 located inward of the protrusible portion 9.

Since the massaging plate 10 is mounted on the protrusible portion 9 configured to protrude to rise up inward in the rightward and leftward direction and is configured to protrude and retract, a pressing angle or pressing position of the massaging portion 8 with respect to the lower leg 22 are set quite freely. By combining the rising angle of the protrusible portion 9 and the position or protruding angle of the massaging plate 10 in various ways, the pressing angle or the pressing position with respect to the lower leg 22 are set quite freely. Since the massaging plate 10 is not installed on a flexible air cell but on the receiver plate 13 of the protrusible portion 9 which is a part of the support portion 7, the massaging portion 8 is installed on a rigid base. As a result, positional or angular displacement of the massaging plate 10 is minimized, and the pressing angle or the pressing position, and the pressing force are set with high precision.

It is essential that the chair-type massaging apparatus massage the user suitably. Regarding a massager that massages the lower leg 22 of the user, it is essential that the pressing position, the pressing angle and the pressing force with respect to the lower leg 22 of the user be set optimally and accurately. The improvement of setting freedom and precision in the massaging apparatus enhances performance of the massaging apparatus.

As shown in FIG. 4, in this embodiment, the lower leg 22 is pressed from substantially forward toward rearward. The pressing position and the pressing angle of the massaging plate 10 (or pressing element 26) with respect to the lower leg 22 are finely adjustable by appropriately setting the position or angle of the massaging plate 10 provided on the receiver plate 13 rotating. For example, the pressing position is easily adjusted so that the lower leg 22 is pressed at plural acupuncture points thereof.

When the massaging portion 8 includes the rotatable massaging plate 10 and the protrusible portion 9 includes the rotatable receiver plate 13 as illustrated in this embodiment, a very simple structure is provided. In this embodiment, the first rotational axis Z1 which is the rotational axis of the receiver plate 13 and the second rotational axis Z2 which is the rotational axis of the massaging plate 10 are provided at different positions. To be specific, the first rotational axis Z1 and the second rotational axis Z2 extend vertically of the leg rest 4 substantially in parallel, and the second rotational axis Z2 is positioned outward of the first rotational axis Z1 in the rightward and leftward direction when the receiver plate 13 and massaging plate are in the retracted positions, respectively.

In contrast to the configuration in which the position of the first rotational axis Z1 coincides with that the second rotational axis Z2, the pressing angle and the pressing position of the massaging plate 10 with respect to the lower leg 22 are set quite freely.

While the leg rest 4 of the first embodiment is constructed such that the massaging plate 10 is comprised of the upper massaging plate 11 and the lower massaging plate 12, it may alternatively be divided into right and left parts or otherwise three or more parts. In a further alternative, the receiver plate 13 may be suitably divided. The massaging plate 10 and the receiver plate 13 may be thus divided and the air cells that push these plates may be placed at separate positions so as to correspond to these divided plates. Thereby, since the divided plates may independently protrude and retract, a variety of massaging patterns are created.

As shown in FIG. 3, the base 16 of the support portion 7 of the first embodiment is constructed such that the support surface 6 is set higher. In other words, the right and left sides outside the support surface 6 are set lower. For this reason, when the protrusible portion 9 (receiver plate 13) and the massaging portion 8 (massaging plate 10) retract, at least part of the receiver plate 13 and the massaging plate 10 are accommodated in the lower region. This desirably improves the above mentioned flatness. Furthermore, the region in which the intermediate massaging portion 15 (intermediate air cell 23) is located lower than the support surface 6, and at least part of the intermediate air cell 23 is accommodated in the lower region. Likewise, this desirably improves flatness.

Embodiment 2

Figure 7:
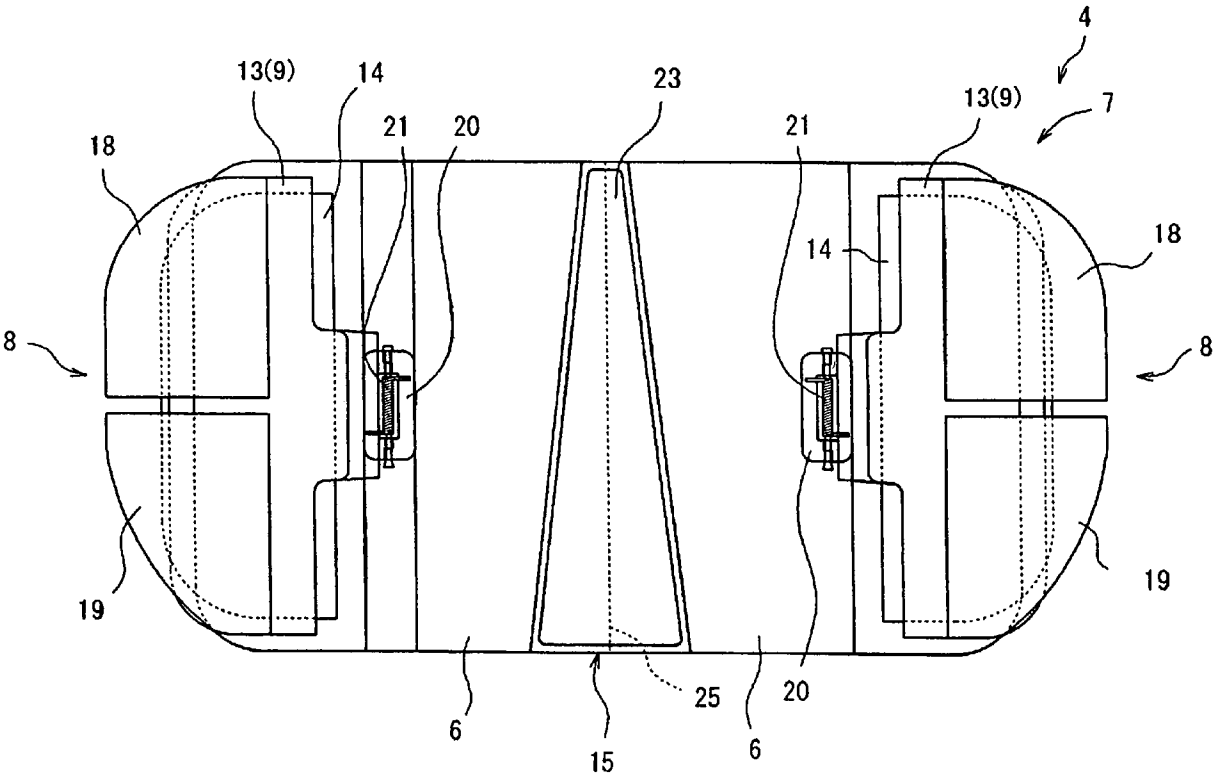
FIG. 7 is a front view of a leg rest according to a second embodiment of the present invention.
Figure 8:
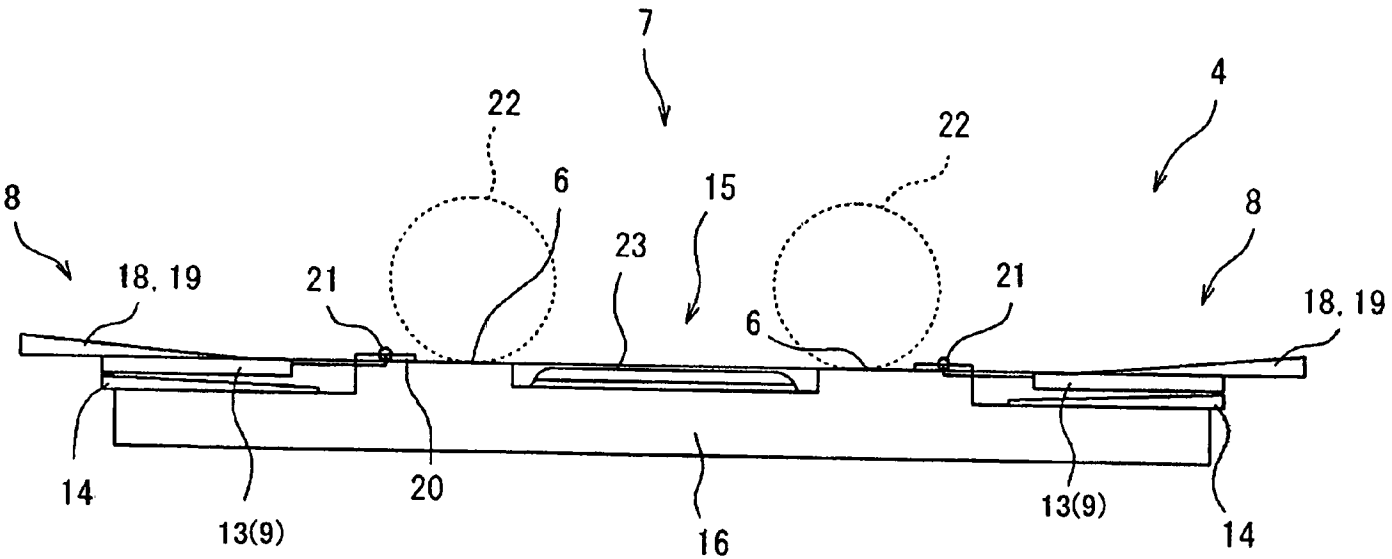
FIG. 8 is a plan view of the leg rest of FIG. 7, showing a state in which air cells contract.
Figure 9:
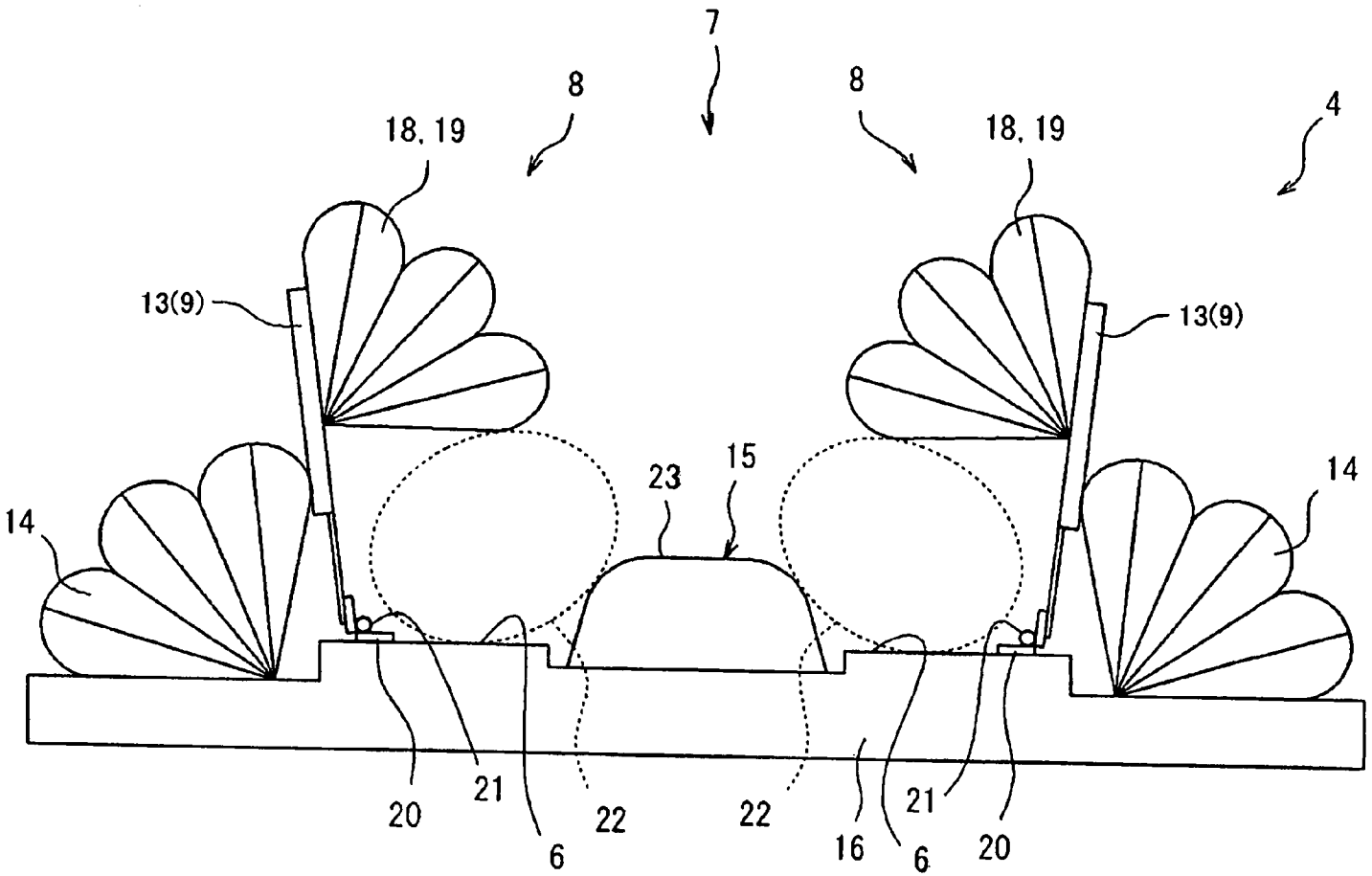
FIG. 9 is a plan view of the leg rest of FIG. 7, showing a state in which the air cells expand.

FIGS. 7 to 9 are views showing the leg rest 4 mounted to the chair-type massaging apparatus according to a second embodiment of the present invention. FIG. 7 is a front view of the leg rest 4. FIGS. 8 and 9 are plan views (FIG. 8 shows a contracted state of air cells and FIG. 9 shows an expanded state of the air cells).

In the second embodiment, one intermediate air cell 23, which serves as the intermediate massaging portion 15, is provided instead of two (two air cells on the right and left sides). The intermediate air cell 23 is configured not to expand in substantially fan-shaped form in cross-section, but to entirely expand forward substantially uniformly as shown in FIGS. 8 and 9.

As shown in FIG. 7, the intermediate air cell 23 is symmetric in the rightward and leftward direction with respect to an imaginary center line 25 in the rightward and leftward direction, and is shaped such that its width continuously decreases from its upper side to its lower side so as to well conform to the shape of the lower leg 22 whose thickness gradually decreases from its knee to its ankle. Thus, the intermediate massaging portion 15, the protrusible portion 9 or the massaging portion 8 is placed to be tilted with respect to the vertical direction so that a spacing between the massaging portion 8 and the intermediate massaging portion 15 decreases toward the lower side of the support portion 7 while protruded.

In the second embodiment, the massaging plate 10 and the pressing element 26 are omitted and the massaging portion 8 is comprised of the upper massaging air cell 18 and the lower massaging air cell 19. That is, the upper massaging air cell 18 (lower massaging air cell 19) presses the lower leg 22 without the massaging plate 10 and the pressing elements 26. Such a construction may be, as a matter of course, applied to the present invention.

Embodiment 3

Figure 10:
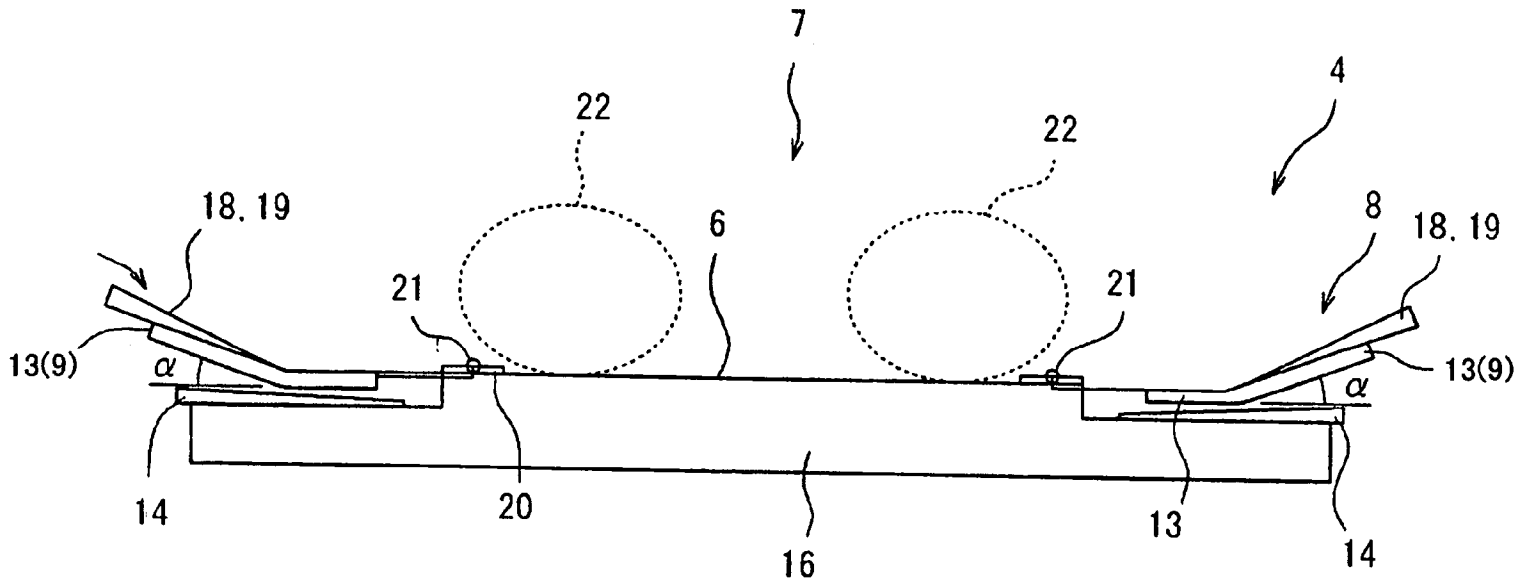
FIG. 10 is a plan view of a leg rest according to a third embodiment of the present invention, showing a state in which the air cells contract.
Figure 11:
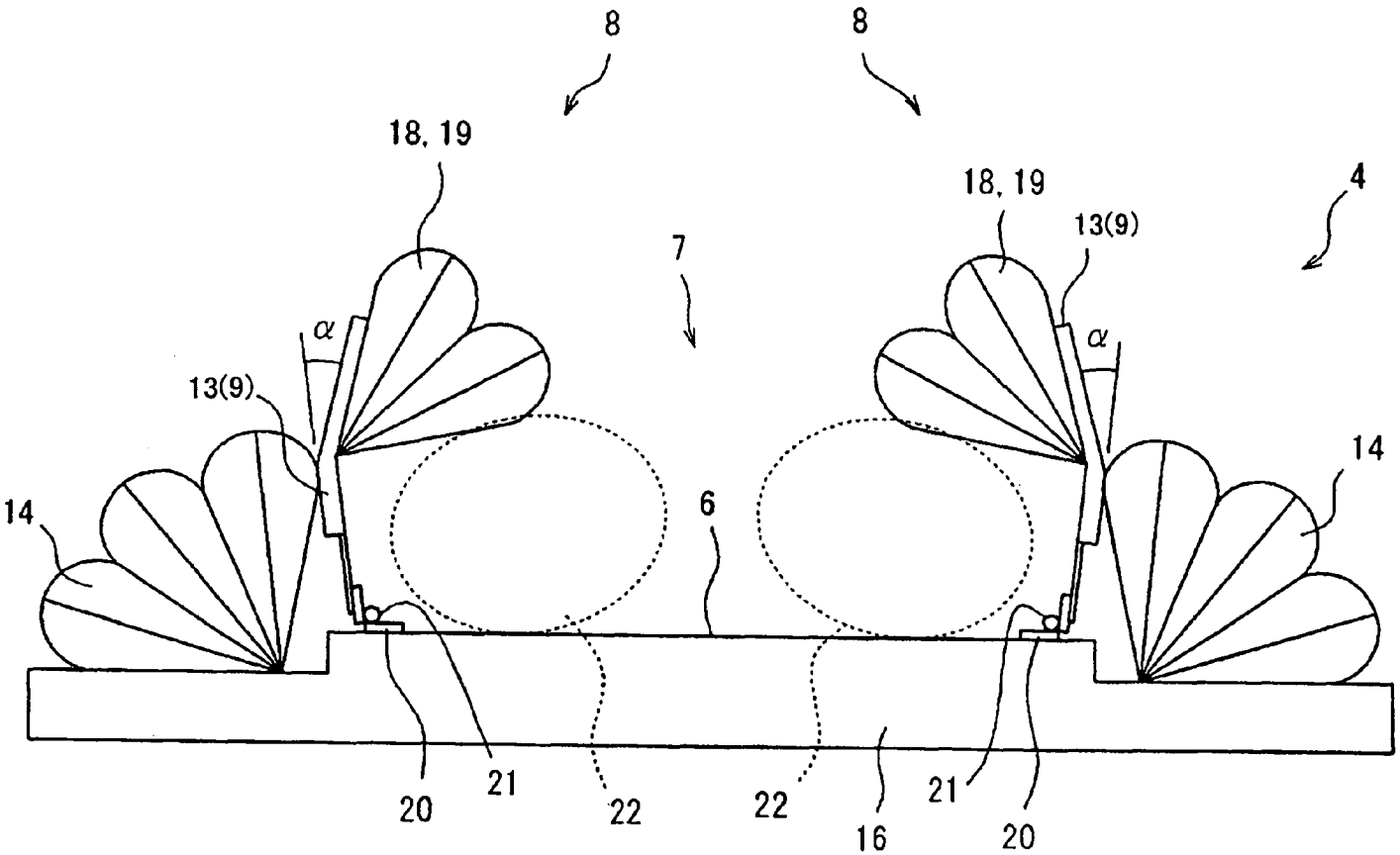
FIG. 11 is a plan view of the leg rest according to the third embodiment of the present invention, showing a state in which the air cells expand.

FIGS. 10 and 11 are plan views of the leg rest 4 according to a third embodiment of the present invention. FIG. 10 shows a contracted state of the air cells and FIG. 11 shows an expanded state of the air cells. In the third embodiment, the intermediate massaging portion 15 in the support portion 7 is omitted. In addition, differently from the first and second embodiments, the receiver plate 13 of the support portion 7 is not perfectly flat, and is bent $\alpha$ degrees forward in the vicinity of a substantially center position thereof in the rightward and leftward direction. The upper massaging air cell 18 and the lower massaging air cell 19 are provided as the massaging portion 8 to be positioned outward relative to the bent position in the rightward and leftward direction. In this construction, also, in the contracted state of the air cells, the protrusible portion 9, the elements of the support portion 7 which are located inward of the protrusible portion 9 and the massaging portion 8 form a substantially flat surface. Therefore, the user is not obstructed and may be seated more freely. It shall be understood that if the angle $\alpha$ is too large, then the flatness decreases, and therefore the angle $\alpha$ is desirably 30 degrees or less.

Embodiment 4

Figure 12:
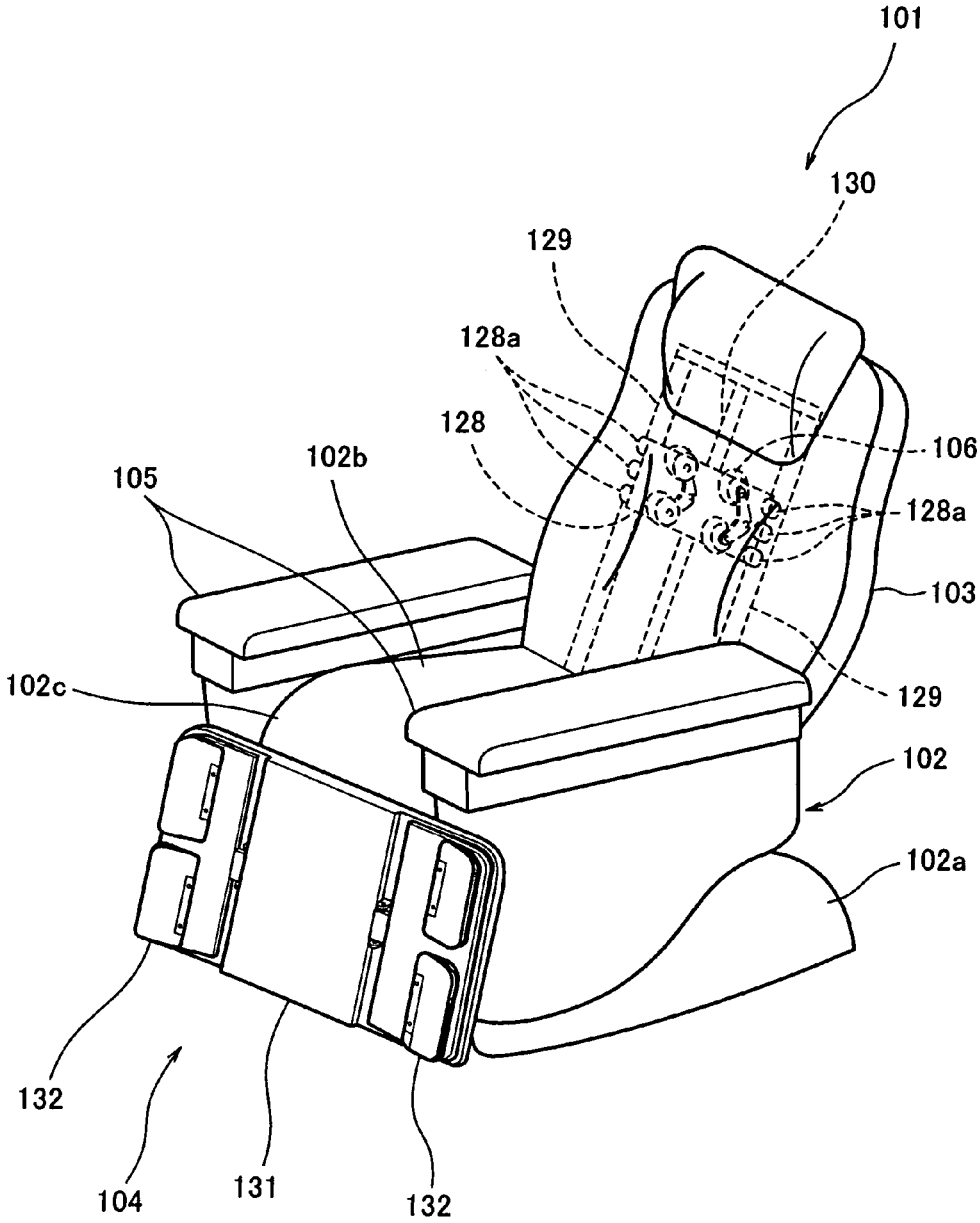
FIG. 12 is a perspective view showing a construction of an entire chair-type massaging apparatus according to a fourth embodiment of the present invention.

FIG. 12 is a perspective view showing a construction of an entire chair-type massaging apparatus according to a fourth embodiment of the present invention. As shown in FIG. 12, a chair-type massaging apparatus 101 of this embodiment is chair-shaped and mainly comprises a seat portion 102, a back rest 103, a leg rest 104, and arm rests 105. The seat portion 102 is constructed such that a cushion portion 102*c* whose upper surface is substantially flat for use as a seat surface 102*b* is provided on a base (not shown) having leg portions 102*a* on both sides of its lower portion. The cushion portion 102*c* is formed in such a manner that an internal material (not shown) such as urethane foam, sponge, or foamed polystyrene is provided over the upper surface of the base and is covered with an outer material (cover) formed of a raised-fiber tricot made of polyester, artificial leather, or natural leather, etc.

To a front side of an upper portion of the seat portion 102 (front side when viewed from the perspective of the user seated in the chair-type massaging apparatus 101, and right and left sides are viewed from the perspective of the user seated in the apparatus 101), the leg rest 104 is pivotally attached at an upper end thereof to massage the ankles and calves of the legs of the user. The leg rest 104 is pivotable forward and backward around the upper end thereof.

The leg rest 104 is entirely of a substantially flat-plate shape, and is configured to support the calves of the user on a front surface thereof. As described in detail later, the leg rest 104 is provided with a plurality of air cells (air bags) which are connected to an air inflow and outflow device 109 including a pump, a valve, and other components which are built in the seat portion 102 or the back rest 103 through air hoses 139 (see FIG. 21). The air cells expand or contract by air inflow and outflow by the air inflow and outflow device 109. With the user seated in the seat portion 102, the air cells expand and contract repeatedly, thus applying pressing stimulation to the legs.

A plurality of air cells are further provided on a back side of the seat surface 102*b* of the seat portion 102. These air cells are also connected to the air inflow and outflow device 109 through air hoses (not shown) and are configured to expand and contract by air inflow and outflow by the air inflow and outflow device 109. A vibrator (not shown) which is identical to that described previously is provided on a back side of the center of the seat surface 102*b* of the seat portion 102. With such a construction, the air cells expand and contract repeatedly to apply pressing stimulation to a hip of the user, and in this state, the vibrator is driven to apply vibration stimulation to an anus region of the user, with the user seated on the seat portion 102.

The back rest 103 is provided on a rear portion of the seat portion 102. The back rest 103 is sized so that an adult with a standard frame is seated on the chair-type massaging apparatus 101 so as not to protrude outward therefrom and is shaped to be substantially rectangular as viewed from front in order to support the upper half body of the user. The back rest 103 is pivotally mounted at a lower end portion thereof to the rear portion of the seat portion 102 by a horizontal pivot and is rotatable around the pivot to enable reclining forward and backward. The arm rests 105 are respectively provided on both sides of the back rest 103 and are fixedly supported on the base of the seat portion 102. The arm rests 105 extend forward from the both sides of the back rest 103 and are used as arm rests with the user seated in the chair-type massaging apparatus 101.

Figure 13:
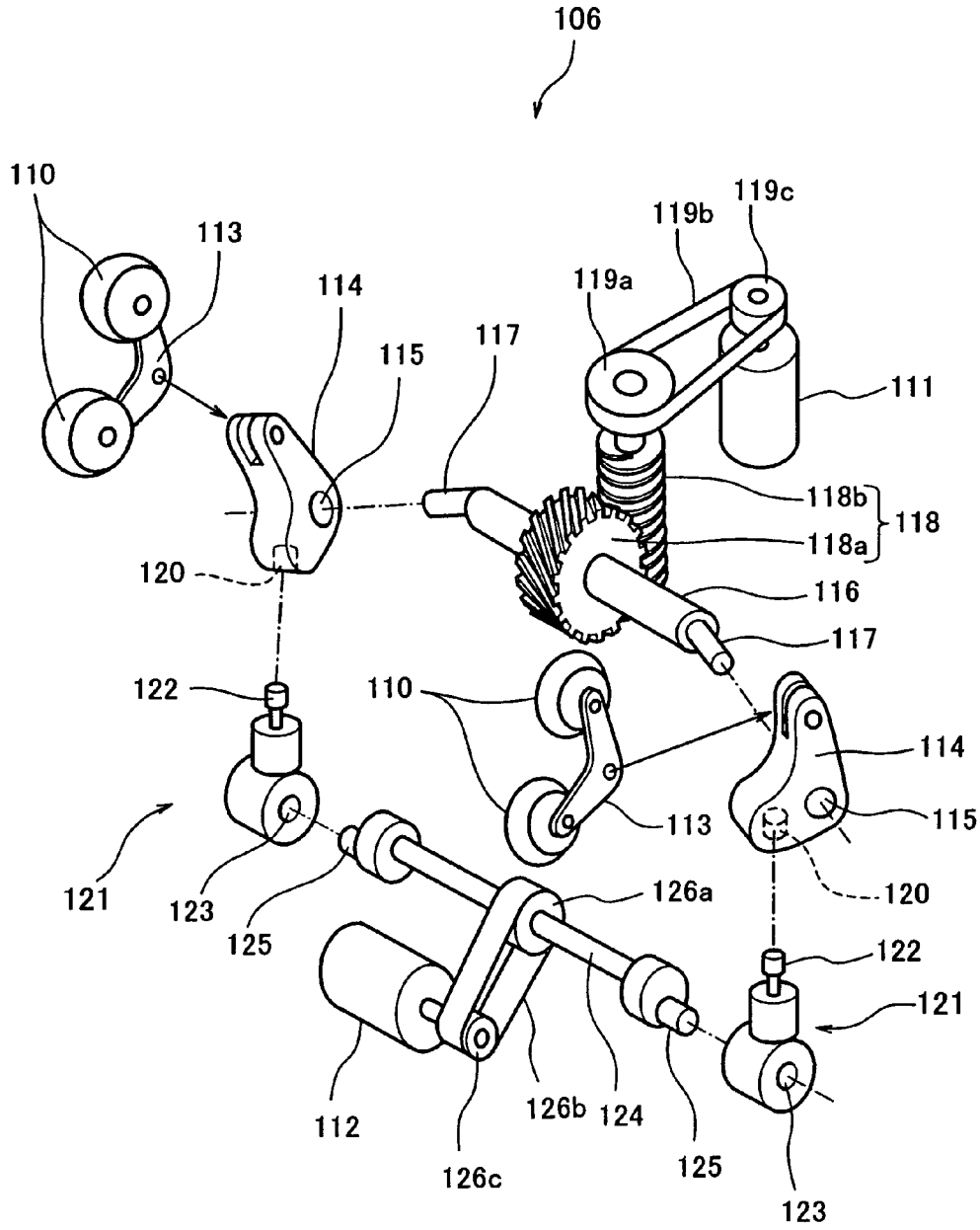
FIG. 13 is an exploded perspective view showing a construction of a massaging system included in the chair-type massaging apparatus according to the fourth embodiment of the present invention.

A massaging system 106 illustrated in FIG. 13 is mounted inside the back rest 103. FIG. 13 is an exploded perspective view showing a construction of the massaging system 106 included in the chair-type massaging apparatus 101 according to this embodiment of the present invention. The massaging system 106 includes four roller-shaped massaging elements 110 that apply mechanical stimulation to the body of the user and motors 111 and 112 of DC servo motors that drive the massaging elements 110 to displace. The massaging elements 110 are respectively mounted to tip ends of V-shaped arms 113. The arms 113 are respectively mounted to two substantially V-shaped connecting rods 114 to be rotatable within a predetermined range. Each connecting rod 114 is provided with a fitting hole 115. Tilted portions 117 are provided on both ends of a rotational shaft 116 and are loosely fitted into the fitting holes 115. The tilted portions 117 are tilted at a predetermined angle with respect to the rotational shaft 116. A helical gear 118*a* is coaxially mounted on an intermediate region of the rotational shaft 116 and is in mesh with a worm screw 118*b*. Thus, the helical gear 118*a* and the worm screw 118*b* form a worm gear system 118.

A pulley 119*a* is coaxially mounted on one end of the worm screw 118*b*. The pulley 119*a* is coupled to a pulley 119*c* mounted on an output shaft of the motor 111 through a belt 119*b*. Therefore, the rotation of the motor 111 is transmitted to the worm screw 118*b* through the belt 119*b*, causing the worm screw 118*b* to rotate. As a result, the rotational shaft 116 rotates. According to the rotation of the rotational shaft 116, the tilted portions 117 are displaced to draw conical paths. Thereby, the connecting rods 114 operate in a predetermined manner, causing the right and left massaging elements 110 to move close to and away from each other so as to draw a substantially oval shape both in the rightward and leftward direction and in the vertical direction. This operation corresponds to a kneading operation. The kneading operation of the massaging elements 110 includes forward movement (toward the user) in which the right and left massaging elements 110 move close to each other and rearward movement in which the massaging elements 110 move away from each other. In this manner, in the kneading operation, the massaging elements 110 move three-dimensionally.

As shown in FIG. 13, each connecting rod 114 is provided with a fitting hole 120 on a lower region thereof. A protruding portion 122 provided on a coupling element 121 is inserted into the fitting hole 120. The coupling element 121 is provided with a horizontal hole 123. Eccentric portions 125 are provided on both ends of a rotational shaft 124 and are fitted into the holes 123. A pulley 126*a* is coaxially mounted on an intermediate region of the rotational shaft 124 and is coupled to a pulley 126*c* mounted on the output shaft of the motor 112 through a belt 126*b*. Therefore, the rotation of the motor 112 is transmitted to the rotational shaft 124 through the belt 126*b*. Thereby, the eccentric portions 125 at both ends of the rotational shaft 124 rotate, causing the coupling elements 121 to move substantially vertically. As a result, the connecting rod 114 reciprocates around the fitting hole 115, causing the massaging elements 110 to reciprocate substantially vertically to draw a circular arc. When the motor 112 is rotated at a constant speed, the massaging elements 110 reciprocate in a fixed cycle, which corresponds to a tapping operation of the massaging element 110. When the motor 112 is rotated while changing a rotation speed, the massaging elements 110 reciprocate in a variable cycle, which corresponds to a pressing operation of the massaging elements 110.

As should be appreciated from the above, the massaging elements 110 are driven by the motor 111 to perform the kneading operation and are driven by the motor 112 to perform the tapping operation or the pressing operation. When the massaging elements 110 are driven by both the motors 111 and 112, the kneading operation and the tapping operation are combined, or the kneading operation and the pressing operation are combined. As a matter of course, these operations may be independently carried out.

The massaging system 106 is, as shown in FIG. 12, mounted to an up-down base 128. Rollers 128*a* are mounted at both side ends of the up-down base 128. The rollers 128*a* are supported on guide rails 129 to be able to roll along them. Nuts (not shown) are provided on the up-down base 128. A threaded rod 130 is provided in parallel with the guide rails 129 and is threadedly engaged with the nuts. The threaded rod 130 is pivotally mounted at upper and lower end portions thereof. The lower end portion of the threaded rod 130 is coupled to an output shaft of a motor (not shown) provided on a lower portion of the back rest 103. Therefore, when the threaded rod 130 is driven by the motor to rotate, the up-down base 128 having the nuts is inhibited from rotating integrally with the threaded rod 130 and the nuts and the threaded rod 130 rotate relative to each other because the rollers 128*a* are engaged with the guide rails 129, so that the up-down base 128 and the massaging system 106 move up and down. With such a construction, when the massaging system 106 moves up and down with the upper half of the body of the user leaning on the back rest 103, a rolling operation is carried out in such a manner that the massaging elements 110 roll on the back of the user vertically.

Figure 14:
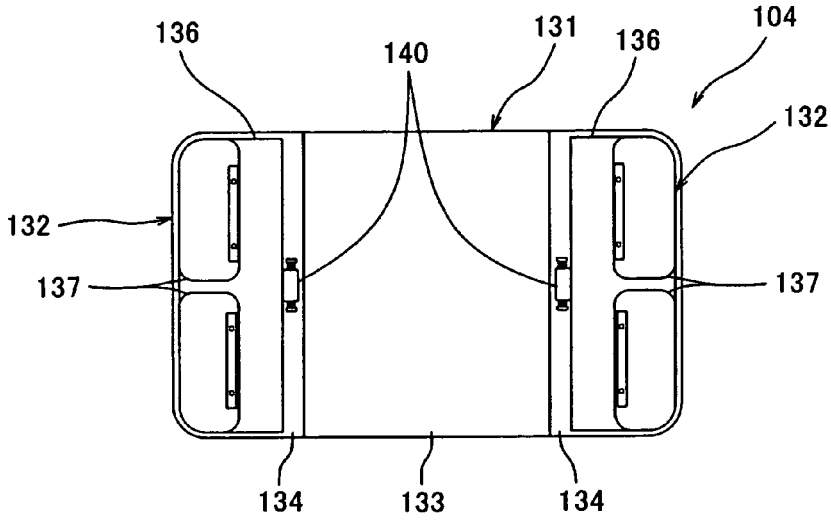
FIG. 14 is a front view showing a construction of a leg rest included in the chair-type massaging apparatus according to the fourth embodiment of the present invention.
Figure 15:
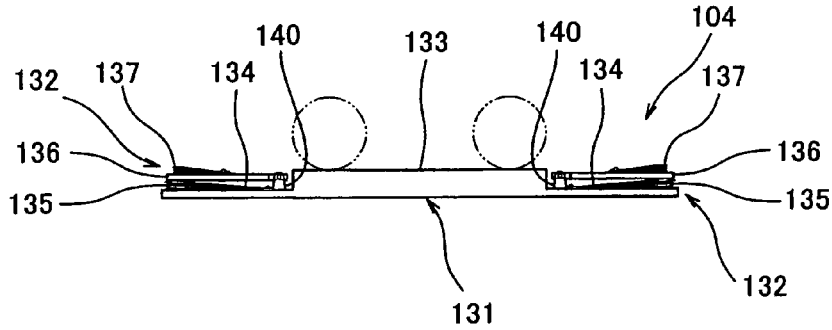
FIG. 15 is a plan view showing a construction of the leg rest included in the chair-type massaging apparatus according to the fourth embodiment of the present invention.
Figure 16:
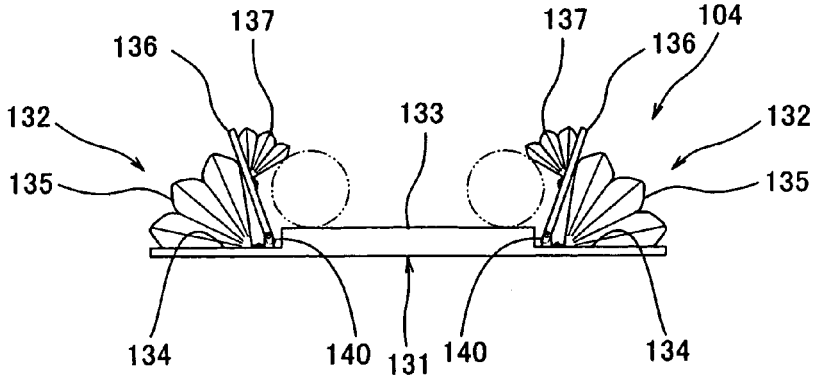
FIG. 16 is a plan view showing a construction of the leg rest included in the chair-type massaging apparatus according to the fourth embodiment of the present invention.

Subsequently, a construction of the leg rest 104 will be described in detail. For the sake of simple explanation, as described below, the leg rest 104 is illustrated as extended substantially downward from a front end of the seat surface 102*b*, except for the condition specifically described. FIG. 14 is a front view showing the construction of the leg rest 104 provided in the chair-type massaging apparatus 101 according to the fourth embodiment of the present invention. FIGS. 15 and 16 are plan views of the leg rest 104. As shown in FIGS. 14 to 16, the leg rest 104 of this embodiment mainly includes a support portion 131 and massaging portions 132. The support portion 131 is of a substantially flat plate shape, and is pivotally mounted at an upper end thereof to a front side of an upper portion of the seat portion 102 by a pivot extending horizontally (see FIG. 12).

As shown in FIGS. 14 to 16, an intermediate region in the width direction of the support portion 131 forms a support surface 133 on which rear regions of the lower legs of the user, i.e., the calves of the legs of the user, are supported. Mounting surfaces 134 are respectively provided on fight and left sides outside the support surface 133 of the support portion 131 such that they are set one-step lower than the support surface 133 and extend substantially in parallel with the support surface 133. The massaging portion 132 is mounted to each mounting surface 134 and mainly includes a rear air cell (rear air bag) 135, a receiver plate 136, and a front air cell (front air bag) 137.

In the fourth embodiment, the mounting surface 134 is located one-step lower than the support surface 133 to form a step between them; however, the mounting surface and support surface alternatively may form a flat surface.

Figure 17:
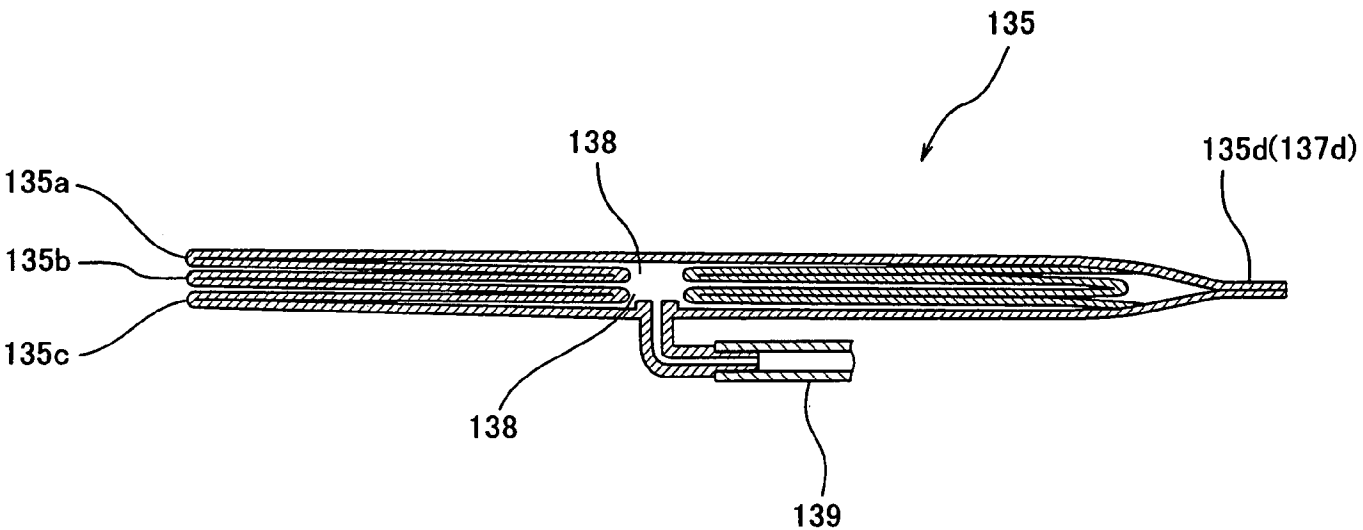
FIG. 17 is a plan cross-sectional view showing a construction of a rear air cell in a contracted state.
Figure 18:
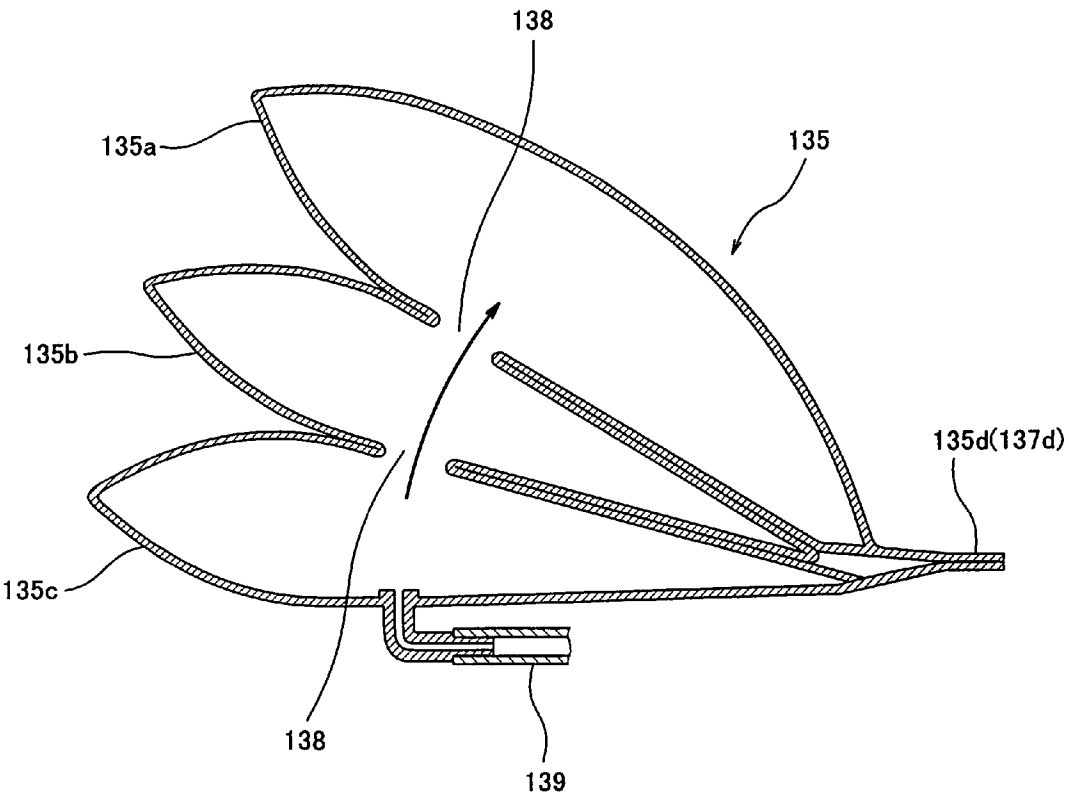
FIG. 18 is a plan cross-sectional view showing a construction of the rear air cell in an expanded state.

FIG. 17 is a plan cross-sectional view showing a construction of the rear air cell 135 in a contracted state and FIG. 18 is a plan cross-sectional view showing a construction of the rear air cell 135 in an expanded state. As shown in FIGS. 17 and 18, the rear air cell 135 includes a plurality of air bags 135*a* to 135*c* (three in FIGS. 17 and 18) that are superimposed. A hole 138 is provided at a join portion between adjacent air bags 135*a* and 135*b* and a joint portion between the air bags 135*b* and 135*c* to allow the air bags 135*a* to 135*c* to communicate with each other therethrough. An air hose 139 is connected to the air bag 135 in contact with the mounting surface 134 to allow air to be inflowed and outflowed therethrough. A hole (not shown) is provided on the mounting surface 134 of the support portion 131, and through the hole, the air hose 139 is connected to the air inflow and outflow device 109 provided in the seat portion 102 or in the back rest 103. The air inflow and outflow device 109 inflows and outflows the air to cause the rear air cell 135 to expand or contract.

An outer end of the rear air cell 135, i.e., an end portion of the rear air cell 135 that is distant from the support surface 133 is expandable in a bellows-like manner. On the other hand, an inner end of the rear air cell 135, i.e., an end portion of the rear air cell 135 which is closer to the support surface 133 forms an expansion inhibiting portion 135*d* to inhibit the end portions of the air bags 135*a* to 135*c* from traveling away from each other. In the expansion inhibiting portion 135*d*, an end portion of the air bag 135*a* and an end portion of the air bag 135*c* are coupled to each other so as not to be away from each other. Since the air bag 135*b* is interposed between the air bags 135*a* and 135*c*, an end portion of the air bag 135*b* is not away from these unless the end portions of the air bags 135*a* and 135*c* move away from each other. Thus, the inner end of the rear air cell 135 is configured not to expand.

As shown in FIG. 17, with the air outflowed from the rear air cell 135, the rear air cell 135 is substantially flat. In this state, when the air is inflowed to the rear air cell 135, the outer end of the rear air cell 135 expands with the inner end of the rear air cell 135 remaining unexpanded, and as a result, the rear air cell 135 expands in substantially fan-shaped form as shown in FIG. 18.

As shown in FIGS. 14 to 16, the rear air cell 135 is mounted to the mounting surface 134 in such a manner that the expansion inhibiting portion 135*d* is fixed to the mounting surface 134. In this construction, the inner end of the rear air cell 135 is configured not to move away from the mounting surface 134 when the rear air cell 135 expands in fan-shaped form.

The receiver plate 136 is mounted in front of the rear air cell 135. The receiver plate 136 is of a substantially rectangular shape and has an area that is slightly larger than that of a main surface of the rear air cell 135 so as to entirely cover the rear air cell 135. The main surface of the receiver plate 136 has an area that is slightly smaller than that of the mounting surface 134. The receiver plate 136 is mounted at an inner end intermediate region thereof by a hinge 140 in the vicinity of the step portion between the mounting surface 134 and the support surface 133 of the support portion 131. The receiver plate 136 is pivotable forward and backward around a pivot extending in the longitudinal direction by the hinge 140. The receiver plate 136 may be made of a relatively hard material such as a metal, or otherwise may be made of a relatively flexible material such as synthetic resin.

Figure 19:
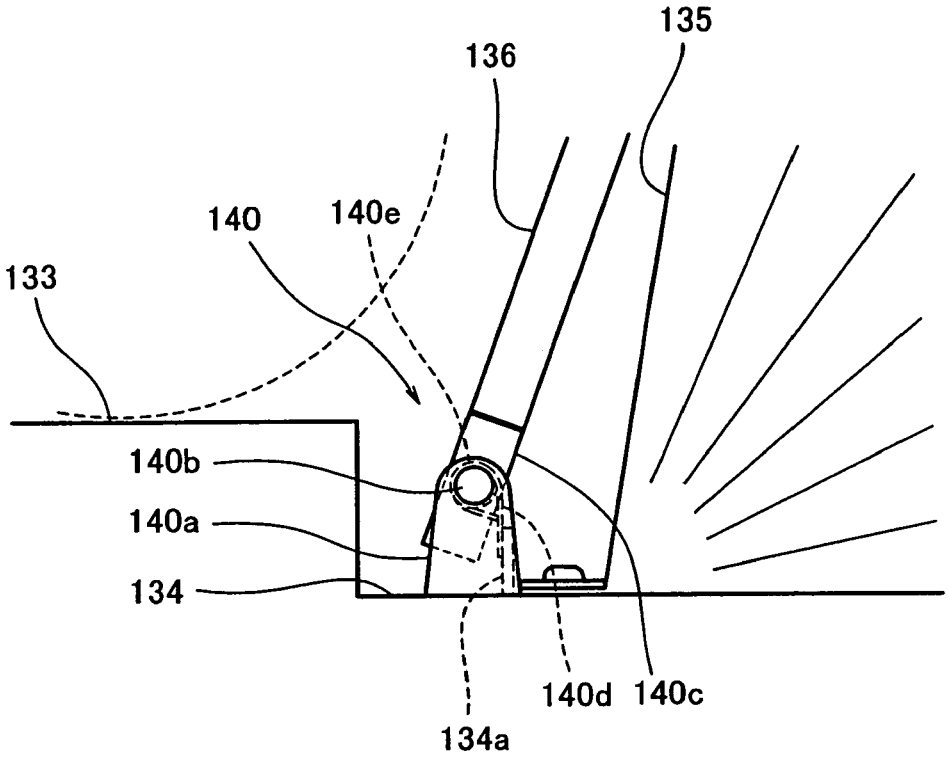
FIG. 19 is a partially enlarged plan view showing a hinge structure of a receiver plate according to the fourth embodiment of the present invention.

FIG. 19 is a partially enlarged plan view showing a hinge structure of the receiver plate 136. The hinge 140 includes two support elements 140*a* arranged in the vertical direction to protrude and a pin 140*b* connecting the support elements 140*a*, in a substantially intermediate region in the longitudinal direction of the mounting surface 134 and in the vicinity of the step portion between the mounting surface 134 and the support surface 133. An extending portion 140*c* extends from an intermediate region of a base end of the receiver plate 136 and has a width (longitudinal length) slightly smaller than a distance between the support elements 140*a*. The extending portion 140*c* is provided with a hole extending in the longitudinal direction, i.e., in the longitudinal direction of the receiver plate 136. The extending portion 140*c* is provided between the support elements 140*a*. The pin 140*b* loosely extends through the hole of the extending portion 140*c*. In this manner, the receiver plate 136 is pivotally mounted to the support portion 131.

The receiver plate 136 is biased by a coil spring 140*d* as described below. The coil spring 140*d* includes coil portions 140*e* at both ends thereof, which are coupled to each other by a coupling element (not shown) of a straight line shape. The coil spring 140*d* is formed of spring steel. Each coil portion 140*e* is provided between the extending portion 140*c* and the support element 140*a*. The pin 140*b* extends through the coil portions 140*e*. Both ends of the coil spring 140*d* extend in a straight line shape. An engagement plate 134*a* is provided to protrude from a region of the mounting surface 134 which are located outward of the support element 140*a*. The coil spring 140*d* is engaged at both ends with the engagement plates 134*a*. The coupling element of the coil spring 140*d* engages with the extending portion 140*c*. Thus, the receiver plate 136 is biased to move closer to the mounting surface 134 by an elastic force exerted by the coil spring 140*d*. When the rear air cell 135 expands, the receiver plate 136 rotates forward against the force exerted by the coil spring 140*d*, while when the rear air cell 135 contracts, the receiver plate 136 returns to a position which is substantially parallel to the mounting surface 134 by the force of the coil spring 140*d*.

As a return device for the receiver plate 136, the illustrated coil spring 140*d* is merely exemplary. Alternatively, a front surface portion of the rear air cell 135 may be bonded to a rear surface of the receiver plate 136 so that the receiver plate 136 returns to a position substantially parallel to the mounting surface 134 upon contraction of the air cell 135.

As shown in FIGS. 14 to 16, two front air cells 137 are arranged in the vertical direction on a front surface of the receiver plate 136. The front air cells 137 are constructed to be similar to and smaller than the rear air cells 135. As in the rear air cell 135, the front air cell 137 is substantially flat and expands in fan-shaped form by inflowing air. The width of each front air cell 137 is about half of the width of the receiver plate 136. Each front air cell 137 is mounted to a substantially outer half region of the front surface of the receiver plate 136. Each front air cell 137 is placed in such a manner that an unexpandable end is located inward, i.e., closer to the support surface 133, and an expandable end is located outward, i.e., distant from the support surface 133. The front air cell 137 is mounted to the receiver plate 136 with the expansion inhibiting portion 137*d* (see FIGS. 17 and 18) fixed to the receiver plate 136. In this embodiment, the massaging portion constructed above forms an expandable portion of the present invention.

While the chair-type massaging apparatus 101 is not in use, the rear air cell 135 and the front air cell 137 respectively contract to cause a front portion of the massaging portion 132 to become substantially flat as shown in FIG. 15. As a result, the leg rest 104 forms a substantially flat plate shape, and hence the chair-type massaging apparatus 101 has entirely a simple external appearance.

The user seated in the chair-type massaging apparatus 101 in such a state can easily place the lower legs on the leg rest 104 because the front surface of the leg rest 104 is substantially flat. When the lower legs are not massaged or otherwise the chair-type massaging apparatus 101 is used as an easy chair, the lower legs of the user are not restricted and therefore the user can assume a desired posture freely because the front surface of the leg rest 104 is substantially flat.

When the rear air cells 135 and the front air cells 137 expand in fan-shaped form with the calves of the user placed on the support surface 133, the right and left receiver plates 136 rotate forward around the hinges 140 by the expansion of the rear air cells 135 such that the fight and left receiver plates 136 are substantially opposite to the outer regions of the lower legs of the user. Also, by expansion of the front air cells 137, pressing surfaces which are front surfaces of the left front air cells 137 rotate rightward and rearward and pressing surfaces of the fight front air cells 137 rotate leftward and rearward, thereby pressing outer regions of the shins of the user including acupuncture points such as sanri and horyu inward and rearward. As a result, the user can expect effects such as facilitating of blood circulation, recovery from fatigue, relaxation, function adjustments of internal organs.

Figure 20:
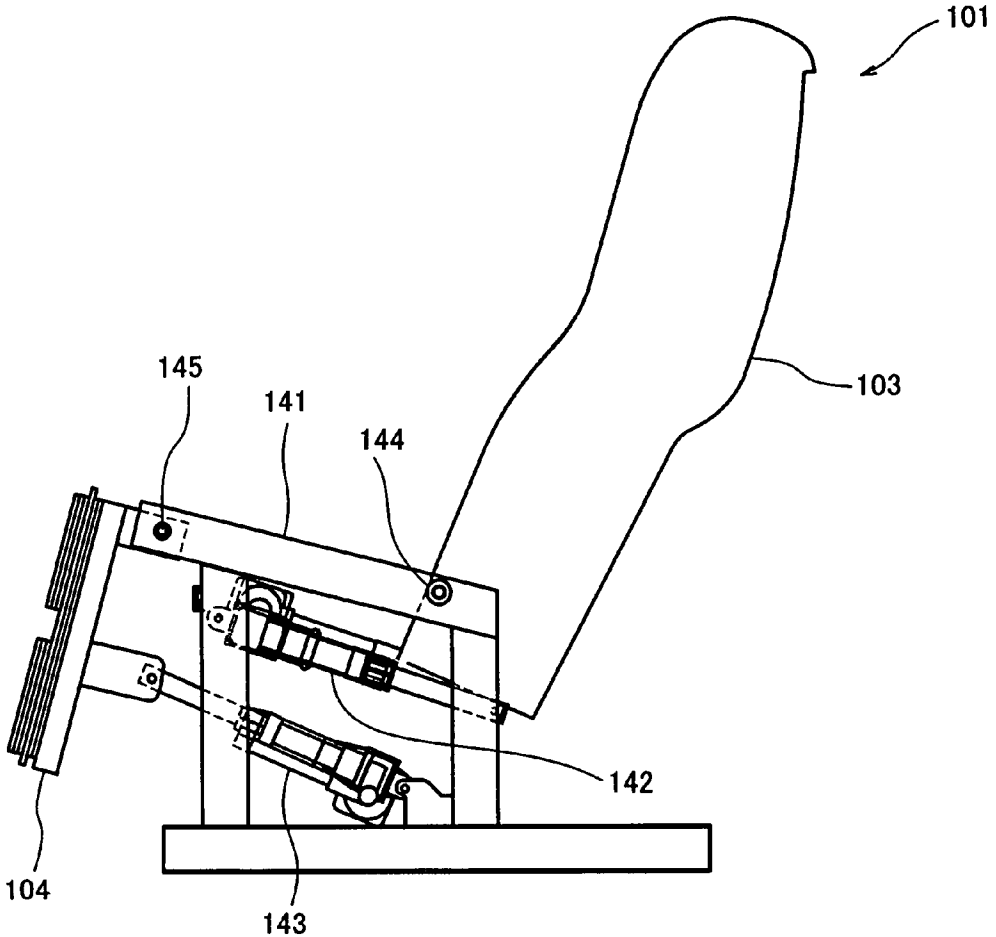
FIG. 20 is a side view showing a rotating structure of the leg rest according to the fourth embodiment of the present invention.

FIG. 20 is side view for explaining a rotating structure of the leg rest 104. As shown in FIG. 20, a frame structure 141 is mounted inside the seat portion 102. Direct-acting type actuators 142 and 143 are attached to the frame structure 141. The actuator 142 is pivotally mounted at one end thereof to the frame structure 141 such that it is pivotable around a pivot extending horizontally and at an opposite end thereof to a lower end portion of the back rest 103 such that it is pivotable around a pivot extending horizontally. The actuators 142 and 143 respectively include electric motors. The rotation of output shafts of the electric motors is converted into straight-line movement, and thus, the actuators 142 and 143 expand and contract. The actuator 142 is mounted to the frame structure 141 at a position forward relative to a position at which the actuator 142 is mounted to the back rest 103. The actuator 142 is placed to extend substantially forward and backward. The back rest 103 is pivotally mounted in the vicinity of a lower end portion thereof to the frame structure 141 to be pivotable around a pivot 144 extending horizontally. When the actuator 142 expands and contracts, the back rest 103 is pivotable forward and backward around the pivot 144, thus changing a reclining angle.

The actuator 143 is pivotally mounted at one end thereof to the frame structure 141 to be pivotable around a pivot extending horizontally, and at an opposite end thereof to a rear portion of the leg rest 104 to be pivotable around a pivot extending horizontally. The actuator 143 is mounted to the frame structure 141 at a position rearward relative to a position at which the actuator 143 is mounted to the leg rest 104. The actuator 143 is placed to extend substantially forward and backward. The leg rest 104 is pivotally mounted at an upper end thereof to the frame structure 141 to be pivotable around a pivot 145 extending horizontally. When the actuator 143 expands and contracts, the leg rest 104 is pivotable forward and backward around a pivot 145, thus changing a tilting angle of the leg rest 104.

In the fourth embodiment, the reclining device of the back rest 103 and the rotation device of the leg rest 104 are the direct-acting type actuators 142 and 143 including the motors; however, these are merely exemplary. Alternatively, other direct-acting type actuators including air cylinders or linear motors may be used. In addition, air bags may cause the back rest 103 or the leg rest 104 to pivot. In a further alternative, the back rest 103 may be reclined manually or the leg rest 104 may be rotated manually.

Figure 21:
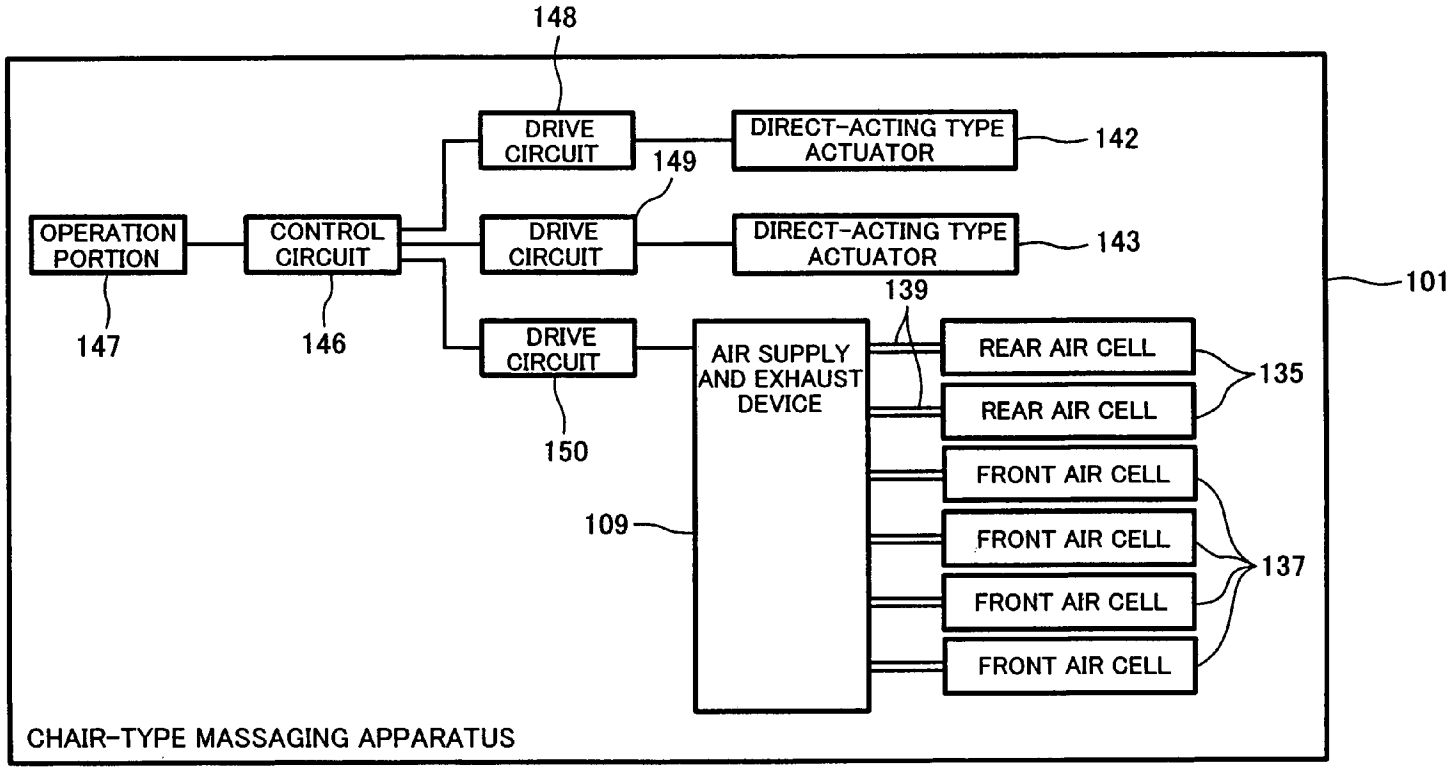
FIG. 21 is a block diagram showing a part of a configuration of the chair-type massaging apparatus according to the fourth embodiment of the present invention.

FIG. 21 is a block diagram showing a part of a configuration of the chair-type massaging apparatus 101 according to the fourth embodiment of the present invention. As shown in FIG. 21, the chair-type massaging apparatus is provided with a control circuit 146. The control circuit 146 includes a CPU, ROM, RAM, an input/output interface, etc and is provided inside the seat portion 102 or the back rest 103. The control circuit 146 is coupled to an operation portion 147 provided with a plurality of operation keys and to drive circuits 148 to 150. The control circuit 146 is configured to receive an operation signal from the operation portion 147 and to transmit a control signal according to the operation signal to the drive circuits 148 to 150. The operations of the chair-type massaging apparatus 101 according to the operation keys and their combinations are preset in the control circuit 146. When the user presses an operation key corresponding to a desired operation, the operation signal is transmitted to the control circuit 146, which outputs a control signal corresponding to the operation input.

The drive circuits 148 and 149 are coupled to the direct-acting type actuators 142 and 143, respectively. This makes it possible to freely change the reclining angle of the back rest 103 and the tilting angle of the leg rest 104 according to the user's operation with the operation portion 147.

The drive circuit 150 is coupled to the air inflow and outflow device 109 and is configured to drive the air inflow and outflow device 109 according to the control signal received from the control circuit 146. The control circuit 146 is configured to control the operation of the air inflow and outflow device 109. The air inflow and outflow device 109 includes a switching valve such as an electromagnetic valve, an air pump, and other components, and is coupled to the rear air cells 135 and the front air cells 137 through air hoses 139. The air inflow and outflow device 109 is capable of independently inflowing and outflowing air respectively to each of the rear air cells 135 and the front air cells 137.

Figure 22:
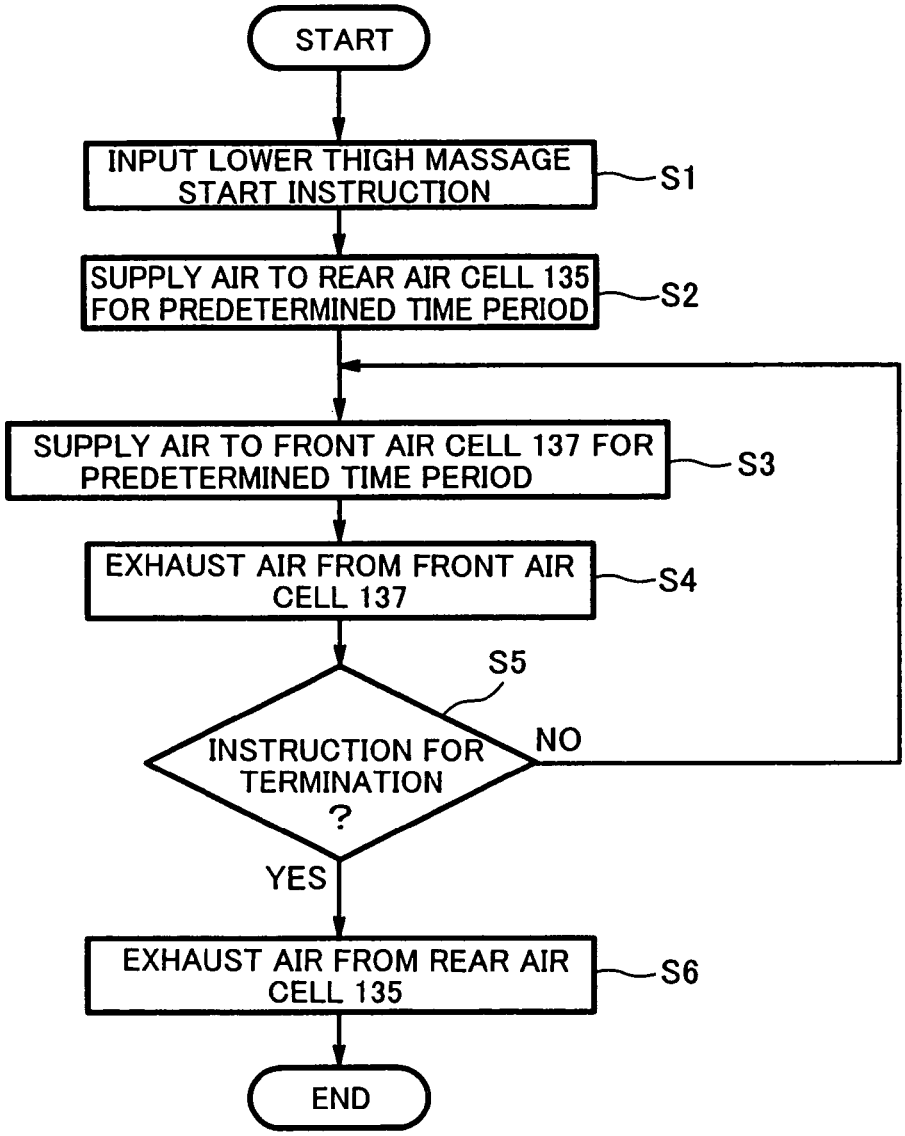
FIG. 22 is a flowchart showing an example of an operation control of the leg rest included in the chair-type massaging apparatus according to the fourth embodiment of the present invention.

An operation control of the leg rest 104 will be described. FIG. 22 is a flowchart showing an example of the operation control of the leg rest 104 in the chair-type massaging apparatus 101 according to the fourth embodiment of the present invention. When the user seated in the chair-type massaging apparatus 101 performs a predetermined input operation to instruct the leg rest 104 to start massaging the lower legs (step S1), the control circuit 146 sends a predetermined control signal to the drive circuit 150 to control the operation of the air inflow and outflow device 109 so that the air is inflowed to the rear air cells 135 for a preset time period (step 52). This causes the receiver plates 136 to rotate forward. Thereafter, the receiver plates 136 are fixed when the air inflow to the rear air cells 135 stops.

Subsequently, the control circuit 146 sends a predetermined control signal to the drive circuit 150 to control the operation of the air inflow and outflow device 109 so that the air is inflowed to the front air cells 137 for a preset time period (step S3). This causes the front air cells 137 to expand in fan-shaped form to press outer regions of the shins of the user inward and rearward.

After a set time period elapses from the start of the air inflow to the front air cells 137, the control circuit 146 sends a predetermined control signal to the drive circuit 150 to control the operation of the air inflow and outflow device 109 so that the air is outflowed from the front air cells 137 (step S4). This releases the pressing force applied to the outer regions of the shins of the user.

The control circuit 146 determines whether or not there is an instruction from the user for terminating massaging the lower legs (step 55). If it is determined that there is no instruction, the control circuit 146 returns the process to step 53. On the other hand, if it is determined that there is an instruction in step 55, the control circuit 146 sends a predetermined control signal to the drive circuit 150 to control the operation of the air inflow and outflow device 109 so that the air is outflowed from the rear air cells 135 (step S6), thus terminating the process.

The front air cells 137 repeat expansion and contraction to repeatedly press the outer regions of the shins of the user unless the instruction for terminating massaging the lower legs is received from the user. The massage strength of the lower legs can be adjusted by the user's predetermined input operation with the operation portion 147 in such a manner that in order to increase the massage strength, the time period during which the air is inflowed to the rear air cells 135 is set longer, while in order to decrease the massage strength, the time period during which the air is inflowed to the rear air cells 135 is set shorter. It shall be appreciated that the time period during which the air is inflowed to the front air cells 137 may be configured to be changed.

Furthermore, instead of changing the time periods during which the air is inflowed to the rear air cells 135 and the front air cells 137, an air inflow amount for the same time period may be adjusted, thus adjusting the massage strength.

The number and size of the rear air cells 135, the receiver plates 136, and the front air cells 137 are not intended to be limited to those illustrated in the fourth embodiment. Alternatively, the rear air cells 135, the receiver plates 136, and the front air cells 137 may be substantially equally sized and one of them may be mounted for each lower leg of the user. Also, the rear air cell 135 and the front air cell 137 need not be superimposed with the receiver plate 136 interposed between them. For example, each of the rear air cell 135 and the front air cell 137 may include only one air bag or otherwise may be superimposed without the receiver plate 136. Furthermore, they may include three or more air bags superimposed.

Embodiment 5

Figure 23:
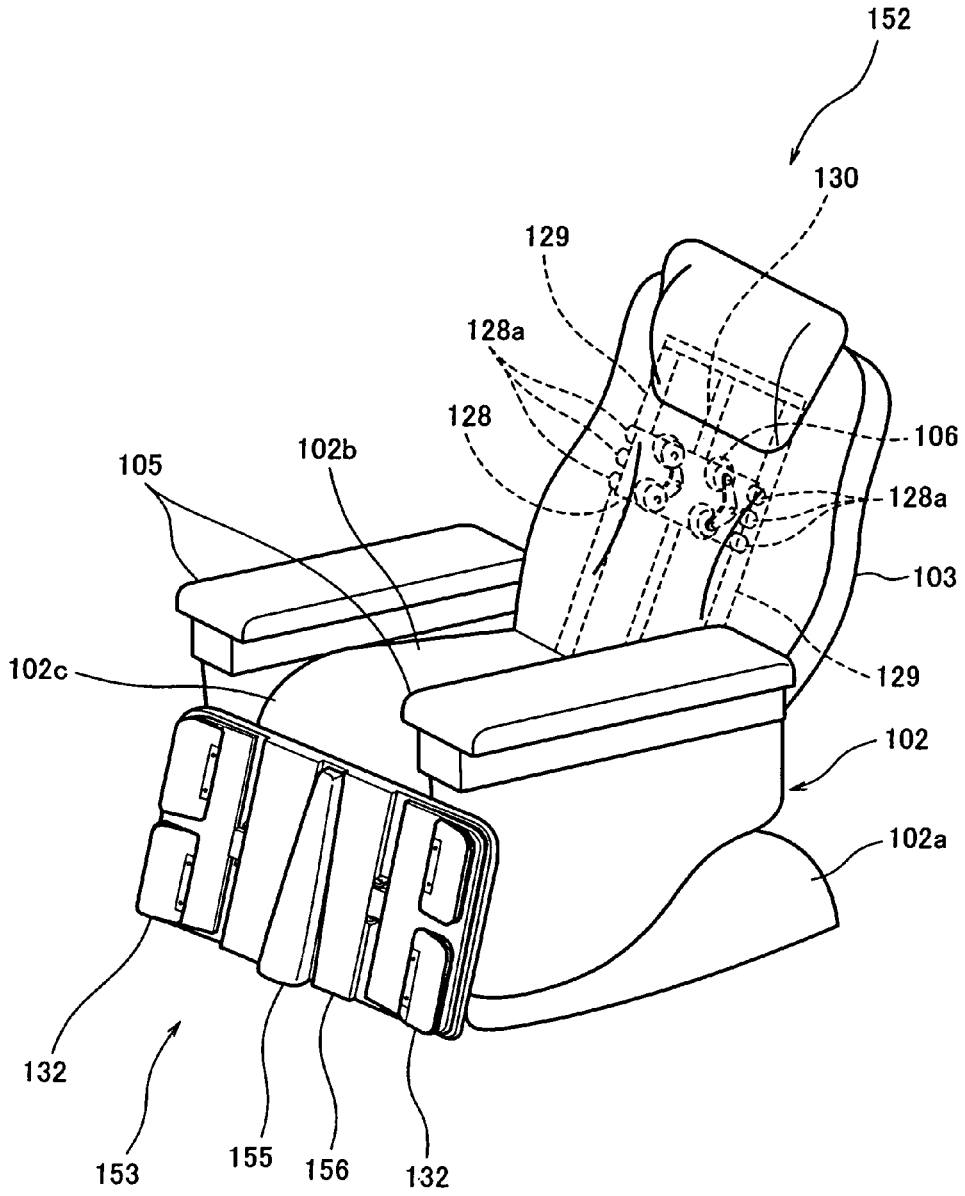
FIG. 23 is a perspective view showing a construction of an entire chair-type massaging apparatus according to a fifth embodiment of the present invention.

FIG. 23 is a perspective view showing a construction of an entire chair-type massaging apparatus 152 according to a fifth embodiment of the present invention. As shown in FIG. 23, the chair-type massaging apparatus 152 is constructed such that a leg rest 153 is pivotally mounted at an upper end thereof to an upper front side of the seat portion 102. An intermediate massaging portion 155 is mainly comprised of an intermediate air cell (intermediate air bag) 154 (see FIGS. 24 to 26) and is provided in substantially an intermediate region in a width direction of the leg rest 153.

Figure 24:
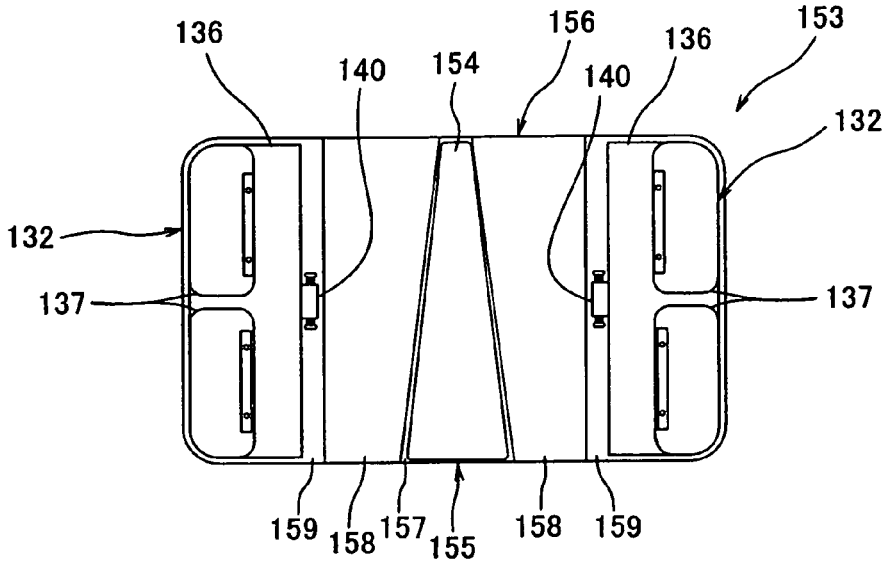
FIG. 24 is a front view showing a construction of a leg rest included in the chair-type massaging apparatus according to the fifth embodiment of the present invention.
Figure 25:
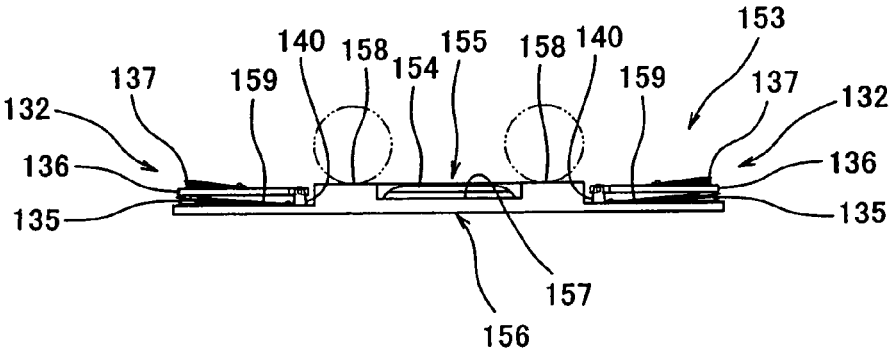
FIG. 25 is a plan view showing a construction of the leg rest included in the chair-type massaging apparatus according to the fifth embodiment of the present invention.
Figure 26:
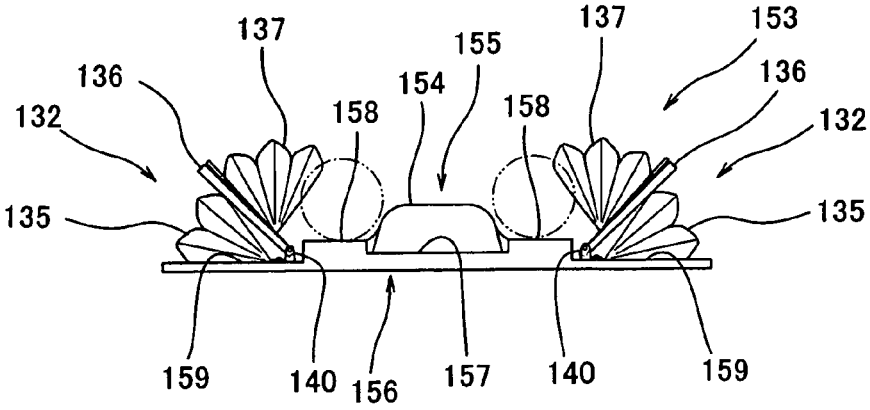
FIG. 26 is a plan view showing the construction of the leg rest included in the chair-type massaging apparatus according to the fifth embodiment of the present invention.

The construction of the leg rest 153 will be described in detail. As described below, for the simplicity of explanation, the leg rest 153 is illustrated as extended substantially downward from a front end of the seat surface 102*b*, except for a case specifically described. FIG. 24 is a front view showing the construction of the leg rest 153 included in the chair-type massaging apparatus 152 according to the fifth embodiment of the present invention. FIGS. 25 and 26 are plan views thereof. As shown in FIGS. 24 to 26, the leg rest 153 mainly includes a support portion 156, the intermediate massaging portion 155, and massaging portions 132. The support portion 156 forms a substantially flat plate shape, and is pivotally mounted at an upper end thereof to the upper front side of the seat portion 102 by a pivot extending horizontally (see FIG. 23).

As shown in FIGS. 24 to 26, an intermediate mounting surface 157 is formed in an intermediate region in the width direction of the support portion 156 and configured to allow the intermediate massaging portion 155 to be mounted thereon. Support surfaces 158 are formed on right and left sides outside the intermediate mounting surface 157 of the support portion 156 and are configured to allow the right and left calves of the user to be supported thereon. Further, mounting surfaces 159 are formed outside the support surfaces 158 and are configured to allow the massaging portions 132 to be mounted thereon. The intermediate mounting surface 157, the support surfaces 158 and the mounting surfaces 159 are parallel to each other. The intermediate mounting surface 157 is formed lower than the support surfaces 158, and the mounting surfaces 159 are formed lower than the intermediate mounting surface 157. Thus, there are step portions between the intermediate surface 157 and the support surfaces 158 and between the mounting surfaces 159 and the support surfaces 158. As shown in FIG. 24, the intermediate mounting surface 157 is formed to have a width that increases in a downward direction, and the step portions between the intermediate mounting surface 157 and the support surfaces 158 are tilted with respect to the longitudinal direction to have a spacing between them that increases in a downward direction.

Alternatively, the support surfaces 158 and the intermediate mounting surface 157 may form a flat surface, or otherwise the support surfaces 158 and the mounting surfaces 159 may form a flat surface.

An intermediate air cell 154 is mounted to the intermediate mounting surface 157. The intermediate air cell 154 has a dimension slightly smaller than that of the intermediate mounting surface 157 and has a width that increases in a downward direction, as in the intermediate mounting surface 157. The intermediate air cell 154 in a contracted state is substantially flat so as to form a flat surface along with the support surfaces 158. In this state, the intermediate air cell 154 expands to protrude forward further than the support surfaces 158 by inflowing the air.

Alternatively, the lower legs of the user need not be supported only by the support surfaces 158, but a part of the calves may be supported by the support surfaces 158 and the remaining part of them may be supported by the intermediate air cell 154.

Figure 27:
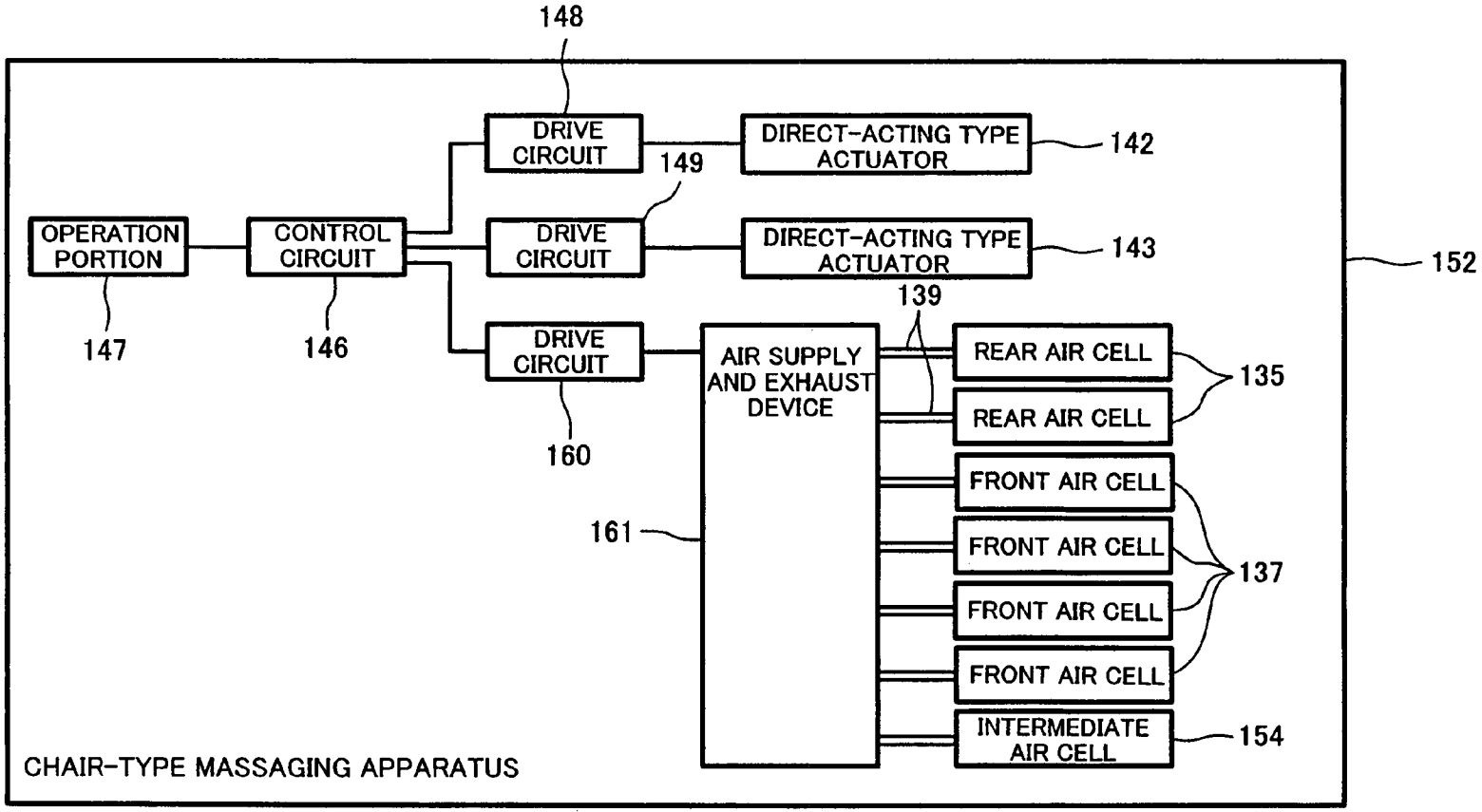
FIG. 27 is a block diagram showing a part of a configuration of the chair-type massaging apparatus according to the fifth embodiment of the present invention.

FIG. 27 is a block diagram showing a part of a configuration of the chair-type massaging apparatus 152 according to the fifth embodiment of the present invention. As shown in FIG. 27, the control circuit 146 is coupled to drive circuits 148, 149, and 160 and is configured to send a control signal to them. The drive circuit 160 is coupled to an air inflow and outflow device 161 and is configured to drive the air inflow and outflow device 161 in accordance with the control signal received from the control circuit 146. The control circuit 146 is capable of controlling an operation of the air inflow and outflow device 161. The air inflow and outflow device 161 includes a switching valve such as an electromagnetic valve, an air pump, and other components, and is coupled to the rear air cells 135, the front air cells 137, and the intermediate air cell 154 through the air hoses 139. The air inflow and outflow device 161 is configured to inflow and outflow air to and from each of the rear air cells 135, the front air cells 137, and the intermediate air cell 154 independently.

Figure 28:
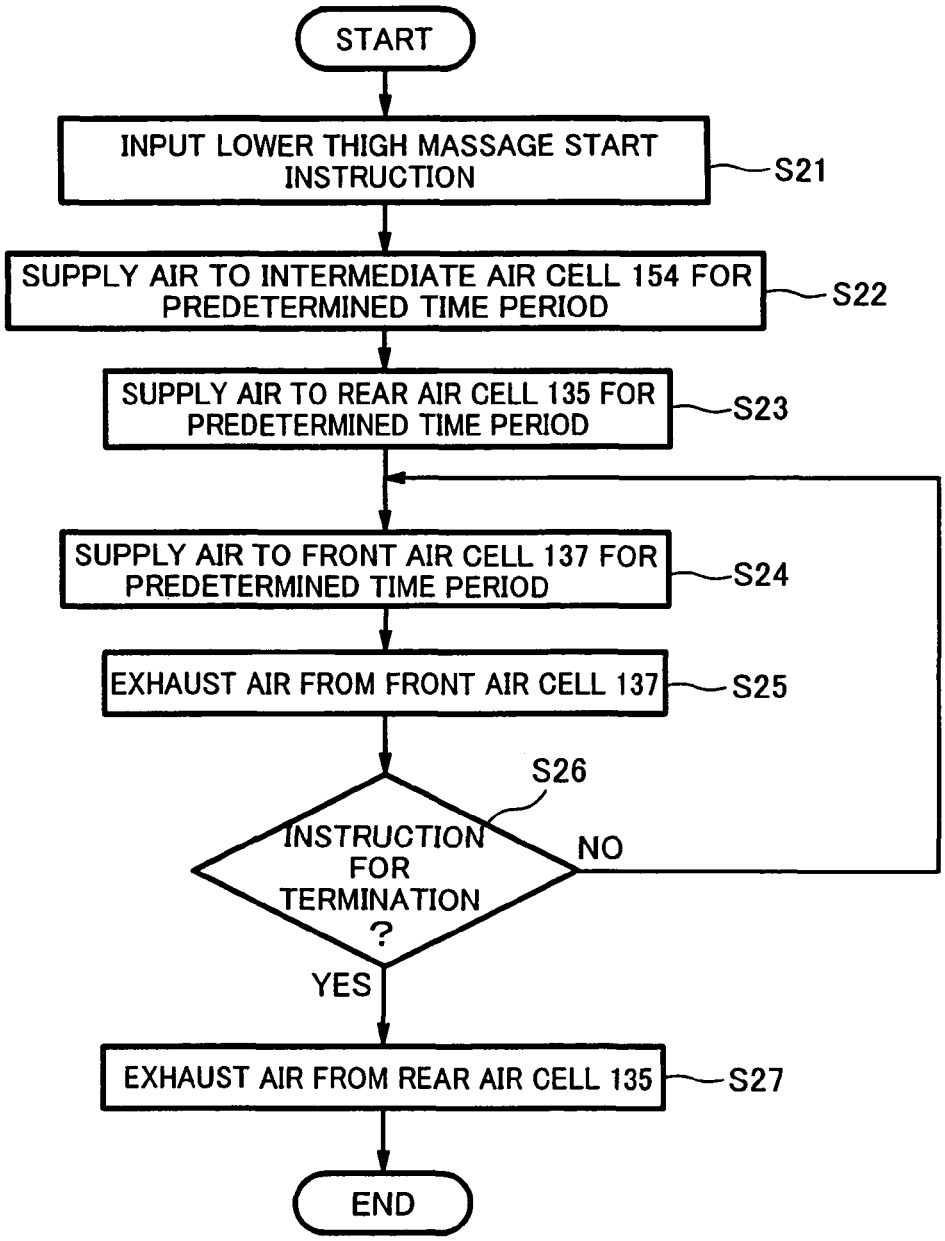
FIG. 28 is a flowchart showing an example of an operation control of the leg rest included in the chair-type massaging apparatus according to the fifth embodiment of the present invention.

An operation control of the leg rest 153 will be described. FIG. 28 is a flowchart showing an example of the operation control of the leg rest 153 in the chair-type massaging apparatus 152 according to the fifth embodiment of the present invention. When the user seated in the chair-type massaging apparatus 152 performs a predetermined input operation with an operation portion 147 to instruct the leg rest 153 to start massaging the lower legs (step S21), the control circuit 146 sends a predetermined control signal to the drive circuit 160 to control the operation of the air inflow and outflow device 161 so that the air is inflowed to the intermediate air cell 154 for a preset time period (step S22). This causes the intermediate air cell 154 to protrude forward further than the support surfaces 158. Thus, the user only has to move the lower legs so that inner regions of the calves are pressed against the intermediate air cell 154, in order to assume a proper posture to enable the lower legs to be massaged. Steps S23 to S27 following the step S22 are identical to the steps S2 to S6 described in the fourth embodiment, and will not be further described.

Since other configurations, functions, and effects of the chair-type massaging apparatus 152 of the fifth embodiment are identical to those of the chair-type massaging apparatus 101 of the fourth embodiment, the same components are identified by the same reference numerals and their configurations, functions and effects will not be further described.

In the chair-type massaging apparatus 152 of the fifth embodiment constructed as described above, while it is not used, the rear air cells 135, the front air cells 137, and the intermediate air cell 154 respectively contract to cause front regions of the massaging portions 132 and the intermediate massaging portion 155 to form a substantially flat surface as shown in FIG. 25, and thus the leg rest 153 forms a substantially flat plate shape. As a result, the chair-type massaging apparatus 152 entirely has a simple external appearance.

With the user seated in the chair-type massaging apparatus 152 in such a state, the user easily places the lower legs onto the leg rest 153 because the front surface of the leg rest 153 is a substantially flat surface. When the lower legs are not massaged, or the chair-type massaging apparatus 152 is otherwise used as an easy chair, the user can assume a desired posture freely without restriction of the lower legs because the front surface of the leg rest 153 is the substantially flat surface.

When the intermediate air cell 154 expands, the inner regions of the calves of the user contact the intermediate air cell 154. As shown in FIG. 26, when the rear air cells 135 and the front air cells 137 respectively expand in this state, the outer regions of the shins of the user are pressed inward and rearward by the pressing surfaces of the front air cells 137. As a result, each lower leg of the user is sandwiched between the front air cell 137 and the intermediate air cell 154 to be subjected to grab-massage.

As used herein, the term "grab-massage" refers to a massage operation in which a massager such as a massage person applies a finger pressure to massage the leg or the arm of the user in such a manner that the massager grabs the leg or the arm while applying strong and weak forces. The grab-massage is one of massage operations which may be comfortable to the user.

Since the intermediate air cell 154 is mounted to the support portion 156 to have a width that increases in the downward direction, it contacts large regions in the longitudinal direction of the legs. Thereby, it is possible to avoid the intermediate air cell 154 contacting only a longitudinal part of the calves of the user.

While in the fifth embodiment, the intermediate air cell 154 is configured to have the width that increases in a downward direction, it may alternatively have a rectangular shape.

Since the inner regions of the calves of the user contact the intermediate air cell 154, it is possible to inhibit the lower legs of the user from moving inward even when the outer regions of the shins of the user are pressed inward and rearward. As a result, the massaging effects are enhanced as compared to the case where only the massaging portions 132 massage the outer regions of the shins.

The operation control of the leg rest 153 is not limited to the above. For example, an operation cycle may be repeated in such a manner that only the rear air cells 135 may contract and thereafter the front air cells 137 and the intermediate air cell 154 may respectively contract in the state in which the rear air cells 135, the front air cells 137, and the intermediate air cell 154 respectively expand. In this case, with the rear air cells 135, the front air cells 137 and the intermediate air cell 154 respectively expanded, the lower leg of the user is sandwiched between the massaging portion 132 and the intermediate massaging portion 155. In this state, by contracting only the rear air cells 135, the front air cells 137 are caused to retract by an elastic force exerted by the coil spring 140*d*. Therefore, the lower leg of the user is pulled rearward with the lower leg sandwiched between the massaging portion 132 and the intermediate massaging portion 155. Thus, the lower leg of the user is subjected to pull massage.

As used herein, the term "pull-massage" refers to a massage operation in which the massager grabs a region of the user, for example, the lower leg, to be massaged, and shifts a massage position (position at which finger or the like is in contact with a body of the user) outward relative to the massage position while grabbing the region to be massaged. The pull-massage is one massage operation that may be comfortable to the user.

Alternatively, the operation of the leg rest 153 may be controlled so that the front air cells 137 and the intermediate air cell 154 expand and contract repeatedly in synchronization with each other with the rear air cells 135 expanded. In this case, the grab-massage of the lower legs of the user is repeatedly performed.

As in the fourth embodiment, the number and size of the rear air cells 135, the receiver plates 136, and the front air cells 137 are not intended to be limited to those illustrated in the fifth embodiment. Also, the rear air cell 135 and the front air cell 137 need not be superimposed with the receiver plate 136 interposed between them. For example, each of the rear air cell 135 and the front air cell 137 may include only one air bag or otherwise may be superimposed without the receiver plate 136. Furthermore, they may include three or more air bags superimposed.

Furthermore, the number and size of the intermediate air cell 154 are not intended to be limited to those of the fifth embodiment, but a plurality of intermediate air cells 154 may be arranged in the vertical direction, or otherwise the intermediate air cell 154 may include a plurality of air bags.

Embodiment 6

Figure 29:
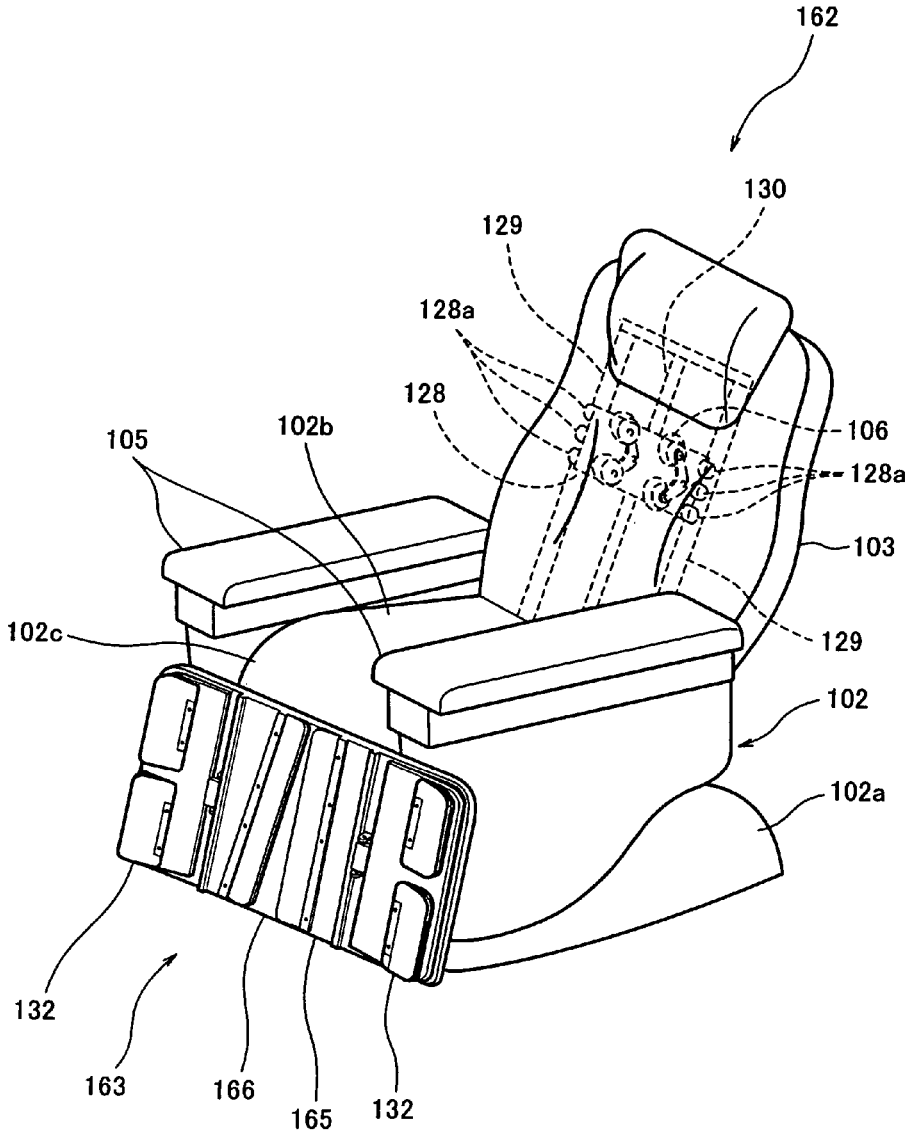
FIG. 29 is a perspective view showing a construction of an entire chair-type massaging apparatus according to a sixth embodiment of the present invention.

FIG. 29 is a perspective view showing a construction of an entire chair-type massaging apparatus according to a sixth embodiment of the present invention. As shown in FIG. 29, a chair-type massaging apparatus 162 of this embodiment is constructed such that a leg rest 163 is pivotally attached at an upper end portion thereof to an upper front side of the seat portion 102, and an intermediate massaging portion 166 mainly includes a pair of intermediate air cells 164 (see FIGS. 30 to 32) mounted at an intermediate region in the width direction of the leg rest 163.

Figure 30:
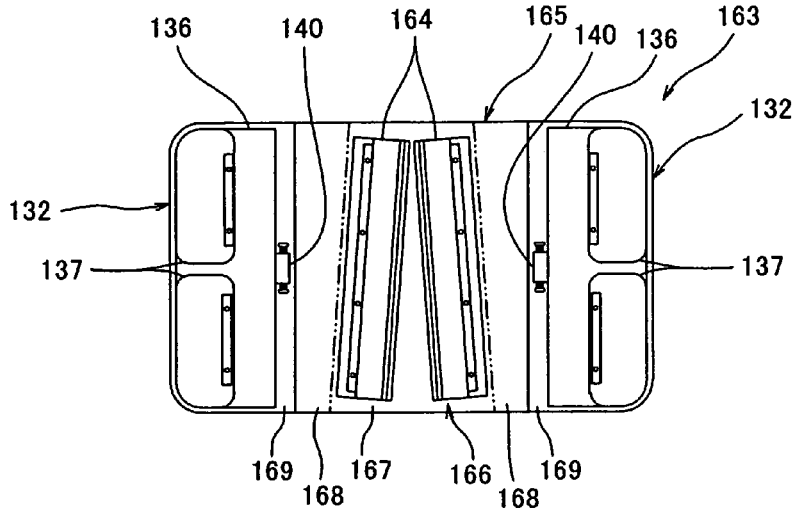
FIG. 30 is a front view showing a construction of a leg rest included in the chair-type massaging apparatus according to the sixth embodiment of the present invention.
Figure 31:
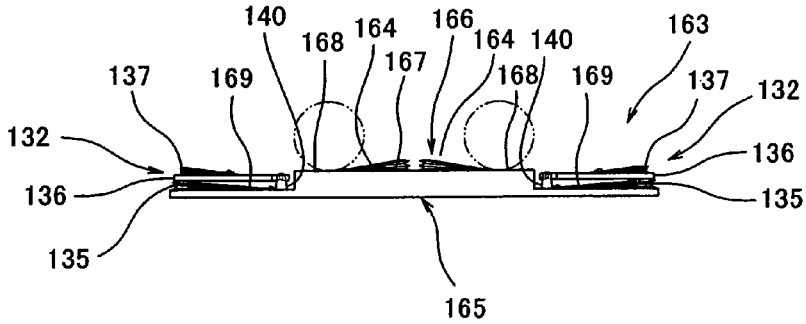
FIG. 31 is a plan view showing the construction of the leg rest included in the chair-type massaging apparatus according to the sixth embodiment of the present invention.
Figure 32:
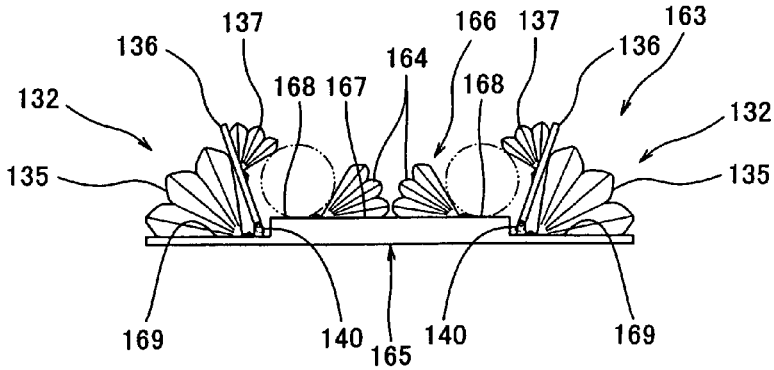
FIG. 32 is a plan view showing the construction of the leg rest included in the chair-type massaging apparatus according to the sixth embodiment of the present invention.

Subsequently, a construction of the leg rest 163 will be described in more detail. As described below, for the sake of simple explanation below, the leg rest 163 is illustrated as extended substantially downward from a front end of the seat surface 102*b*, except for the condition specifically described. FIG. 30 is a front view showing the construction of the leg rest 163 provided in the chair-type massaging apparatus 162 according to the sixth embodiment of the present invention. FIGS. 31 and 32 are plan views thereof. As shown in FIGS. 30 to 32, the leg rest 163 of this embodiment includes a support portion 165 and the massaging portions 132. The support portion 165 includes an intermediate mounting surface 167 (trapezoid region defined by two-dotted line in FIG. 30) at a substantially intermediate region in the width direction thereof. Support surfaces 168 are formed on right and left sides outside the intermediate mounting surface 167 of the support portion 165 and are configured to allow the right and left calves of the user to be supported thereon. Mounting surfaces 169 are provided outside the support surfaces 168 and are configured to allow the massaging portions 132 to be mounted thereon. The intermediate mounting surface 167, the support surfaces 168 and the mounting surfaces 169 are parallel to each other. The intermediate mounting surface 167 is as high as the support surfaces 168 to form a flat surface, and the mounting surfaces 169 are lower than the intermediate mounting surface 167 and the support surfaces 168. Thus, there are step portions between the mounting surfaces 169 and the support surfaces 168. Alternatively, the mounting surfaces 169 and the support surfaces 168 may form a flat surface, or otherwise there may be step portions between the intermediate mounting surface 167 and the support surfaces 168 so that the intermediate mounting surface 167 is lower than the support surfaces 168.

A pair of right and left intermediate air cells 164 are mounted to the intermediate mounting surface 167. Each intermediate air cell 164 is shaped to have a reduced width of the rear air cell 135. As in the rear air cell 135 and the front air cell 137, each intermediate air cell 164 is configured to expand in fan-shaped form from a substantially flat state by air inflow. The respective intermediate air cells 164 are mounted to the intermediate mounting surface 167 in such a manner that their expandable ends are closer to each other and their unexpandable ends are distant from each other, and a distance between them increases in a downward direction. As in the mounting structure of the rear air cell 135 to the support surface 133 described in the fourth embodiment, each intermediate air cell 164 is mounted to the intermediate mounting surface 167 such that an expansion restricting portion 164*d* is fastened to the intermediate mounting surface 167.

While the intermediate air cells 164 are mounted to the intermediate mounting surface 167 to be tilted, they may alternatively be mounted to the intermediate mounting surface 167 to be arranged in parallel with each other.

The lower legs of the user are not necessarily supported only by the support surfaces 168. Alternatively, a part of the calves may be supported by the support surfaces 168 and a remaining part may be supported by the intermediate air cells 164 in a contracted state. In this case, the intermediate air cells 164 are always in contact with the lower legs of the user. Thus, the pressing force of the intermediate air cells 164 may be applied to the lower legs of the user more efficiently.

Figure 33:
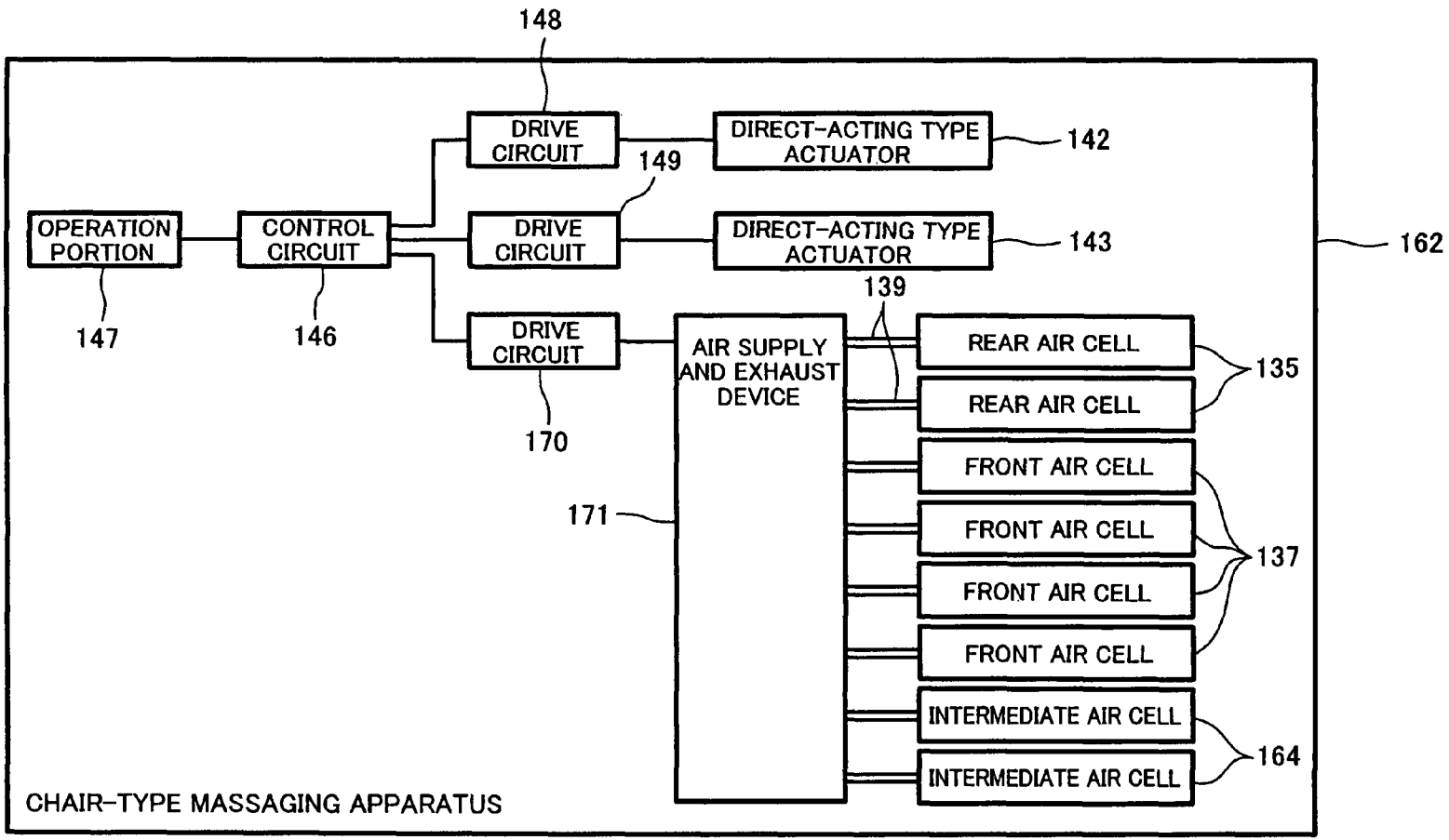
FIG. 33 is a block diagram showing a part of a configuration of the chair-type massaging apparatus according to the sixth embodiment of the present invention.

FIG. 33 is a block diagram showing a part of a configuration of the chair-type massaging apparatus 162 according to the sixth embodiment of the present invention. As shown in FIG. 33, the control circuit 146 is coupled to the drive circuits 148, 149, and 170 and is configured to send a control signal to them. The drive circuit 170 is coupled to an air inflow and outflow device 171 and is configured to drive the air inflow and outflow device 171 in accordance with the control signal received from the control circuit 146. The control circuit 146 is capable of controlling an operation of the air inflow and outflow device 171. The air inflow and outflow device 171 includes a switching valve such as an electromagnetic valve, an air pump, and other components, and is coupled to the rear air cells 135, the front air cells 137, and the intermediate air cells 154 through air hoses 139. The air inflow and outflow device 171 is configured to inflow and outflow air to and from each of the rear air cells 135, the front air cells 137, and the intermediate air cells 154 independently.

Figure 34:
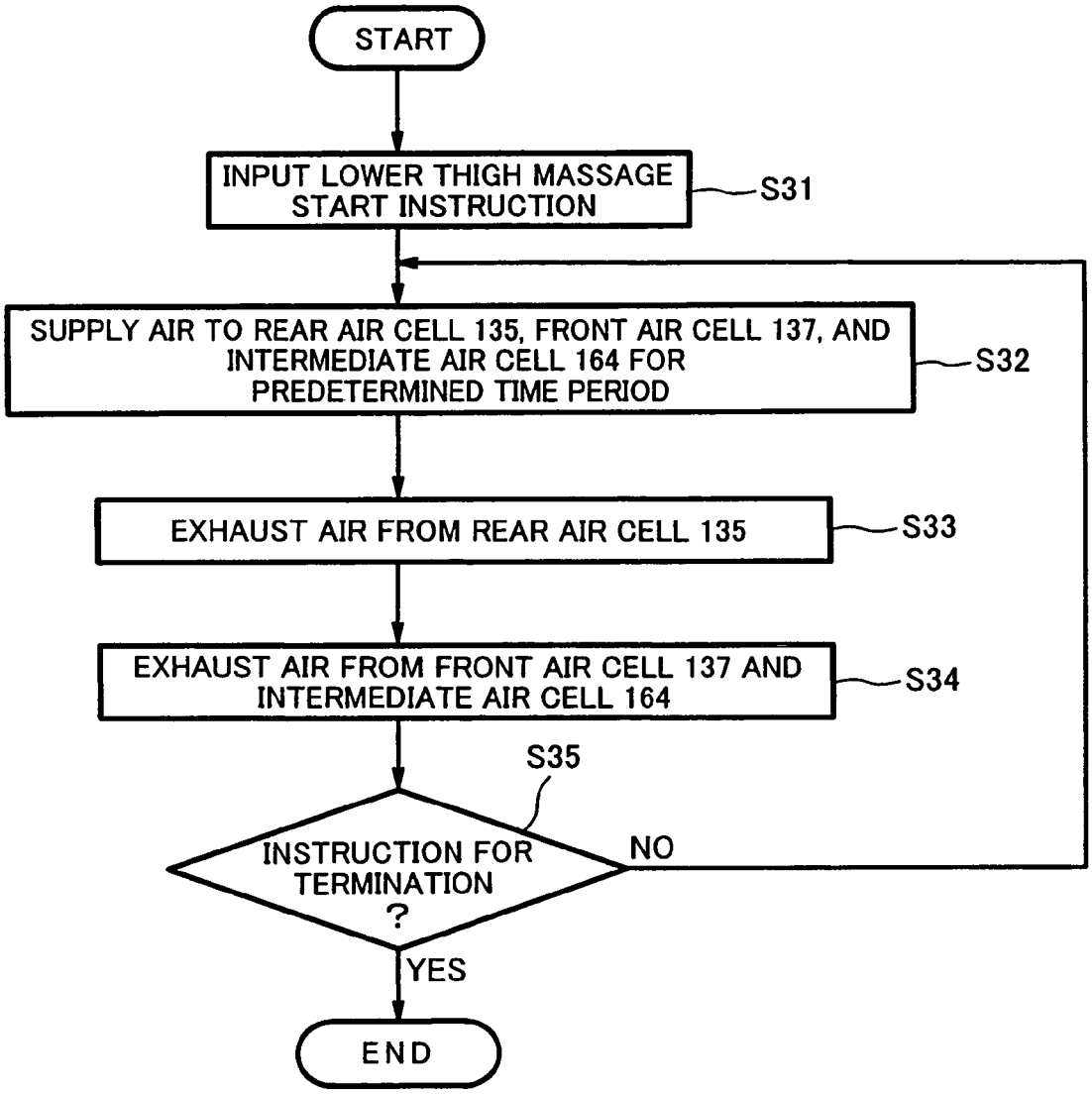
FIG. 34 is a flowchart showing an example of an operation control of the leg rest included in the chair-type massaging apparatus according to the sixth embodiment of the present invention.

Subsequently, an operation control of the leg rest 163 will be described. FIG. 34 is a flowchart showing an example of the operation control of the leg rest 163 in the chair-type massaging apparatus 162 according to the sixth embodiment of the present invention. When the user seated in the chair-type massaging apparatus 162 performs a predetermined input operation with the operation portion 147 to instruct the leg rest 163 to start massaging the lower legs (step S31), the control circuit 146 sends a predetermined control signal to the drive circuit 170 to control the operation of the air inflow and outflow device 171 so that the air is inflowed to the rear air cells 135, the front air cells 137 and the intermediate air cells 164 for a preset time period (step S32). This causes the rear air cells 135, the front air cells 137, and the intermediate air cells 164 to respectively expand to an extent to which the front air cells 137 contact the outer regions of the shins of the user and the intermediate air cells 164 contact the inner regions of the calves. In this state, each lower leg is sandwiched between and pressed by the front air cells 137 and the intermediate air cell 164.

Since the intermediate air cells 164 are mounted to the support portion 165 with a distance between them that increases in a downward direction, they contact large regions in the longitudinal direction of the lower legs. Thereby, it is possible to avoid the intermediate air cells 164 contacting only a longitudinal part of the calves of the user.

After an elapse of the set time period from when the air inflow to the rear air cells 135, the front air cells 137, and the intermediate air cells 164 starts, the control circuit 146 sends a predetermined control signal to the drive circuit 170 to control the operation of the air inflow and outflow device 171 so that the air is outflowed from the rear air cells 135 (step 533). This causes the rear air cells 135 to contract. The receiver plates 136 rotate rearward by the force exerted by the coil springs 140*d*, and the front air cells 137 retract. Thus, the pull massage is performed on the lower leg of the user in such a manner that the lower leg of the user is pulled rearward with the lower leg sandwiched between the front air cell 137 and the intermediate air cell 164.

After an elapse of a predetermined time period from when the air outflow from the rear air cells 135 starts, the control circuit 146 sends a predetermined control signal to the drive circuit 170 to control the operation of the air inflow and outflow device 171 so that the air is outflowed from the front air cells 137 and the intermediate air cells 164 (step 534). Thereby, the pressing force applied to the lower legs of the user is released.

The control circuit 146 determines whether or not there is an instruction from the user for terminating massaging of the lower legs (step S35), and if it is determined that there is no instruction, the control circuit 146 returns the process to step S32. On the other hand, if it is determined that there is an instruction in step S35, the control circuit 146 terminates the process.

The leg rest 163 repeats pull-massage of the lower legs unless there is an instruction from the user for terminating massaging of the lower legs. The massage strength of the lower legs is adjustable by the user's predetermined input operation with the operation portion 147 in such a manner that in order to increase the massage strength, the time period during which the air is inflowed to the rear air cells 135, the front air cells 137 and the intermediate air cells 164 is set longer, while in order to decrease the massage strength, the time period during which the air is inflowed to them is set shorter.

Since other configurations, functions, and effects of the chair-type massaging apparatus 162 of the sixth embodiment are identical to those of the chair-type massaging apparatus 101 of the fourth embodiment, the same components are identified by the same reference numerals and their configurations, functions, and effects will not be further described.

As in the fourth embodiment, the number and size of the rear air cells 135, the receiver plates 136 and the front air cells 137 are not intended to be limited to those illustrated in the sixth embodiment. Also, the rear air cell 135 and the front air cell 137 need not be superimposed with the receiver plate 136 interposed between them. For example, each of the rear air cell 135 and the front air cell 137 may include only one air bag or otherwise may be superimposed without the receiver plate 136. Furthermore, they may include three or more air bags superimposed.

The number and size of the intermediate air cells 164 are not intended to be limited to those of the sixth embodiment. The intermediate air cells 164 may be configured in such a manner that a plurality of intermediate air cells 164 may be arranged in two lines in the vertical direction, or otherwise may be comprised of a plurality of air bags.

Embodiment 7

Figure 35:
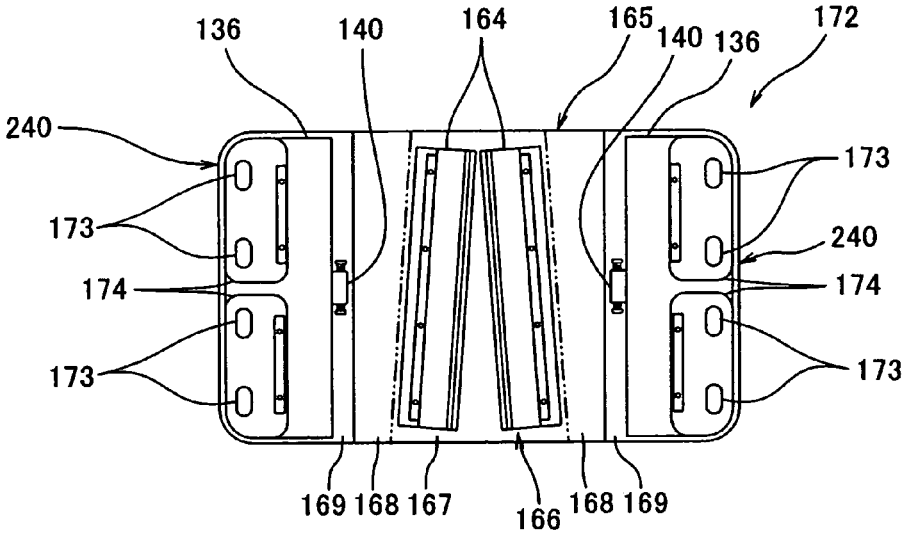
FIG. 35 is a front view showing a construction of a leg rest included in the chair-type massaging apparatus according to a seventh embodiment of the present invention.
Figure 36:
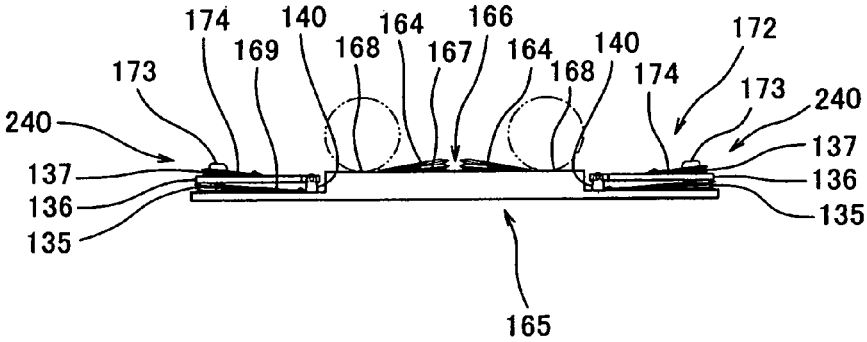
FIG. 36 is a plan view showing a construction of the leg rest included in the chair-type massaging apparatus according to the seventh embodiment of the present invention.
Figure 37:
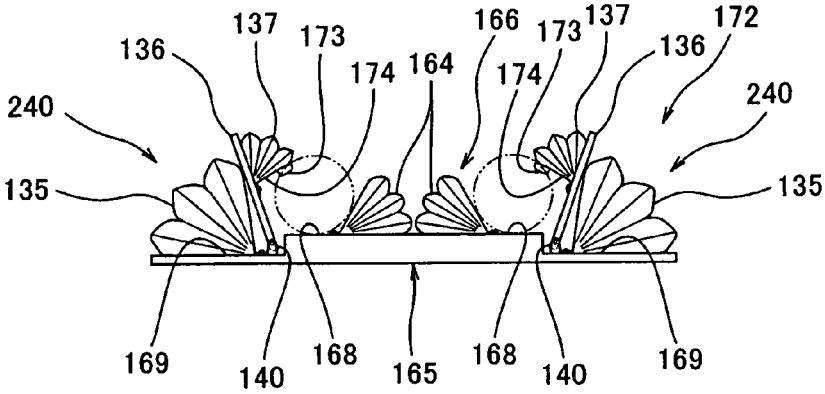
FIG. 37 is a plan view showing a construction of the leg rest included in the chair-type massaging apparatus according to the seventh embodiment of the present invention.
Figure 38:
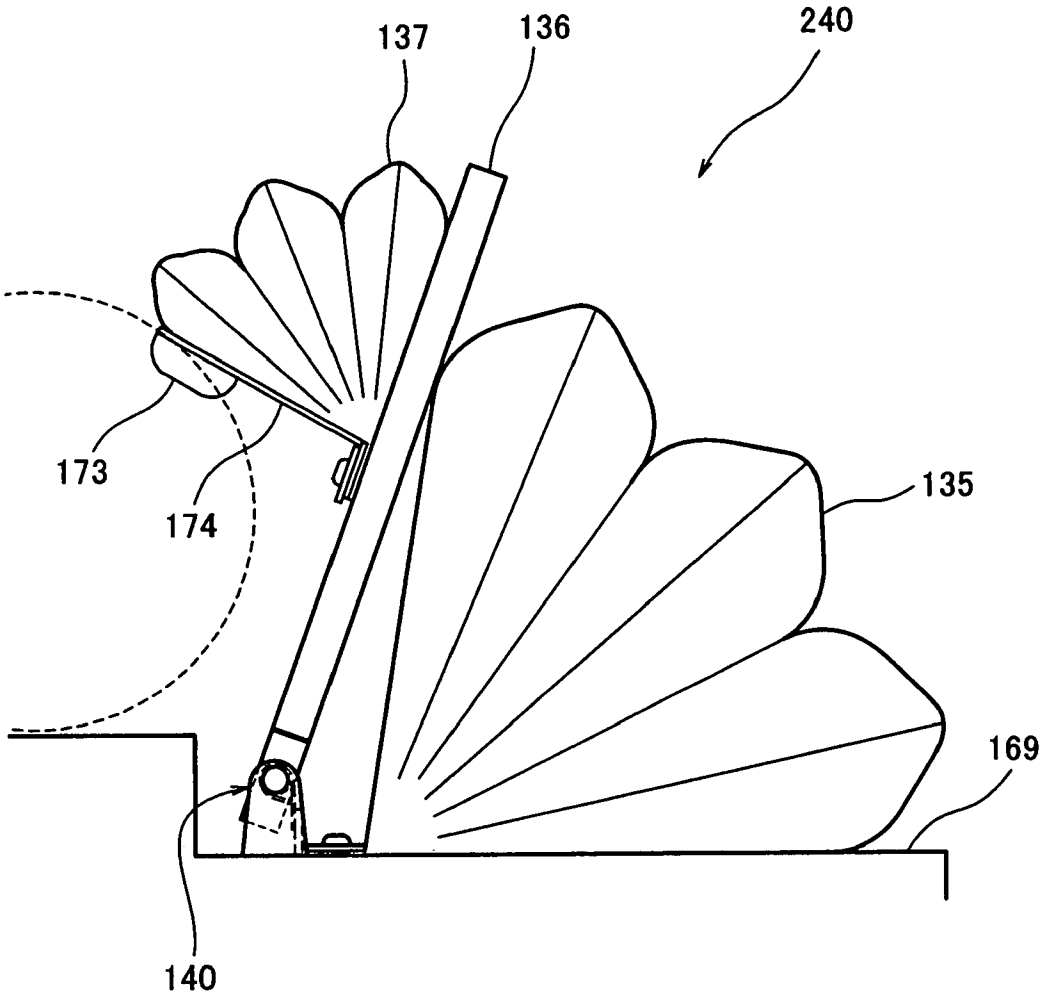
FIG. 38 is a partially enlarged plan view of the leg rest of FIG. 37.

FIG. 35 is a front view showing a construction of a leg rest 172 of a chair-type massaging apparatus according to a seventh embodiment of the present invention. FIGS. 36 and 37 are plan views thereof. FIG. 38 is a partially enlarged plan view of the leg rest 172 of FIG. 37. As shown in FIGS. 35 to 37, each massaging portion 240 of the leg rest 172 of the seventh embodiment is constructed such that two pressing heads (massaging elements) 173 are arranged in the longitudinal direction on a front side of each front air cell 137. In greater detail, as shown in FIG. 38, a pressing plate 174 having a main surface of a substantially the same shape as that of a front surface of each front air cell 137 is mounted to the front surface of the front air cell 137, and the two pressing heads 173 are arranged in the vertical direction on the front surface of the pressing plate 174. When the rear air cells 135 and the front air cells 137 expand, the pressing heads 173 press the outer regions of the shins of the user to apply stimulation to the user as if the massager were pressing the outer regions of the shins.

The pressing heads 173 may be made of materials that are not specifically limited, for example, metal or synthetic resin, but preferably elastomer having an elasticity, various types of urethane foams, other foams, etc. This makes it possible to inhibit too strong stimulation from being applied to the user. The shape of the pressing heads 173 is not specifically limited, but may be round, for example, hemispherical.

Since other configurations, functions, and effects of the chair-type massaging apparatus of the seventh embodiment are identical to those of the chair-type massaging apparatus 162 of the sixth embodiment, the same components are identified by the same reference numerals and their configurations, functions, and effects will not be further described.

As in the fourth embodiment, the number and size of the rear air cells 135, the receiver plates 136 and the front air cells 137 are not intended to be limited to those illustrated in the seventh embodiment. Also, the rear air cell 135 and the front air cell 137 need not be superimposed with the receiver plate 136 interposed between them. For example, each of the rear air cell 135 and the front air cell 137 may include only one air bag or may be superimposed without the receiver plate 136. Furthermore, they may include three or more air bags superimposed.

As in the sixth embodiment, the number and size of the intermediate air cells 164 are not intended to be limited to those of the seventh embodiment. The intermediate air cells 164 may be configured in such a manner that a plurality of intermediate air cells 164 may be arranged in two lines in the vertical direction, or otherwise may be comprised of a plurality of air bags.

Embodiment 8

Figure 39:
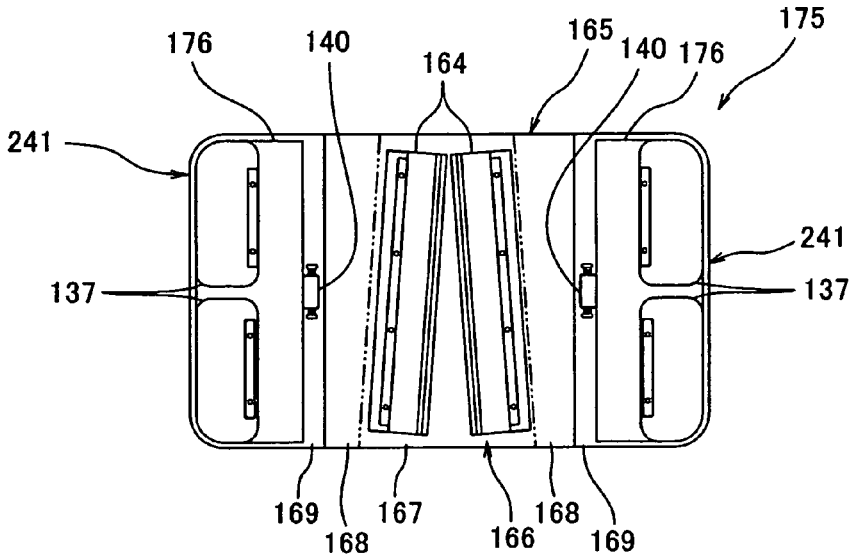
FIG. 39 is a front view showing a construction of an example of the leg rest included in a chair-type massaging apparatus according to an eighth embodiment of the present invention.
Figure 40:
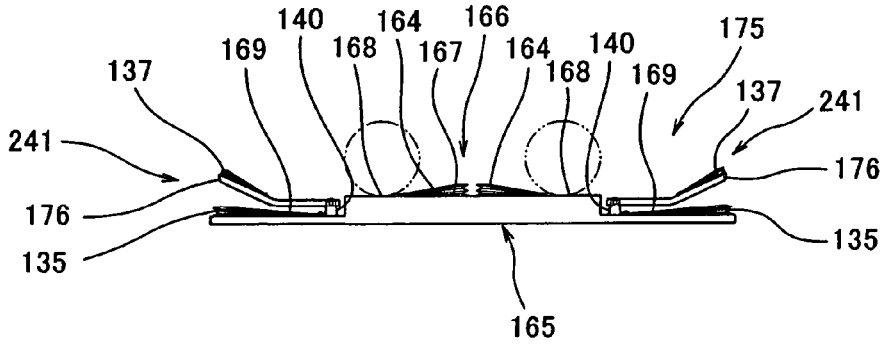
FIG. 40 is a plan view showing the construction of the example of the leg rest included in the chair-type massaging apparatus according to the eighth embodiment of the present invention.
Figure 41:
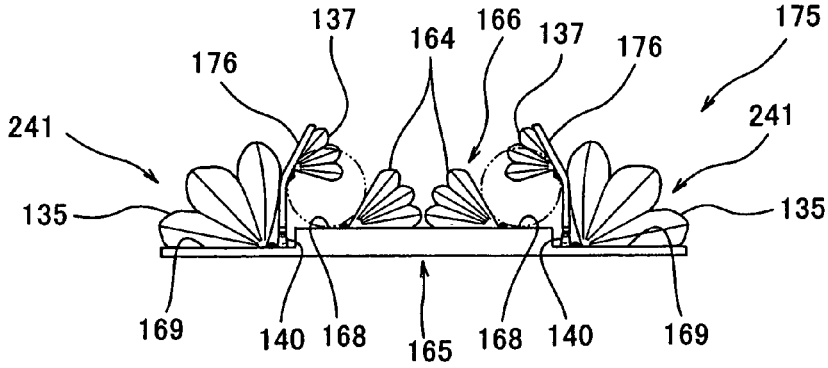
FIG. 41 is a plan view showing the construction of the example of the leg rest included in the chair-type massaging apparatus according to the eighth embodiment of the present invention.

FIG. 39 is a front view showing a construction of a leg rest of a chair-type massaging apparatus according to an eighth embodiment of the present invention. FIGS. 40 and 41 are plan views thereof. As shown in FIGS. 39 to 41, each receiver plate 176 included in a massaging portion 241 of a leg rest 175 is configured such that its outer end portion in the width direction is bent forward a predetermined angle. The front air cells 137 are mounted to the receiver plate 176 at a position which is outward relative to the bent position. As shown in FIG. 41, each rear air cell 135 is expandable to an extent to which a base end portion of the receiver plate 176 becomes perpendicular to the support surface 168. When the rear air cell 135 expands, the outer end portion of the receiver plate 176 covers the support surface 168 from the front. The receiver plate 176 may be made of materials having hardness sufficient to maintain the bent state, and is preferably made of materials having relatively high hardness, for example, metal or plastic having plasticity at temperatures near a room temperature.

In contrast to the configuration in which the receiver plate is flat, the front air cell 137 is moved closer to the lower leg of the user when the rear air cell 135 expands. Therefore, by expanding the front air cell 137, a front region of the lower leg including the outer region of the shin of the user is pressed substantially backward, and thus stronger stimulation is applied to the outer region of the shin. Furthermore, if the front air cell 137 is made smaller, sufficient massage strength can be ensured.

Instead of a receiver plate 176 that is bent forward at one point, the receiver plate 176 may alternatively be entirely curved forward in a circular arc shape.

Since other configurations, functions, and effects of the chair-type massaging apparatus of the eighth embodiment are identical to those of the chair-type massaging apparatus 162 of the sixth embodiment, the same components are identified by the same reference numerals and their configurations, functions, and effects will not be further described.

As in the fourth embodiment, the number and size of the rear air cells 135, the receiver plates 136 and the front air cells 137 are not intended to be limited to those illustrated in the eighth embodiment. Furthermore, two or more air bags may be superimposed on the front surface of the receiver plate 176, or otherwise may be superimposed behind the receiver plate 176.

As in the sixth embodiment, the number and size of the intermediate air cells 164 are not intended to be limited to those of the eighth embodiment. The intermediate air cells 164 may be configured in such a manner that a plurality of intermediate air cells 164 may be arranged in two lines in the vertical direction, or otherwise may be comprised of a plurality of superimposed air bags.

Figure 42:
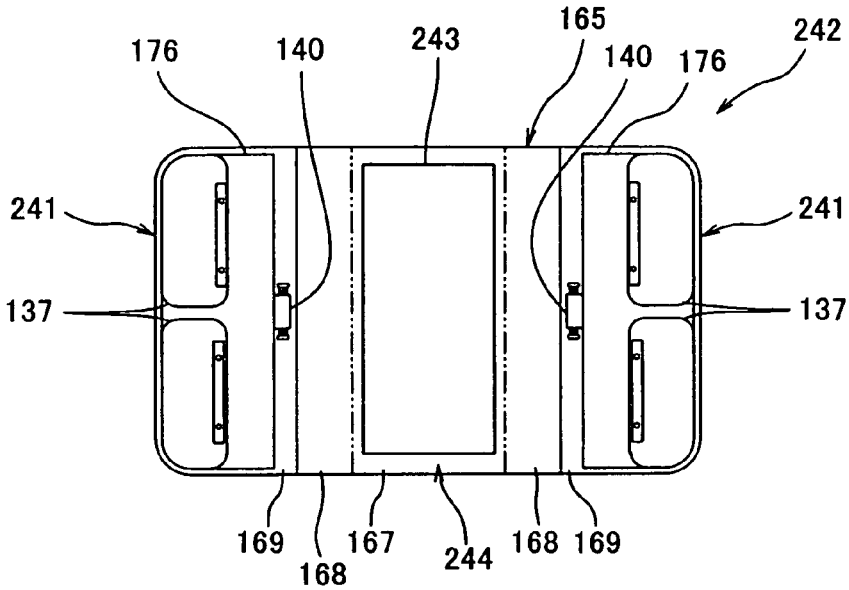
FIG. 42 is a front view showing the construction of another example of the leg rest included in the chair-type massaging apparatus according to the eighth embodiment of the present invention.
Figure 43:
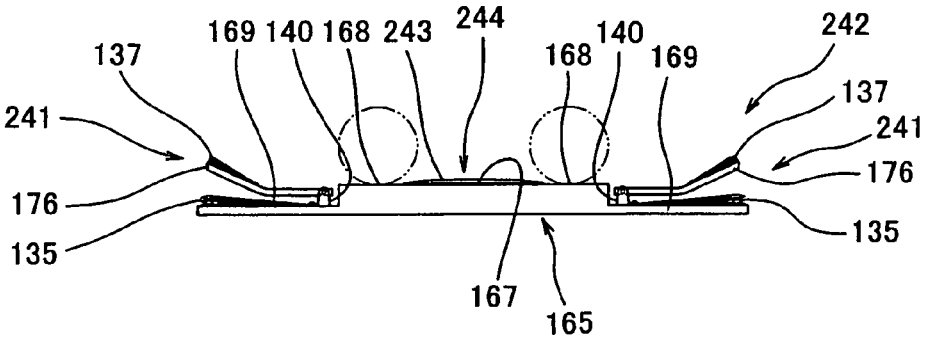
FIG. 43 is a plan view showing the construction of another example of the leg rest included in the chair-type massaging apparatus according to the eighth embodiment of the present invention.
Figure 44:
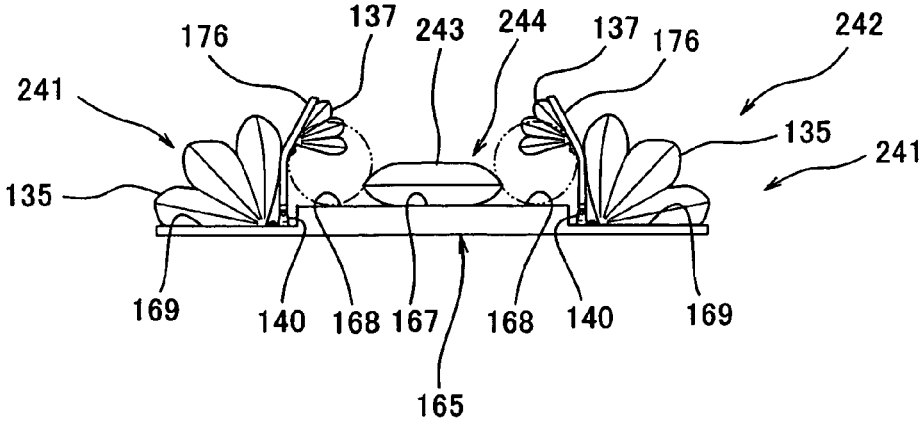
FIG. 44 is a plan view showing the construction of another example of the leg rest included in the chair-type massaging apparatus according to the eighth embodiment of the present invention.

FIG. 42 is a front view showing another construction of the leg rest of the chair-type massaging apparatus according to the eighth embodiment of the present invention. FIGS. 43 and 44 are plan views thereof. As shown in FIGS. 42 to 44, a leg rest 242 is constructed in such a manner that an intermediate mounting surface 167 of the support portion 165 is rectangular (region defined by two-dotted line in FIG. 42) and an intermediate massaging portion 244 including a rectangular flat intermediate air cell 243 is mounted to intermediate mounting surface 167 instead of the intermediate massaging portion 166 including a pair of intermediate air cells 164. The intermediate air cell 243 is flat in a contracted state, and hence the front surface of the support portion 165 is substantially flat. When the intermediate air cell 243 expands, it protrudes forward from the support surface 168 so as to contact and press the inner region of the calf of the user. When the user places the lower leg on the support portion 165 such that the inner region of the calf contacts the intermediate air cell 243, the calf of the user is guided to a massage position on the support surface 168.

The shape of the intermediate air cell 243 is not intended to be limited to a rectangle shape, but may be a trapezoid shape with a width increasing in a downward direction.

The number, size, and configuration of the intermediate air cell(s) 243 are not intended to be limited to the above. The intermediate air cell(s) 243 may be configured in such a manner that a plurality of intermediate air cells 243 may be arranged in two lines in the vertical direction, or otherwise may be comprised of a plurality of superimposed air bags.

Embodiment 9

Figure 46:
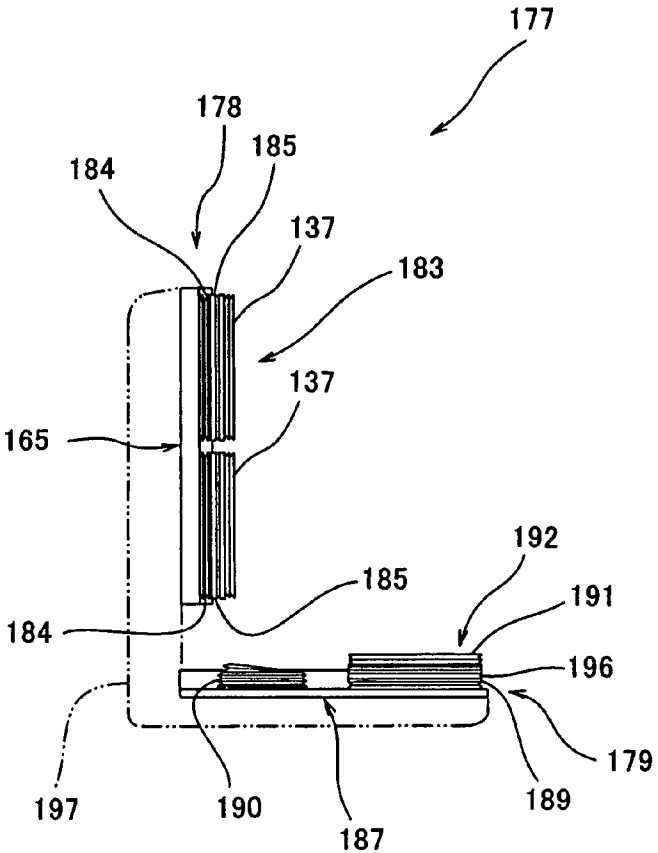
FIG. 46 is a side view showing the construction of the leg rest included in a chair-type massaging apparatus according to the ninth embodiment of the present invention.
Figure 45:
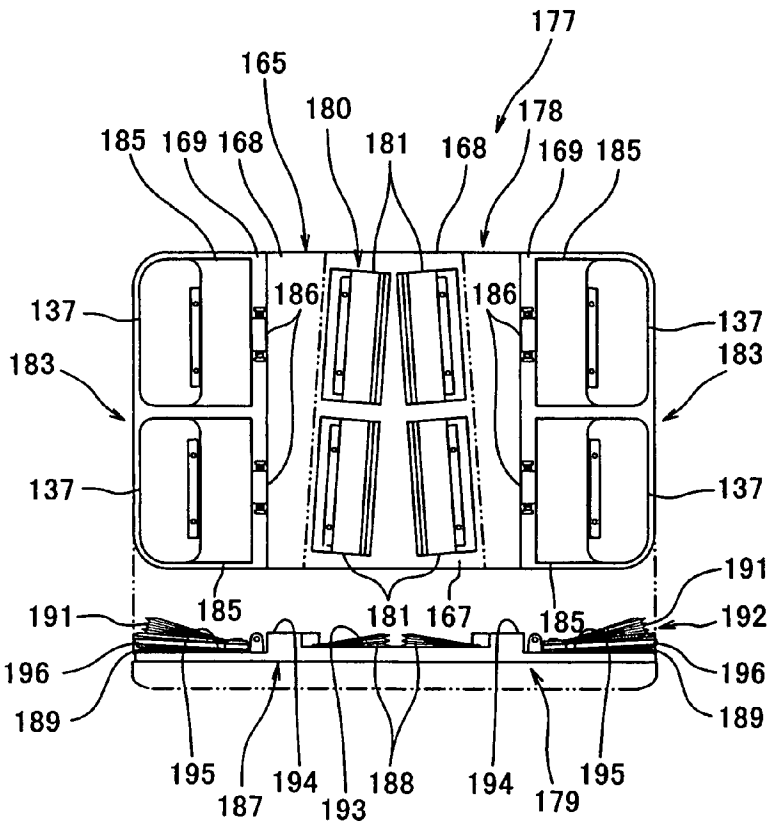
FIG. 45 is a front view showing a construction of a leg rest included in a chair-type massaging apparatus according to a ninth embodiment of the present invention.

FIG. 45 is a front view showing a construction of a leg rest 177 of a chair-type massaging apparatus according to a ninth embodiment of the present invention. FIG. 46 is a side view thereof. As shown in FIGS. 45 and 46, the leg rest 177 of the ninth embodiment includes a lower leg massaging unit 178 configured to massage the lower leg of the user, i.e., a region from the knee to the ankle, and a foot massaging unit 179 configured to massage a foot of the user, i.e., a region from the ankle to tip portion. The lower leg massaging unit 178 is identical in construction to the leg rest 163 described in the seventh embodiment except that the intermediate massaging portion 180 includes two pairs of intermediate air cells 181, and each of right and left massaging portions 183 includes rear air cells 184 and receiver plates 185 which are formed by dividing the rear air cell 135 and the receiver plate 136 in two in the vertical direction and by arranging them in the vertical direction. In greater detail, the intermediate massaging portion 180 is constructed such that a pair of intermediate air cells 181 are arranged on right and left sides of an upper half region of the intermediate mounting surface 167 and another pair of intermediate air cells 181 are arranged on right and left sides on a lower half region of the intermediate mounting surface 167. Each pair of intermediate air cells 181 are arranged to be tilted with respect to the longitudinal direction such that a distance between them increases in a downward direction. Also, the two intermediate air cells 181 arranged in the longitudinal direction, i.e., two intermediate air cells 181 arranged on the right side or on the left side are arranged in a straight line shape. Thereby, the intermediate air cells 181 contact a large region of the lower legs in the longitudinal direction while the lower legs of the user are massaged. Therefore, the intermediate air cells 181 contacting only a longitudinal part of the calves of the user is avoided.

Subsequently, a construction of the massaging portion 183 will be described in detail. The two rear air cells 184 are vertically arranged on each mounting surface 169. As in the rear air cells 135 and the front air cells 137 described in the fourth embodiment, each rear air cell 184 is configured to expand in fan-shaped form from a substantially flat state by inflowing the air thereto. Each rear air cell 184 has a main surface portion which is slightly smaller than an upper half region (or lower half region) of the mounting surface 169, and is placed on the mounting surface 169 as in the rear air cell 135 in such a manner that its unexpandable end is oriented inward, i.e., toward the support surface 168, and its expandable end is oriented outward.

The receiver plate 185 is placed in front of each rear air cell 184 thus configured. Each receiver plate 185 is constructed of a substantially rectangular plate having an area slightly larger than that of the main surface portion of the rear air cell 184, and is placed in front of the rear air cell 184 so as to cover the entire rear air cell 184. Each receiver plate 185 is mounted to the mounting surface 169 by a hinge 186 as in the receiver plate 136 of the fourth embodiment, which will not be described in detail. One front air cell 137 is mounted in an outer half region of the front surface of the receiver plate 185 as in the fourth embodiment. As in the receiver plate 136 of the fourth embodiment, the receiver plate 185 may be constructed of a relatively hard material such as metal, or otherwise a relatively flexible material such as synthetic resin.

In the manner described above, the massaging portion 183 is constructed of the rear air cells 184, the receiver plates 185, and the front air cells 137.

Each foot massaging unit 179 includes a sole support portion 187 of a substantially flat plate shape, and a sole massaging portion 192 comprised of air cells (air bags) 188 to 191, and a vibrator (not shown). As in the rear air cell 135 and the front air cell 137, the air cells 188 to 191 are configured to expand in fan-shaped form from a substantially flat state by inflowing air thereto. An intermediate mounting surface 193 is formed in an intermediate region in the width direction of the sole support portion 187 and configured to allow the air cell 188 and the vibrator to be mounted thereon. Support surfaces 194 are provided on right and left regions outside the intermediate mounting surface 193 of the sole support portion 187 and configured to allow the sole of the user to be supported thereon. Mounting surfaces 195 are provided on outer end regions of upper surfaces of the sole support portions 187 to be positioned on right and left regions outside the support surfaces 194. The intermediate mounting surface 193, the support surfaces 194, and the mounting surfaces 195 are parallel to each other. The intermediate mounting surface 193 is formed lower than the support surfaces 194 and the mounting surfaces 195 are formed lower than the intermediate mounting surface 193. In this manner, there are steps between the intermediate mounting surface 193 and the support surfaces 194 and between the mounting surfaces 195 and the support surfaces 194.

The support surface 194 and the intermediate mounting surface 193 may form a flat surface, or otherwise the support surface 194 and the mounting surface 195 may form a flat surface.

A pair of air cells 188 are arranged on right and left sides on a front half region of the intermediate mounting surface 193. The air cells 188 are mounted to the intermediate mounting surface 193 in such a manner that their expandable ends are closer to each other and their unexpandable ends are distant from each other.

The vibrators are mounted in regions of the intermediate mounting surface 193 which are located behind the two air cells 188. Each vibrator is positioned to correspond to an arch of the foot of a user with a standard frame, with the foot placed on the foot massaging unit 179.

An air cell 189 is mounted in a front half region of the mounting surface 195 to be located at a position lateral relative to the air cell 188. The air cell 189 has a main surface sized to be slightly smaller than a front half region of the mounting surface 195, and is placed in such a manner that its unexpandable end is oriented inward. A receiver plate 196 having a main surface of substantially the same shape as that of the upper surface of the air cell 189 is mounted on the upper surface of the air cell 189. Furthermore, an air cell 191 is mounted on an upper surface of the receiver plate 196. Since placement and construction of these air cells 189 and 191 and the receiver plate 196 are identical to those of the rear air cell 135, the receiver plate 136, and the front air cell 137 described in the fourth embodiment, they will not be further described.

An air cell 190 is mounted to a rear half region of the mounting surface 195 to be located at a position lateral relative to the vibrator. The air cell 190 is sized to be slightly smaller than the air cell 189, and is placed in such a manner that its unexpandable end is oriented inward as in the air cell 189.

Figure 48:
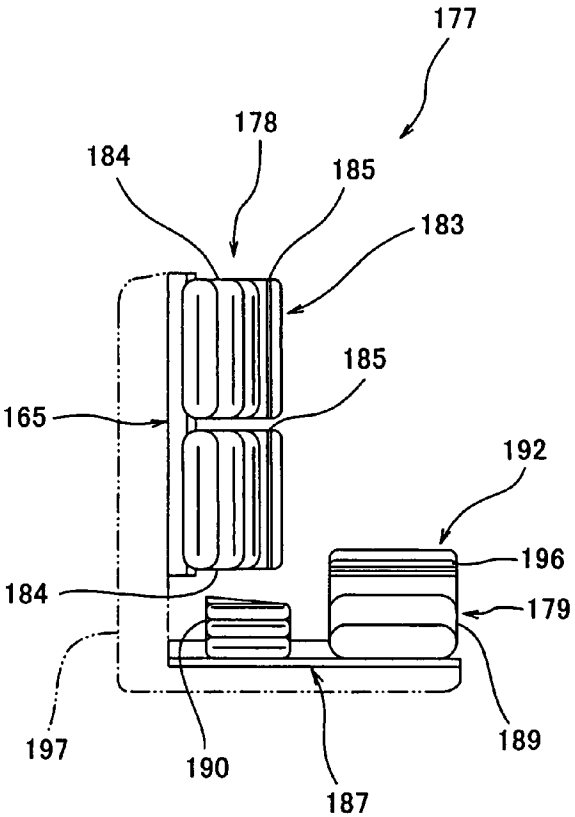
FIG. 48 is a side view showing a construction of the leg rest with the air cells in an expanded state according to the ninth embodiment of the present invention.
Figure 47:
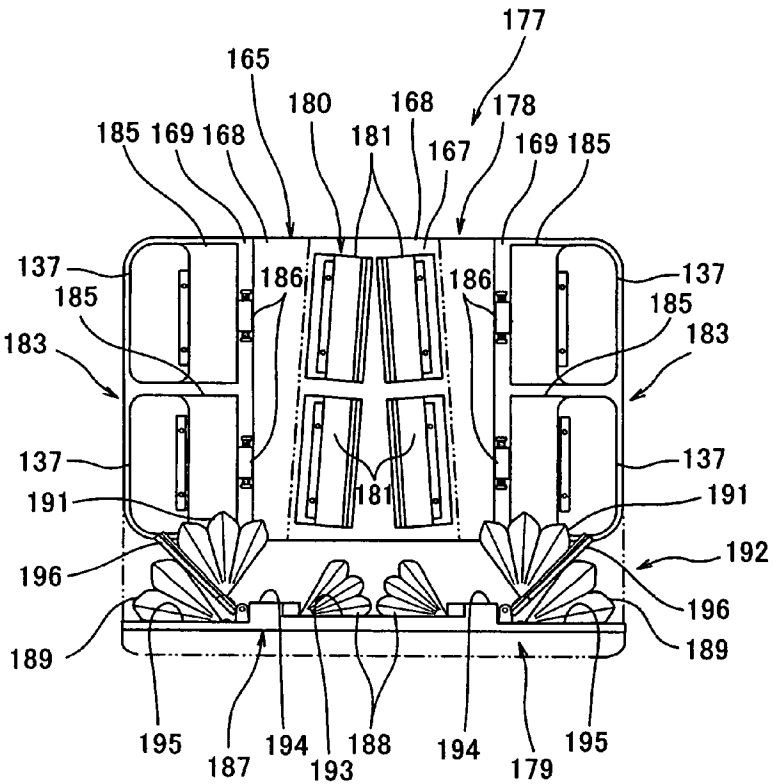
FIG. 47 is a front view showing a construction of the leg rest with air cells in an expanded state according to the ninth embodiment of the present invention.

FIG. 47 is a front view showing a construction of the leg rest 177 with the air cells 188 to 191 expanded. FIG. 48 is a side view thereof. With the sole of an adult user of a standard frame placed on the sole massaging unit 179, a part of the sole is placed on the support surface 194 and the remaining part is placed on the air cell 188 and the vibrator. Under this condition, by expanding the air cells 189 and 191, a top surface of the foot of the user is pressed from above by the air cell 191 as shown in FIGS. 47 and 48. Thus, the top surface of the foot of the user is massaged. In addition, when the air cells 188 and 190 and the vibrator operate with the foot of the user pressed from above, the foot of the user is inhibited from moving away therefrom due to pressure or vibration of them.

By expanding the air cell 188, the tip portion of the foot of the user from a bottom region to an inner region is pressed. Further, by expanding the air cell 190, an ankle (malleolus) of the user is pressed. By operating the vibrator, the vibrational stimulation is applied to the arch of the foot of the user.

By repeating expansion and contraction of the air cells 188 to 191 independently or in synchronization with each other, or by operating the vibrator independently or in synchronization with these air cells 188 to 191, comfortable stimulation is applied to the user while the foot is massaged.

As shown by two-dotted lines in FIGS. 45 to 48, the lower leg massaging unit 178 and the foot massaging unit 179 are coupled by a frame 197 to configure the leg rest 177. In this case, the frame 197 may be provided with an expansion and contraction system to vary a distance between the lower leg massaging unit 178 and the foot massaging unit 179. Alternatively, instead of coupling the lower leg massaging unit 178 to the foot massaging unit 179 by the frame 197 or the like, only the lower leg massaging unit 178 may be pivotally mounted on the seat portion 102, and the foot massaging unit 179 may be placed on a floor surface under the lower leg massaging unit 178 during use.

The above mentioned configuration of the lower leg massaging unit 178 is merely exemplary, and it may be configured as the leg rest of any of the fourth to ninth embodiments. In addition, the above mentioned configuration of the foot massaging unit 179 is merely exemplary. The foot massaging unit 179 may be configured in such a manner that the air cells 189 and 191 and the receiver plate 196 may be omitted, and/or one or a plurality of the air cells 189 and 191 and the receiver plate 196 may be omitted, another air cells or vibrators may be provided separately from the air cells 188 to 191 and the vibrator, or otherwise one or a plurality of the air cells 188 to 191 and the vibrator may be placed at positions different from those mentioned above.

Since other configurations, functions, and effects of the chair-type massaging apparatus of the ninth embodiment are identical to those of the chair-type massaging apparatus 101 of the fourth embodiment, the same components are identified by the same reference numerals and their configurations, functions, and effects will not be further described.

As in the fourth embodiment, the number and size of the rear air cells 184, the receiver plates 185 and the front air cells 137 are not intended to be limited to those illustrated in the ninth embodiment. Also, the rear air cell 184 and the front air cell 137 need not be superimposed with the receiver plate 185 interposed between them. For example, each of the rear air cell 184 and the front air cell 137 may include only one air bag or may be superimposed without the receiver plate 185. Furthermore, they may include three or more air bags superimposed.

Embodiment 10

Figure 49:
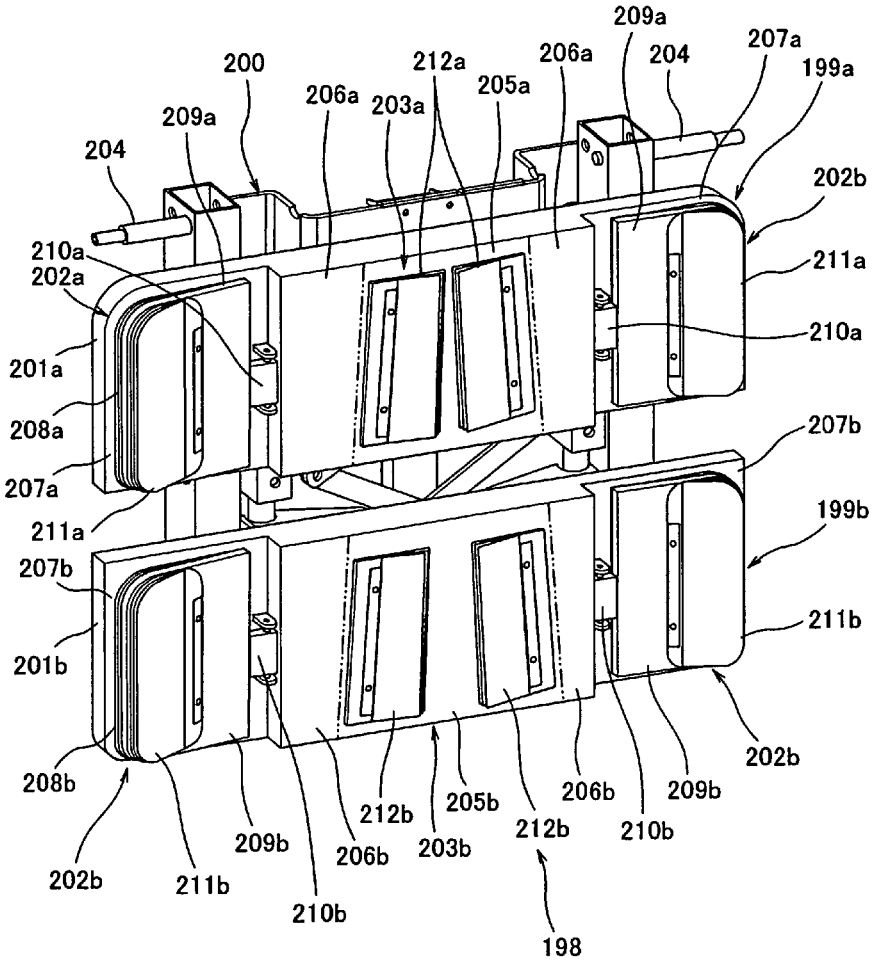
FIG. 49 is a perspective view showing a construction of a leg rest of a chair-type massaging apparatus according to a tenth embodiment of the present invention.

FIG. 49 is a perspective view showing a construction of a leg rest 198 of a chair-type massaging apparatus according to a tenth embodiment of the present invention. In description below, the leg rest 198 is illustrated as extended substantially downward from a front end of the seat surface 102*b*, except for cases specifically mentioned.

The leg rest 198 of the tenth embodiment mainly comprises an upper unit 199*a*, a lower unit 199*b*, and an expansion and contraction system (distance changing device) 200. The upper unit 199*a* mainly includes an upper support portion 201*a*, a massaging portion 202*a*, and an intermediate massaging portion 203*a*. The lower unit 199*b* mainly includes a lower support portion 201*b*, a massaging portion 202*b*, and an intermediate massaging portion 203*b*. A support portion of the present invention is constructed of the upper support portion 201*a* and the lower support portion 201*b*.

The upper unit 199*a* is mounted in front of and under the seat surface 102*b* of the seat portion 102, and the lower unit 199*b* is mounted under the upper unit 199*a*. The upper and lower units 199*a* and 199*b* are mounted to be vertically arranged on the front side of the expansion and contraction system 200 mounted on a front side of an upper region of the seat portion 102*b* to be pivotable around a pivot 204. As in the construction in which the lower leg massaging unit 178 described in the ninth embodiment is divided in two, the upper unit 199*a* and the lower unit 199*b* are vertically arranged to move toward and away from each other.

The upper unit 199*a* includes an upper support portion 201*a* which is of a substantially flat plate shape. The upper support portion 201*a* has an intermediate mounting surface 205*a* (trapezoid-shaped region defined by the two-dotted line of FIG. 49) in an intermediate region substantially in a width direction thereof to allow the intermediate massaging portion 203*a* to be mounted thereon. Support surfaces 206*a* are provided on right and left sides outside the intermediate mounting surface 205*a* of the upper support portion 201*a* and configured to allow the right and left calves of the user to be supported thereon. Further, mounting surfaces 207*a* are formed outside the support surfaces 206*a* and configured to allow the massaging portion 202*a* to be mounted thereon. The intermediate mounting surface 205*a*, the support surfaces 206*a*, and the mounting surfaces 207*a* are parallel to each other, and the intermediate mounting surface 205*a* and the support surface 206*a* are configured to be as high as each other to form a flat surface, and the mounting surface 207*a* is configured to be lower than these. Thus, there are steps between the mounting surfaces 207*a* and the support surfaces 206*a*.

Such a construction is exemplary. Alternatively, the mounting surfaces 207*a*, 207*b* and the support surfaces 206*a*, 206*b* may form a flat surface, or otherwise the intermediate mounting surfaces 205*a*, 205*b* and the support surfaces 206*a*, 206*b* may form a step between them in such a manner that the intermediate mounting surfaces 205*a*, 205*b* is lower than the support surface 206*a*, 206*b*.

The rear air cells 208*a* are respectively mounted to the right and left mounting surfaces 207*a*. The rear air cell 208*a* is configured to expand in fan-shaped form from a substantially flat state by inflowing the air thereto as in the rear air cell 135 and the front air cell 137 which have been described in the fourth embodiment. The rear air cell 208*a* has a main surface which is slightly smaller than the mounting surface 207*a*. The rear air cell 208*a* is mounted on the mounting surface 207*a* as in the rear air cell 135 of the fourth embodiment in such a manner that its unexpandable end is oriented inward, i.e., toward the support surface 206*a*, and its expandable end is oriented outward.

A receiver plate 209*a* is mounted in front of the rear air cell 208*a*. The receiver plate 209*a* is of a substantially rectangular shape having an area slightly larger than that of the main surface of the rear air cell 208*a* and is placed in front of the rear air cell 208*a* so as to cover the entire of the rear air cell 208*a*. The receiver plate 209*a* is mounted to the mounting surface 207*a* by a hinge 210*a* as in the receiver plate 136 of the fourth embodiment. Since the detail of the mounting structure is identical to the mounting structure of the receiver plate 136 of the fourth embodiment, it is not further described. As in the receiver plate 136 of the fourth embodiment, the receiver plates 209*a* and 209*b* which will be described later may be formed of a relatively hard material such as metal, or otherwise a relatively flexible material such as synthetic resin.

A front air cell 211*a* is mounted to a front surface of the receiver plate 209*a*. A main surface portion of the front air cell 211*a* is of a substantially rectangular parallelepiped shape having an area substantially equal to that of an outer half region of the main surface of the receiver plate 209*a*. The front air cell 211*a* is mounted to a substantially outer half region of the front surface of the receiver plate 209*a* as in the front air cell 137 of the fourth embodiment in such a manner that its unexpandable end is oriented inward and its expandable end is oriented outward.

In this manner, the massaging portion 202*a* is constructed of the rear air cell 208*a*, the receiver plate 209*a*, and the front air cell 211*a*.

A pair of intermediate air cells 212*a* are mounted to be arranged on right and left sides on the intermediate mounting surface 205*a*. As in the rear air cell 208*a* and the front air cell 211*a*, each intermediate air cell 212*a* is configured to expand in fan-shaped form from a substantially flat state by inflowing the air thereto. The intermediate air cells 212*a* are mounted to the intermediate mounting surface 205*a* in such a manner that their expandable ends are closer to each other, their unexpandable ends are distant from each other, and a distance between them increases in a downward direction. As in the mounting structure by which the rear air cell 135 is mounted to the support surface 133 described in the fourth embodiment, each intermediate air cell 212*a* is mounted to the intermediate mounting surface 167 such that an expansion restricting portion is fixed to the intermediate mounting surface 205*a*. The intermediate massaging portion 203*a* is constructed of the two intermediate air cells 212*a*.

The intermediate air cells 212*a*, 212*b* are not intended to be limited to a configuration in which adjacent intermediate air cells 212*a*, 212*b* are tilted, but may be mounted to the intermediate mounting surfaces 205*a*, 205*b* to be arranged in parallel with each other.

The lower unit 199*b* mainly includes a lower support portion 201*b*, a massaging portion 202*b* which is mounted to a mounting surface 207*b* of the lower support portion 201*b* and includes a rear air cell 208*b*, a receiver plate 209*b* and a front air cell 211*b*, and an intermediate mounting portion 203*b* which is mounted to an intermediate mounting surface 205*b* (trapezoid-shaped region defined by two-dotted line of FIG. 30) of the lower support portion 201*b* and includes two intermediate air cells 212*b*. The two intermediate air cells 212*b* are placed in such a manner that a distance between them is larger than that of the intermediate air cells 212*a* and increases in a downward direction and a tilting angle of the intermediate air cells 212*b* with respect to the longitudinal direction is equal to that of the intermediate air cells 212*a* so that the intermediate air cell 212*a* of the upper unit 199*a* and the intermediate air cell 212*b* of the lower unit 199*b* which are located on the same side extend in a straight line shape when the upper unit 199*a* and the lower unit 199*b* are moved closer to each other. The other construction of the lower unit 199*b* is identical to that of the upper unit 199*a*, and will not be further described.

The upper unit 199*a* and the lower unit 199*b* are mounted to the expansion and contraction system 200 as shown in FIG. 49 in such a manner that they are movable close to each other or away from each other.

Figure 50:
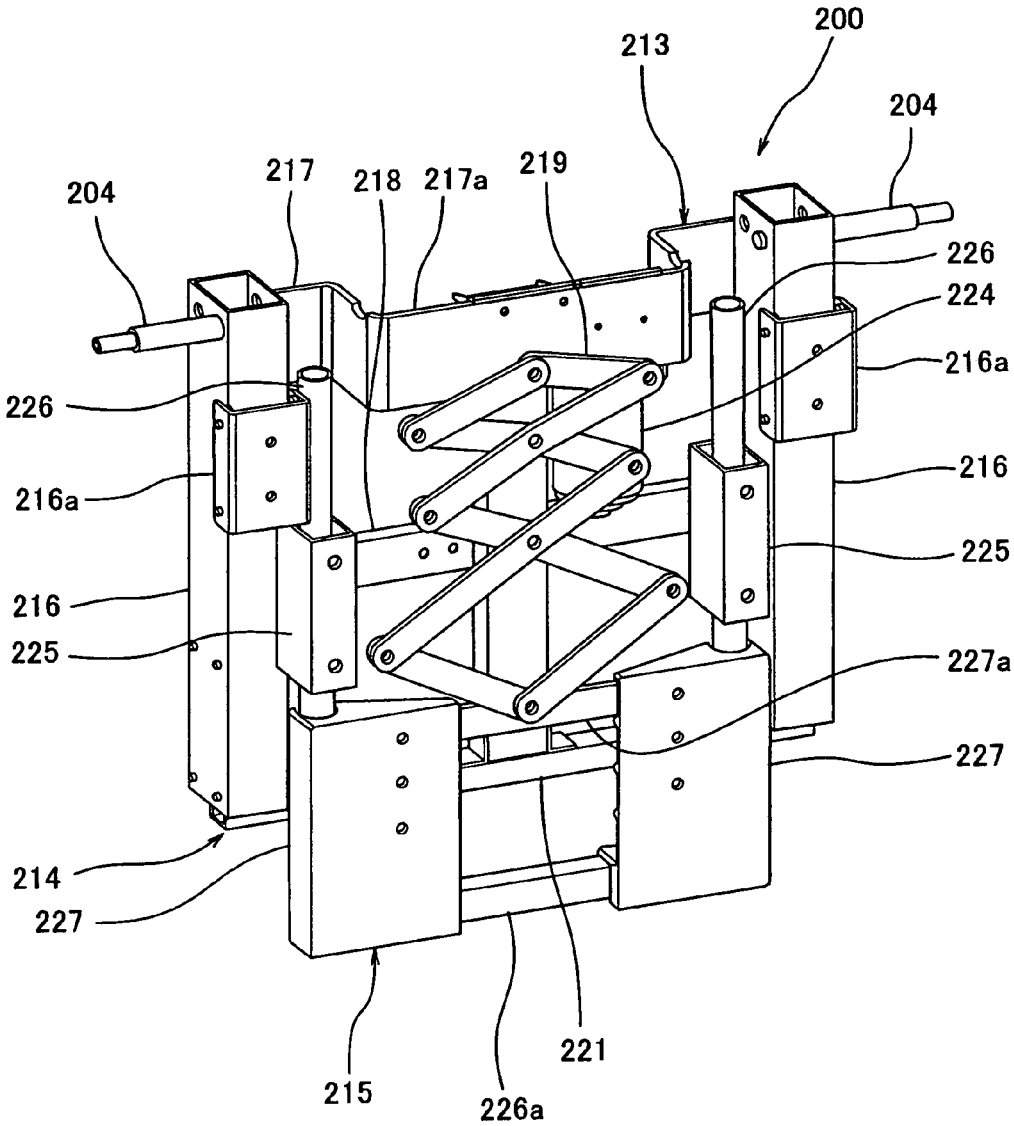
FIG. 50 is a perspective view showing a construction of an expandable and contractable system of the leg rest according to the tenth embodiment of the present invention.
Figure 51:
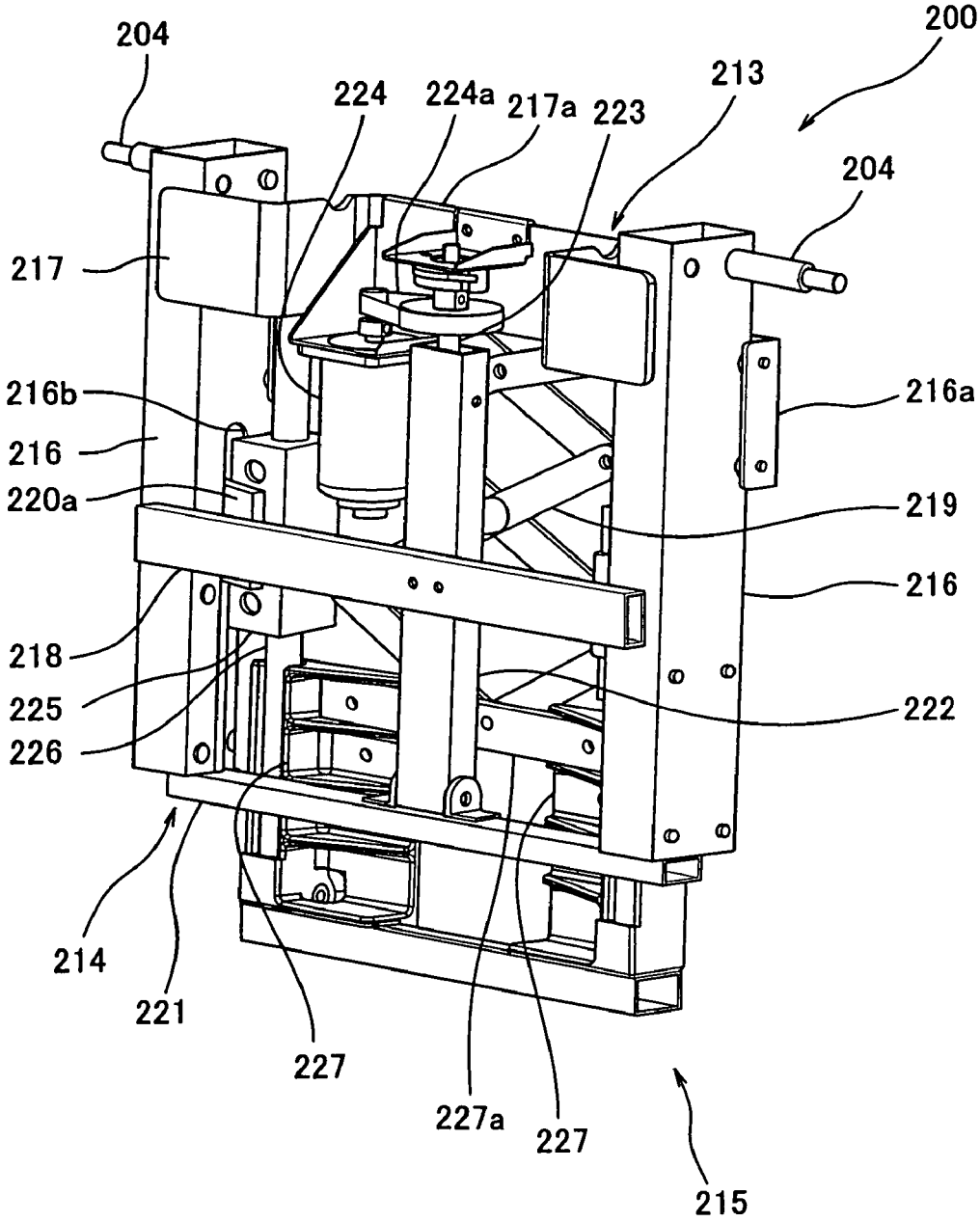
FIG. 51 is a perspective view showing the construction of the expandable and contractable system of the leg rest according to the tenth embodiment of the present invention.
Figure 52:
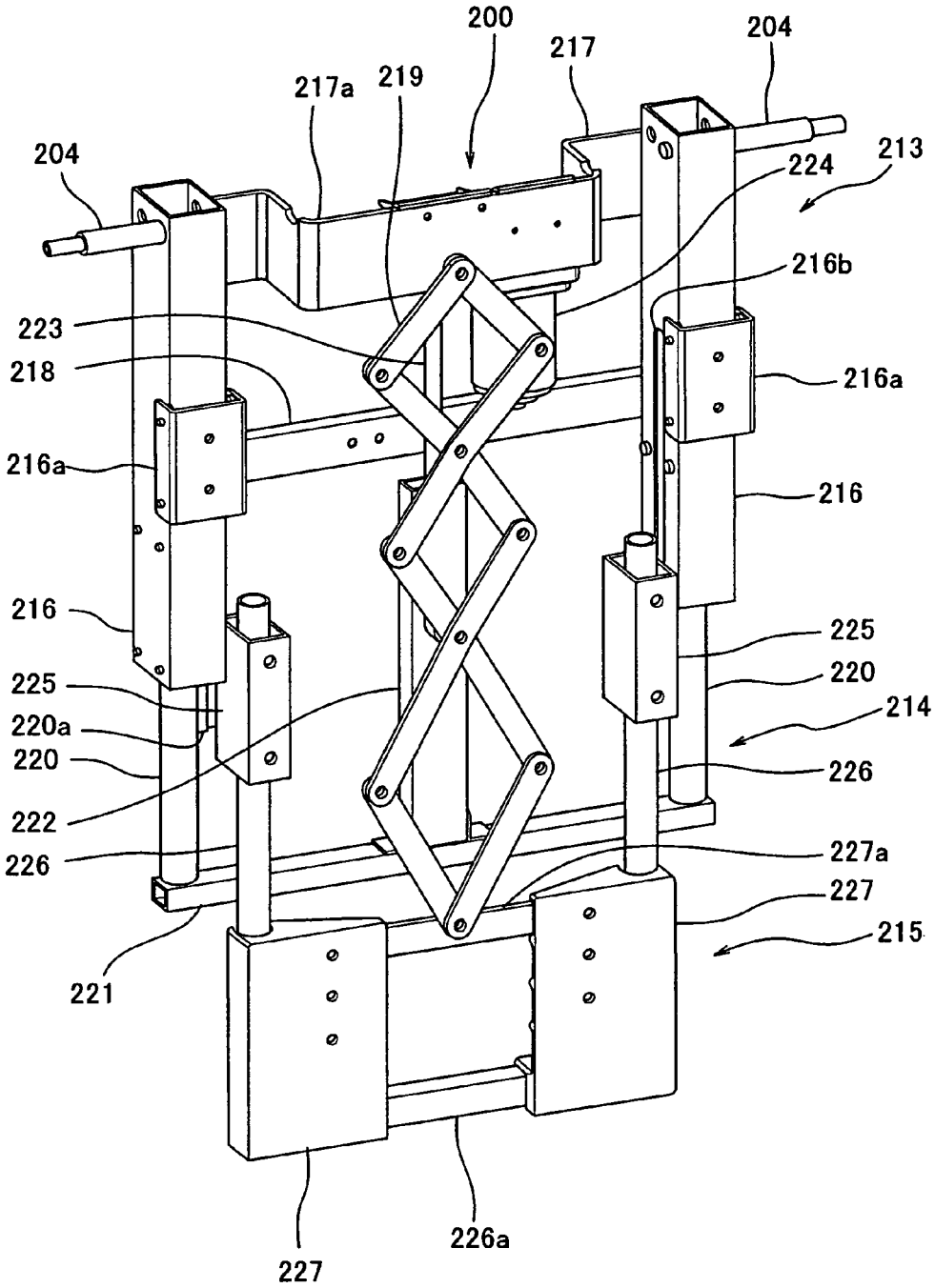
FIG. 52 is a perspective view showing the construction of the expandable and contractable system of the leg rest according to the tenth embodiment of the present invention.
Figure 53:
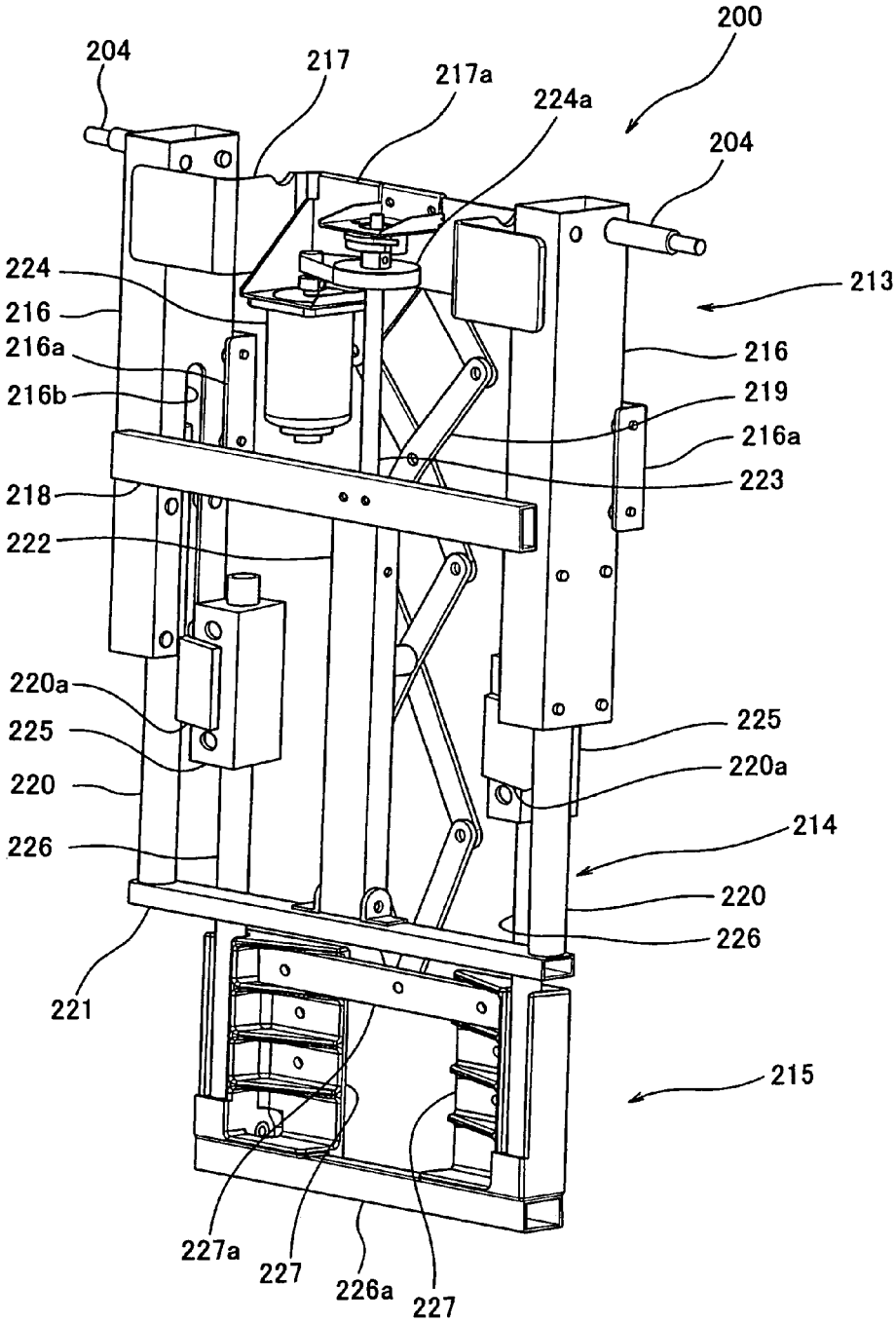
FIG. 53 is a perspective view showing the construction of the expandable and contractable system of the leg rest according to the tenth embodiment of the present invention.

FIGS. 50 to 53 are perspective views showing a construction of the expansion and contraction system 200. FIGS. 50 and 51 are views of the expansion and contraction system 200 in a most contracted state as seen from obliquely forward and obliquely rearward. FIGS. 52 and 53 are views of the expansion and contraction system 200 in a most expanded state as seen from obliquely forward and obliquely rearward. As shown in FIGS. 50 and 52, the expansion and contraction system 200 mainly includes an upper element 213, an intermediate element 214, and a lower element 215. The upper element 213 includes two tubes 216 that are rectangular in cross-section and are arranged to extend in a vertical direction in parallel with each other. Upper end portions of the tubes 216 are coupled to each other by a coupling element 217. For the purpose of improved strength, a rod-shaped element 218 is provided to extend between intermediate regions of the two tubes 216.

The coupling element 217 is bent to protrude forward at its intermediate region. A link at one end of an extensible arm 219 is pivotally mounted to a protruding portion 217*a* by a pivot extending forward and backward. The extensible arm 219 has a pantograph-type structure with three linked sections.

A mounting element 216*a* is fastened to a front side of an intermediate region of each tube 216. Each mounting element 216*a* has a flat surface portion oriented forward, and the upper unit 199*a* is mounted to the flat surface portion (see FIG. 49).

The pivot 204 extends horizontally outward from upper end portions of the tubes 216. This enables the upper element 213 to be pivotable forward and backward with respect to the seat portion 102. The pivot 204 is mounted to the seat portion 102. The direct-acting type actuator 143 is pivotally attached at a tip end portion thereof to a pivot element (not shown) mounted at a rear portion of the expansion and contraction system 200. By a user's predetermined input operation with the operation portion 147, the leg rest 198 is automatically pivotable forward and backward.

The intermediate element 214 includes two slidable rods 220 that are longitudinally elongated rectangular in cross-section and are arranged in parallel with each other, and a horizontally elongated connecting rod 221 connecting lower ends of the slidable rods 220 to each other. The slidable rods 220 are inserted into the tubes 216, respectively. Thereby, the slidable rods 220 are protrusible and retractable together, with respect to the tubes 216. A longitudinally elongated nut 222 is fastened at a lower end thereof to an intermediate region in the rightward and leftward direction of the connecting rod 221. A threaded rod 223 is threaded into the nut 222, and an upper portion of the threaded rod 223 protrudes from an upper end of the nut 222.

The threaded rod 223 is mounted to a rear side of the protruding portion 217*a* of the coupling element 217, i.e., to a concave portion, to be rotatable around its axis. A motor 224 is mounted laterally relative to a position where the threaded rod 223 is mounted to the ee coupling element 217. The motor 224 and the threaded rod 223 are coupled to each other by a rotation transmission system 224*a* including a belt and pulleys. Thereby, a rotation of an output shaft of the motor 224 is transmitted to the threaded rod 223, which is thereby protrusible and retractable with respect to the nut 222.

The nut 222 has an outer shape of a rod having a rectangular cross-section. A link formed by crossing two link members at an intermediate position of the extensible arm 219 is pivotally mounted to an intermediate region in a longitudinal direction of the nut 222 by a pivot extending forward and backward. In this construction, by driving the motor 224, the intermediate element 214 moves up and down, causing the extensible arm 219 to expand and contract.

A cut-out portion 216*b* that is vertically elongate is provided to extend in each of opposing surfaces, i.e., inner surfaces of the tubes 216 in a range from lower end thereof to an intermediate region thereof. A connecting plate 220*a* extends from an intermediate region in the longitudinal direction of each slidable rod 220 inward, i.e., toward the opposite slidable rod 220. A guide 225 is mounted on the connecting plate 220*a* and is configured to have a circular hole extending in parallel with the slidable rod 220. The connecting plate 220*a* extends from the inner side to the outer side of the tube 216 through the cut-out portion 216*b*. This allows the slidable rod 220 to advance and retract into and from the tube 216 without any interference between the connecting plate 220*a* and the tube 216. In this manner, the slidable rod 220, the connecting plate 220*a*, and the guide 225 are movable up and down.

The lower element 215 mainly includes two slidable rods 226 and two mounting elements 227. Each slidable rod 226 is of a round rod shape with a diameter slightly smaller than that of the circular hole formed in the guide 225. Lower ends of the slidable rods 226 are coupled to each other by a horizontally elongate coupling element 226*a*. A mounting element 227 is mounted to a lower end portion of each slidable rod 226. Each mounting element 227 has a flat surface portion oriented forward. The lower unit 199*b* is mounted to the flat surface portion (see FIG. 49).

Upper ends of the mounting elements 227 are coupled to each other by a horizontally elongate coupling element 227*a*. A link at a lower end of the extensible arm 219 is pivotally mounted to the coupling plate 227*a* by a pivot extending forward and backward. The motor 224 drives the intermediate element 214, which thereby moves toward and away from the upper element 213. When the extensible arm 219 expands and contracts, the lower element 215 slides close to and away from the intermediate element 214, causing the expansion and contraction system 200 to entirely expand and contract.

In the above mentioned construction, the leg rest 198 is pivotable forward and backward around the pivot 204. In addition, by changing the distance between the upper unit 199*a* and the lower unit 199*b*, the leg rest 198 is expandable and contractable. By causing the leg rest 198 to expand and contract, the upper unit 199*a* is moved to a position at which the upper unit 199*a* supports an upper side of the lower leg of the user and the lower unit 199*b* is moved to a position at which the lower unit 199*b* supports a lower side of the lower leg of the user.

Since the intermediate air cells 212*a* and 212*b* are mounted to the support portion 165 such that the distance between the air cells 212*a* and the distance between the air cells 212*b* respectively increase downward, they contact a larger range in the longitudinal direction of the lower legs of the user. As a result, the intermediate air cells 212*a* and 212*b* contacting only a longitudinal part of the calves is avoided.

Since other configurations, functions, and effects of the chair-type massaging apparatus of the tenth embodiment are identical to those of the chair-type massaging apparatus 101 of the fourth embodiment, the same components are identified by the same reference numerals, their configurations, functions, and effects will not be further described.

It shall be understood that the upper unit 199*a* and the lower unit 199*b* are not intended to be limited to the above mentioned configurations, but may be constructed such that any of the leg rests of the fourth to ninth embodiments is divided in two in the vertical direction. As in the fourth embodiment, the number and size of the rear air cells 208*a*, 208*b*, the receiver plates 209*a*, 209*b*, and the front air cells 211*a*, 211*b* are not intended to be limited to those illustrated in the tenth embodiment. Also, the rear air cell 208*a*, 208*b* and the front air cell 211*a*, 211*b* need not be superimposed with the receiver plate 209*a*, 209*b* interposed between them. For example, each of the rear air cell 208*a*, 208*b* and the front air cell 211*a*, 211*b* may include only one air bag or may be superimposed without the receiver plate 209*a*, 209*b*. Furthermore, they may include three or more air bags superimposed.

Embodiment 11

Figure 54:
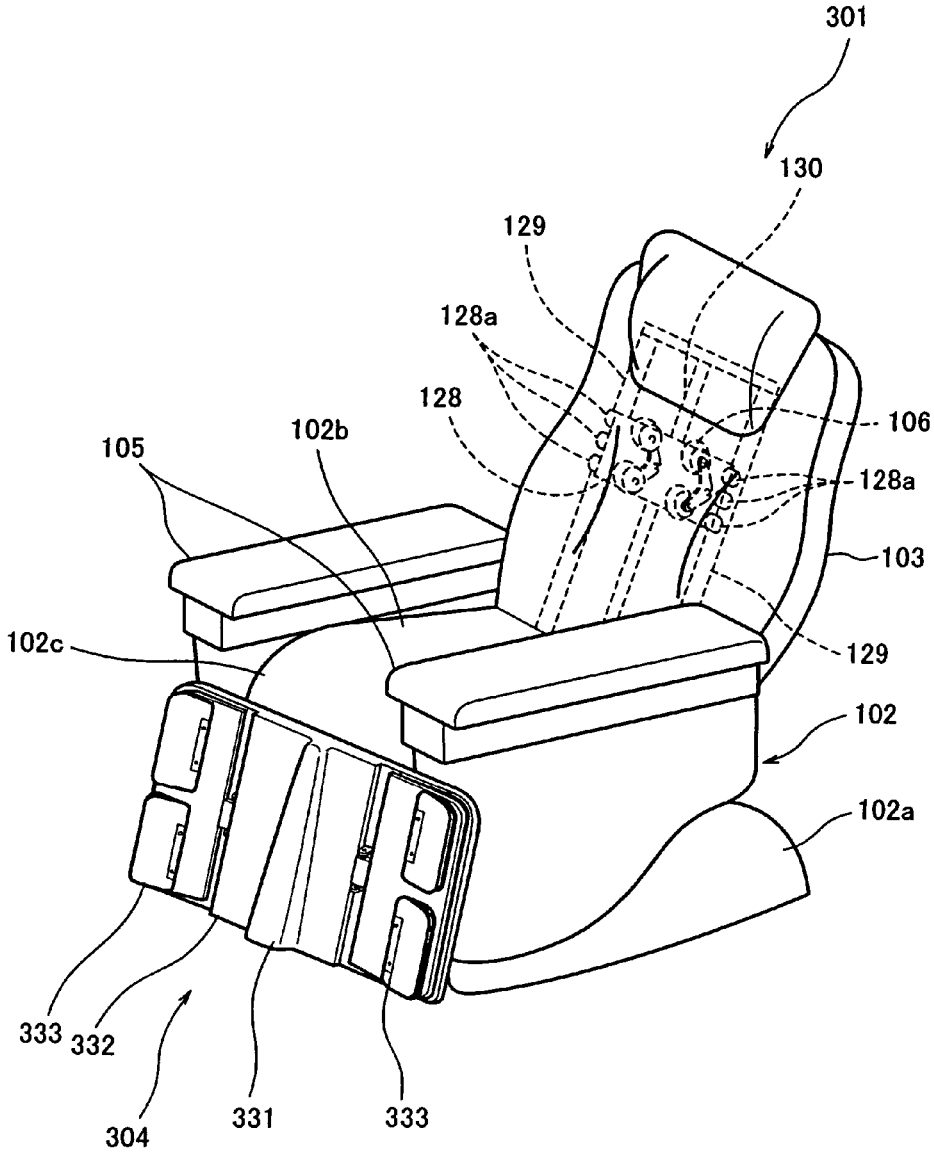
FIG. 54 is a perspective view showing a construction of an entire chair-type massaging apparatus according to an eleventh embodiment of the present invention.

FIG. 54 is a perspective view showing a construction of an entire chair-type massaging apparatus according to an eleventh embodiment of the present invention. As shown in FIG. 54, a chair-type massaging apparatus 301 of this embodiment is constructed such that the leg rest 104 of the chair-type massaging apparatus of the fourth embodiment is replaced by a leg rest 304 described below.

The leg rest 304 is provided with a longitudinally elongate support protrusion 331 formed at a substantially intermediate region in a width direction of a front surface thereof, and is configured to support the calves of the legs of the user on regions of the front surface which are located on both sides of the protrusion 331. As described later, the leg rest 304 is provided with a plurality of air cells which are connected by air hoses to the air inflow and outflow device 109 including a pump, a valve, and other components, which is built in the seat portion 102 or the back rest 103. The air cells expand and contract by air inflow and outflow by the air inflow and outflow device 109. With the user seated, the air cells expand and contract repeatedly, applying a pressing stimulation to the lower legs of the user.

Figure 55:
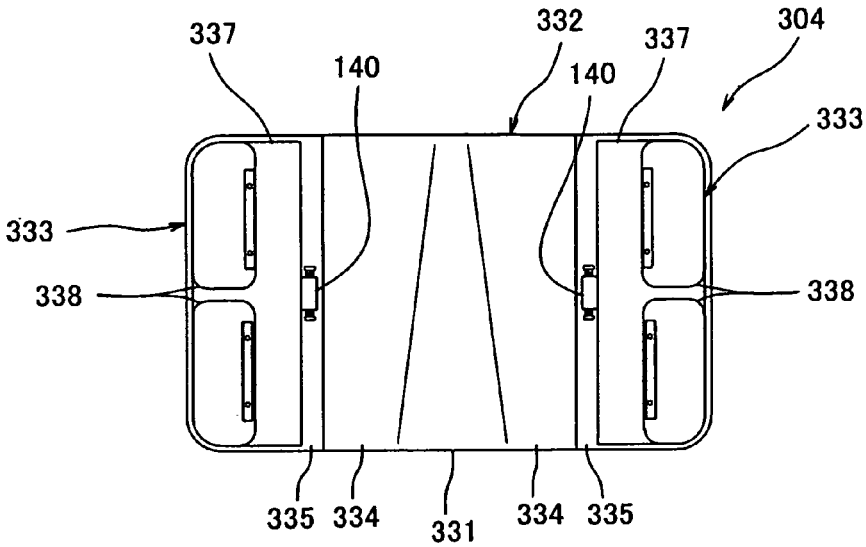
FIG. 55 is a front view showing a construction of a leg rest included in the chair-type massaging apparatus according to the eleventh embodiment of the present invention.
Figure 56:
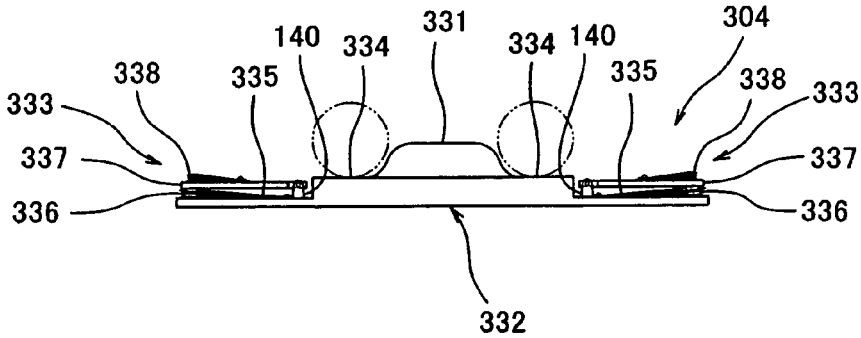
FIG. 56 is a plan view showing the construction of the leg rest included in the chair-type massaging apparatus according to the eleventh embodiment of the present invention.
Figure 57:
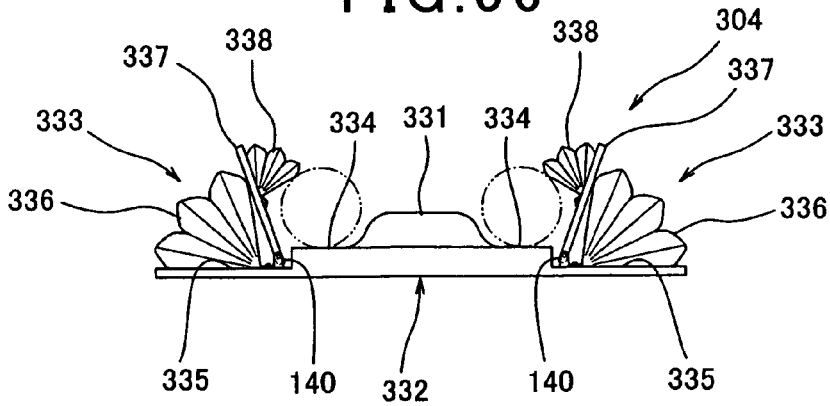
FIG. 57 is a plan view showing the construction of the leg rest included in the chair-type massaging apparatus according to the eleventh embodiment of the present invention.

A construction of the leg rest 304 will be described in detail. For the sake of simple explanation, as described below, the leg rest 304 is illustrated as extended substantially downward from a front end of the seat surface 102*b*, except for the condition specifically described. FIG. 55 is a front view showing the construction of the leg rest 304 provided in the chair-type massaging apparatus 301 according to the eleventh embodiment of the present invention. FIGS. 56 and 57 are plan views thereof. As shown in FIGS. 55 to 57, the leg rest 304 of this embodiment mainly includes a support portion 332 and massaging portions 333. The support portion 332 is configured such that the longitudinally elongate support protrusion 331 protrudes from the substantially intermediate region in the width direction of the front surface of a flat plate oriented such that its longitudinal direction corresponds with the vertical direction. The support portion 332 is mounted at an upper end thereof to a front side of the upper portion of the seat portion 102 by a pivot extending horizontally (see FIG. 54).

As shown in FIGS. 55 to 57, support surfaces 334 are located on both sides outside the support protrusion 331 of the support portion 332 and configured to support the right and left calves of the user. Mounting surfaces 335 are provided outside the support surfaces 334 and configured to allow the massaging portions 333 each including rear air cells 336, receiver plates 337, and front air cells 338 to be mounted thereon. Since rear air cell 336 and the front air cell 338 are configured as in the rear air cell 135 and the front air cell 137 described in the fourth embodiment, and the construction and the rotating structure of the receiver plate 337 are identical to those of the receiver plate 136 described in the fourth embodiment, these will not be further described. The support surface 334 and the mounting surface 335 are parallel to each other, and the mounting surface 335 is lower than the support surface 334. Thus, there is a step between the mounting surface 335 and the support surface 34.

While in the eleventh embodiment, the mounting surface 335 is formed lower than the support surface 334 to form a step between them, they may alternatively form a flat surface.

The support protrusion 331 is made of urethane foam, sponge material, foamed polystyrene, low-repulsion urethane, or chip urethane. The support protrusion 331 is provided on an intermediate region of the front surface of the support portion 332 to extend over an entire length in the vertical direction thereof and to protrude slightly forward from the support surface 334. The protruding amount is sufficiently small for the thickness of the lower legs of the user with a standard frame. With the lower legs of the user placed on the leg rest 304, both lateral end portions of the support protrusion 331 are in contact with rear inner regions of the lower legs, i.e., inner regions of the calves. In contrast to an intermediate wall or a side wall of the leg rest of a conventional massaging apparatus, the height of the support protrusion 331 is sufficiently small. This makes it possible for the user to assume a desired posture by merely moving the lower legs slightly away from the support surface 334 and by crossing them when the user desires to cross the legs. The support protrusion 331 is shaped to have a width that increases in a downward direction.

Depending on the use status of the leg rest 304, the lower legs of the user may be supported only by the support surface 334, or otherwise, only a part of the calves may be supported on the support surface 334 and the remaining part may be supported by the support protrusion 331.

The support protrusion 331 may be made of materials other than the urethane foam, the sponge, the foamed polystyrene, the low-repulsion urethane, or the chip urethane.

Since other configurations, functions, and effects of the chair-type massaging apparatus 301 of the eleventh embodiment are identical to those of the chair-type massaging apparatus 101 of the fourth embodiment, the same components are identified by the same reference numerals and their configurations, functions, and effects will not be further described.

In such a configuration, while the chair-type massaging apparatus 301 is not used, the rear air cells 336 and the front air cells 338 contract as shown in FIG. 56, so that the front side of the massaging portion 333 forms a substantially flat surface with the protrusion present only in the intermediate region in the width direction. Therefore, the leg rest 304 forms a substantially flat plate shape and the chair-type massaging apparatus 301 has a simple external appearance.

With the user seated on the chair-type massaging apparatus 301 in such a state, the lower legs of the user are easily placed on the leg rest 304 because the front surface of the leg rest 304 forms a substantially flat surface except for the intermediate region in the width direction thereof, and the leg rest 304 opens forward and laterally. In addition, by causing the inner regions of the calves to contact the support protrusion 331 with the lower legs of the user placed on the support portion 332, the calves of the user are guided to a massage position on the support surface 334. Furthermore, when the lower legs are not massaged, or the chair-type massaging apparatus 301 is otherwise used as an easy chair, for example, the user assumes a posture of crossed legs, the user can assume a desired posture freely without being disturbed by the support protrusion 331, because the height of the support protrusion 331 is sufficiently small in contrast to the intermediate wall or the like provided on the leg rest of the conventional massaging apparatus.

Since the support protrusion 331 is configured to have the width that increases in a downward direction, the lower legs of the user are easily fitted to the support protrusion 331, and the support protrusion 331 contacting only a longitudinal part of the calves is avoided.

The number and size of the support protrusion 331 are not intended to be limited to the configuration of the eleventh embodiment. For example, a plurality of support protrusions may be arranged in the vertical direction.

Embodiment 12

Figure 58:
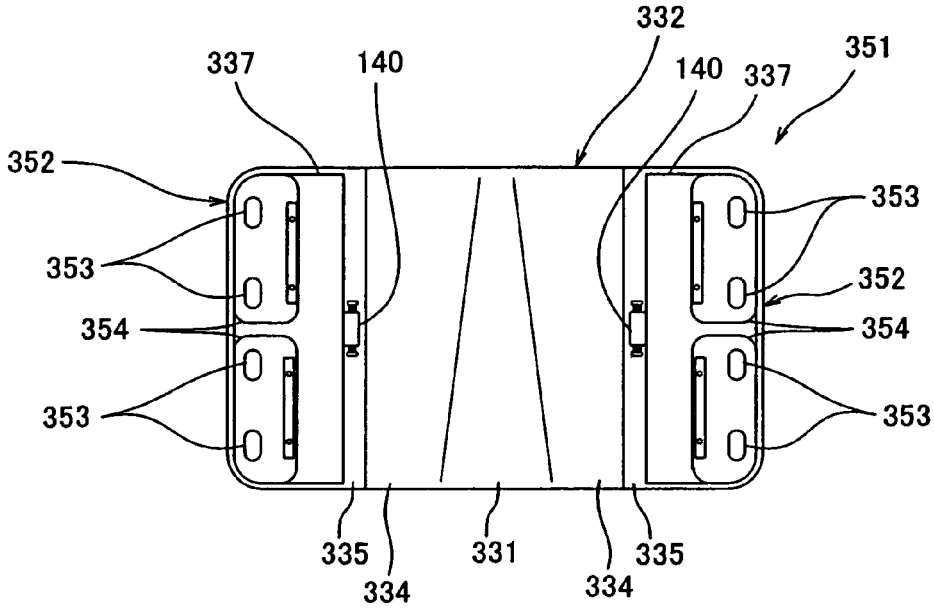
FIG. 58 is a front view showing a construction of a leg rest included in a chair-type massaging apparatus according to a twelfth embodiment of the present invention.
Figure 59:
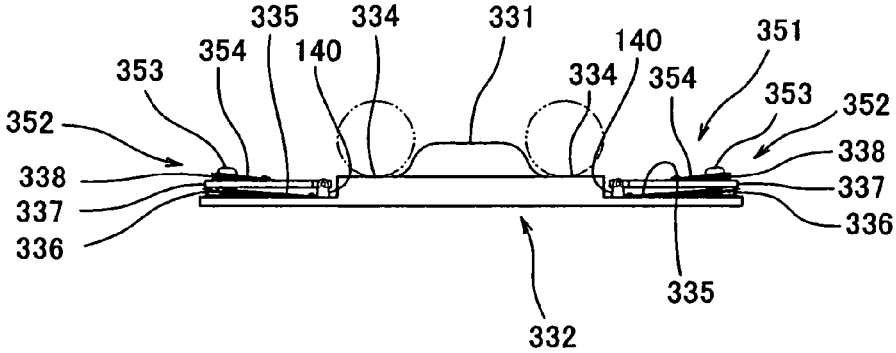
FIG. 59 is a plan view showing a construction of the leg rest included in the chair-type massaging apparatus according to the twelfth embodiment of the present invention.
Figure 60:
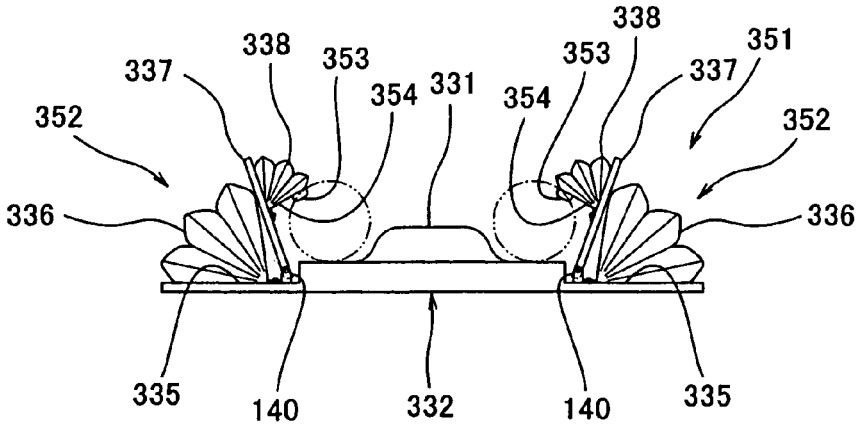
FIG. 60 is a plan view showing the construction of the leg rest included in the chair-type massaging apparatus according to the twelfth embodiment of the present invention.
Figure 61:
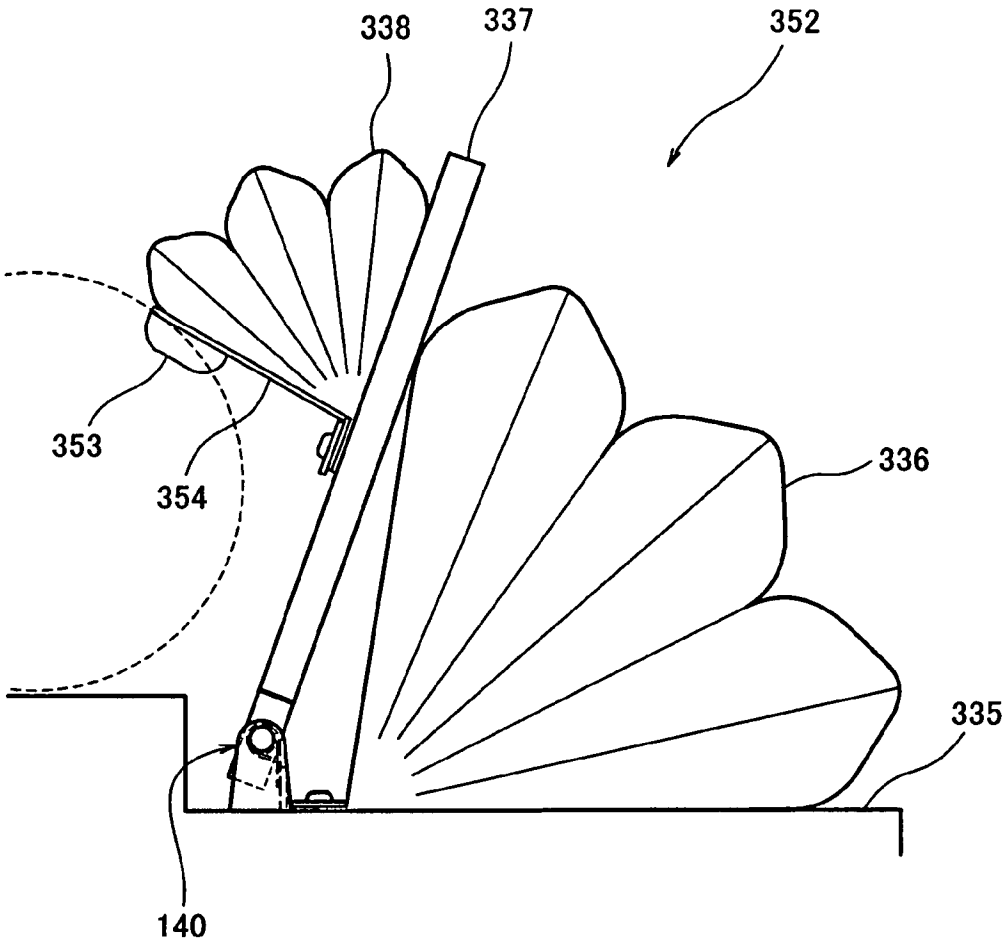
FIG. 61 is a partially enlarged plan view of the leg rest of FIG. 60.

FIG. 58 is a front view showing a construction of a leg rest of a chair-type massaging apparatus according to a twelfth embodiment of the present invention. FIGS. 59 and 60 are plan views thereof. FIG. 61 is a partially enlarged plan view of the leg rest. As shown in FIGS. 58 to 60, each massaging portion 352 of a leg rest 351 of the twelfth embodiment is constructed such that two pressing heads (massaging elements) 353 are arranged in the longitudinal direction on the front side of each front air cell 338. More specifically, as shown in FIG. 61, a pressing plate 354 having a main surface of a shape substantially identical to that of the front surface of the front air cell 338 is fixed to the front surface of the front air cell 338, and the two pressing heads 353 are arranged in the vertical direction on the front surface of each pressing plate 354. When the rear air cell 336 and the front air cell 338 expand, the pressing heads 353 press the outer region of the shin of the user, thus applying stimulation to the user as if the user was being massaged by a masseuse.

The pressing heads 353 may be made of metal or synthetic resin, and are desirably made of elastic elastomer, various kinds of urethane foams, or other foams, in order to inhibit strong stimulation from being applied to the user. Also, the shape of the pressing heads 353 is not intended to be limited, and is desirably pointless, for example, hemispherical.

Since other configurations, functions, and effects of the chair-type massaging apparatus of the twelfth embodiment are identical to those of the chair-type massaging apparatus 301 of the eleventh embodiment, the same components are identified by the same reference numerals and their configurations, functions, and effects will not be further described.

As in the fourth embodiment, the number and size of the rear air cells 336, the receiver plates 337 and the front air cells 338 are not intended to be limited to those illustrated in the twelfth embodiment. Also, the rear air cell 336 and the front air cell 338 need not be superimposed with the receiver plate 337 interposed between them. For example, each of the rear air cell 336 and the front air cell 338 may include only one air bag or may be superimposed without the receiver plate 337. Furthermore, they may include three or more air bags superimposed.

As in the eleventh embodiment, the number and size of the support protrusion 331 are not intended to be limited to the configuration of the eleventh embodiment, and for example, a plurality of support protrusions may be arranged in the vertical direction.

Embodiment 13

Figure 62:
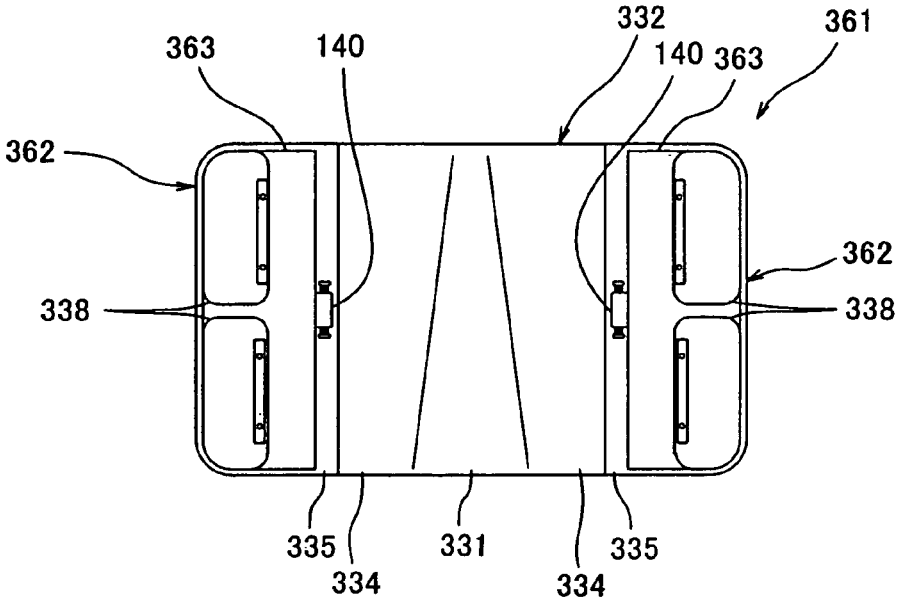
FIG. 62 is a front view showing a construction of a leg rest included in a chair-type massaging apparatus according to a thirteenth embodiment of the present invention.
Figure 63:
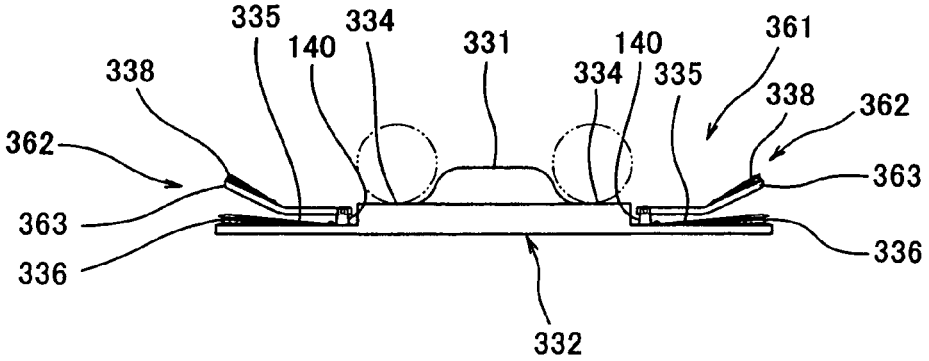
FIG. 63 is a plan view showing the construction of the leg rest included in the chair-type massaging apparatus according to the thirteenth embodiment of the present invention.
Figure 64:
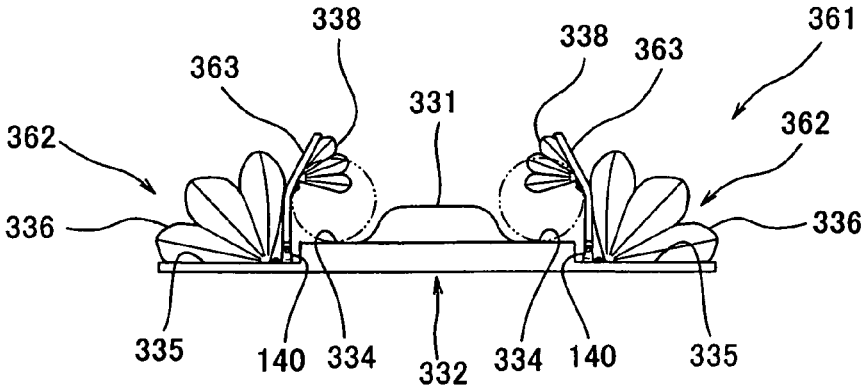
FIG. 64 is a plan view showing the construction of the leg rest included in the chair-type massaging apparatus according to the thirteenth embodiment of the present invention.

FIG. 62 is a front view showing a construction of a leg rest of a chair-type massaging apparatus according to a thirteenth embodiment of the present invention. FIGS. 63 and 64 are plan views thereof. As shown in FIGS. 62 to 64, a receiver plate 363 included in a massaging portion 362 of a leg rest 361 according to the thirteenth embodiment is structured such that an outer end portion in the width direction thereof is bent forward a predetermined angle. A front air cell 338 is mounted to a region of the receiver plate 363 which is located outside the bent position. As shown in FIG. 64, a rear air cell 336 is expandable to an extent to which a base end portion of the receiver plate 363 becomes vertical to a support surface 334. So, when the rear air cell 336 expands, the support surface 334 is covered with an outer end portion of the receiver plate 363 from the front. The receiver plate 363 may be made of any materials so long as the receiver plate has hardness sufficient to maintain the bent state. The receiver plate is preferably made of materials having relatively high hardness such as metals, plastic or other materials having high strength and rigidity at temperatures around a room temperature.

In contrast to the configuration in which the receiver plate is flat, the front air cell 338 is moved closer to the lower leg of the user when the rear air cell 336 expands. By expanding the front air cell 338, the front region of the lower leg including the outer region of the shin of the user is pressed substantially rearward, thus applying stronger stimulation to the outer region of the shin. Even when the front air cell 338 is smaller, sufficient strength of massage is ensured.

While the receiver plate 363 is bent forward at one point, it may alternatively be entirely curved in a circular arc shape.

Since the other configurations, functions, and effects of the chair-type massaging apparatus of the thirteenth embodiment are identical to those of the chair-type massaging apparatus 301 of the eleventh embodiment, the same components are identified by the same reference numerals and their configurations, functions, and effects will not be further described.

As in the fourth embodiment, the number and size of the rear air cells 336, the receiver plates 337 and the front air cells 338 are not intended to be limited to those illustrated in the thirteenth embodiment. Also, two or more air bags may be superimposed on the front surface of the receiver plate 363 or behind it.

As in the eleventh embodiment, the number and size of the support protrusion 331 are not intended to be limited to those of the thirteenth embodiment. For example, a plurality of support protrusions may be arranged in the vertical direction.

Embodiment 14

Figure 66:
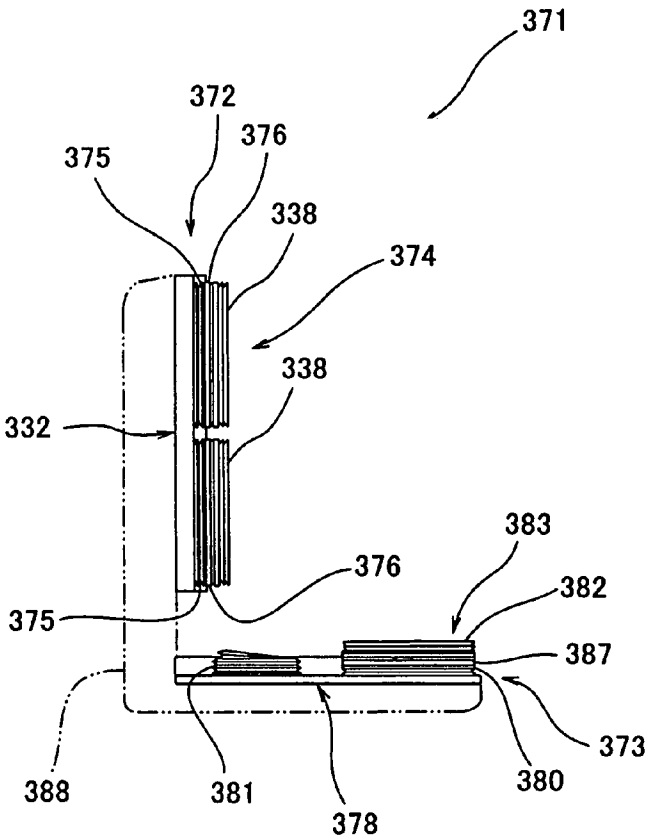
FIG. 66 is a side view showing the construction of the leg rest included in the chair-type massaging apparatus according to the fourteenth embodiment of the present invention.
Figure 65:
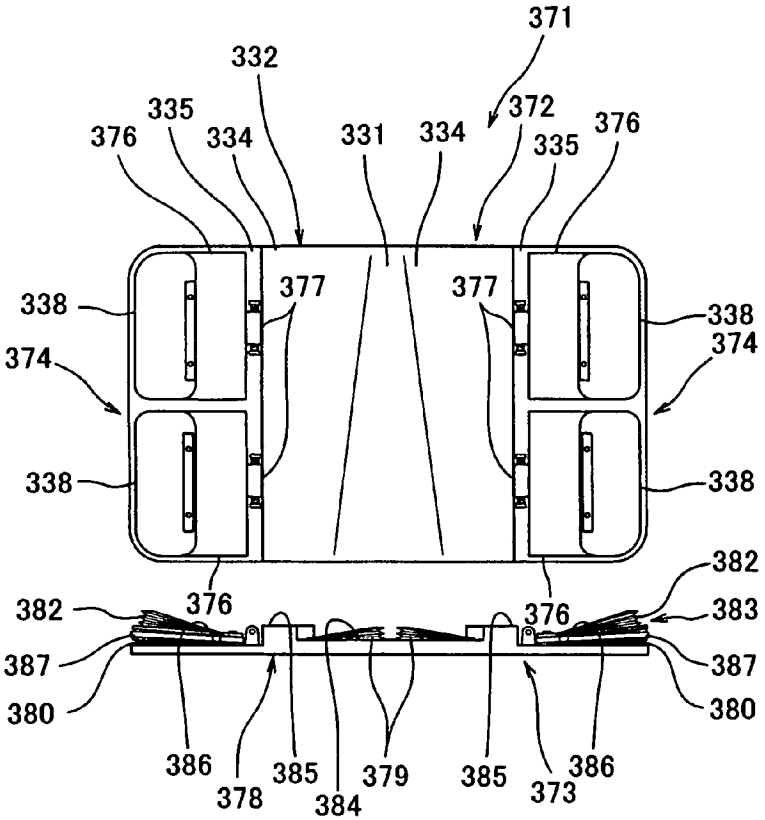
FIG. 65 is a front view showing a construction of a leg rest included in a chair-type massaging apparatus according to a fourteenth embodiment of the present invention.

FIG. 65 is a front view showing a construction of a leg rest 371 of a chair-type massaging apparatus according to a fourteenth embodiment of the present invention. FIG. 66 is a side view thereof. As shown in FIGS. 65 and 66, the leg rest 371 according to the fourteenth embodiment includes a lower leg massaging unit 372 configured to massage the lower leg of the user, i.e., a region ranging from a knee to an ankle of the user, and a foot massaging unit 373 configured to massage a foot of the user, i.e., a region ranging from the ankle to a tip portion of the foot. The lower leg massaging unit 372 is identical in construction to that of the leg rest 304 of the eleventh embodiment except that each of the right and left massaging portions 374 includes rear air cells 375 and receiver plates 376 which are arranged in the vertical direction in such a manner that the rear air cell 336 and the receiver plate 337 of the massaging portion 333 shown in FIG. 11 are each divided in two in the vertical direction.

Subsequently, a construction of the massaging portion 374 will be described in detail. The two rear air cells 375 are arranged in the vertical direction on each mounting surface 335. As in the rear air cell 135 and the front air cell 137 of the fourth embodiment, each rear air cell 375 is configured to expand in fan-shaped form from a substantially flat state by inflowing the air thereto. The rear air cell 375 has a main surface portion which is slightly smaller than an upper half region (or lower half region) of the mounting surface 335, and is placed on the mounting surface 335 as in the rear air cell 135 of the fourth embodiment in such a manner that its unexpandable end is oriented inward, i.e., toward the support surface 334, and its expandable end is oriented outward.

The receiver plate 376 is mounted in front of each rear air cell 375. Each receiver plate 376 is of a substantially rectangular plate shape having an area slightly larger than that of a main surface portion of the rear air cell 375, and is mounted in front of the rear air cell 375 to entirely cover the rear air cell 375. The receiver plate 376 is mounted on the mounting surface 335 by a hinge 377 as in the receiver plate 136 of the fourth embodiment, as in the mounting structure of the receiver plate 136 of the fourth embodiment. One front air cell 338 is mounted on an outer half region of the front surface of each receiver plate 376 as in the fourth embodiment. As in the receiver plate 136 of the fourth embodiment, the receiver plate 376 may be made of a relatively hard material such as metal, or a relatively flexible material such as synthetic resin.

In the manner described above, the rear air cells 375, the receiver plates 376, and the front air cells 338 form the massaging portion 374.

Each foot massaging unit 373 includes a sole support portion 378 of a substantially flat plate shape, and a sole massaging portion 383 comprised of air cells 379 to 382 and a vibrator (not shown). As in the rear air cells 336 and the front air cells 338, the air cells 379 to 382 expand in fan-shaped form from a substantially flat state by inflowing the air thereto. The sole support portion 378 has an intermediate mounting surface 384 in an intermediate region in a width direction thereof to allow the air cells 379 and the vibrator to be mounted thereon. Support surfaces 385 are provided on right and left sides outside the intermediate mounting surface 384 of the sole support portion 378 and configured to allow the sole of the foot of the user to be supported thereon. Mounting surfaces 386 are provided on outer end portions of an upper surface of the sole support portion 378 to be located on right and left sides outside the support surface 385 and configured to allow air cells 380 and 381 to be mounted thereon. The intermediate mounting surface 384, the support surfaces 385 and the mounting surfaces 386 are parallel to each other. The intermediate mounting surface 384 is formed lower than the support surface 385, and the mounting surface 386 is formed lower than the intermediate mounting surface 384. Thus, there are step portions between the intermediate mounting surface 384 and the support surface 385 and between the mounting surface 386 and the support surface 385.

The support surface 385 and the intermediate mounting surface 384 may form a flat surface or otherwise the support surface 385 and the mounting surface 386 may form a flat surface.

The pair of air cells 379 are mounted to a front half region of the intermediate mounting surface 384 to be arranged on the right and left sides. The air cells 379 are mounted to the intermediate mounting surface 384 in such a manner that their expandable ends are close to each other and their unexpandable ends are distant from each other.

The vibrators are mounted to the intermediate mounting surface 384 to be located behind the two air cells 379. Each vibrator is positioned to correspond to an arch of a foot of the user with a standard frame placed on the foot massaging unit 373.

The air cell 380 is mounted on a front half region of the mounting surface 386 and positioned laterally of the air cell 379. The air cell 380 has a main surface that is slightly smaller than the front half region of the mounting surface 386, and is placed such that its unexpandable end is oriented inward. A receiver plate 387 having a main surface of substantially the same shape as an upper surface of the air cell 380 is mounted on the upper surface of the air cell 380. Further, the air cell 382 is mounted on an upper surface of the receiver plate 387. Since the arrangement and configuration of the air cells 380 and 382 and the receiver plate 387 are identical to those of the rear air cell 135, the receiver plate 136, and the front air cell 137 described in the fourth embodiment, they will not be further described.

The air cell 381 is mounted on a rear half region of the mounting surface 386 and positioned laterally of the vibrator. The air cell 381 is smaller in size than the air cell 380, and is placed such that its unexpandable end is oriented inward as in the air cell 380.

Figure 68:
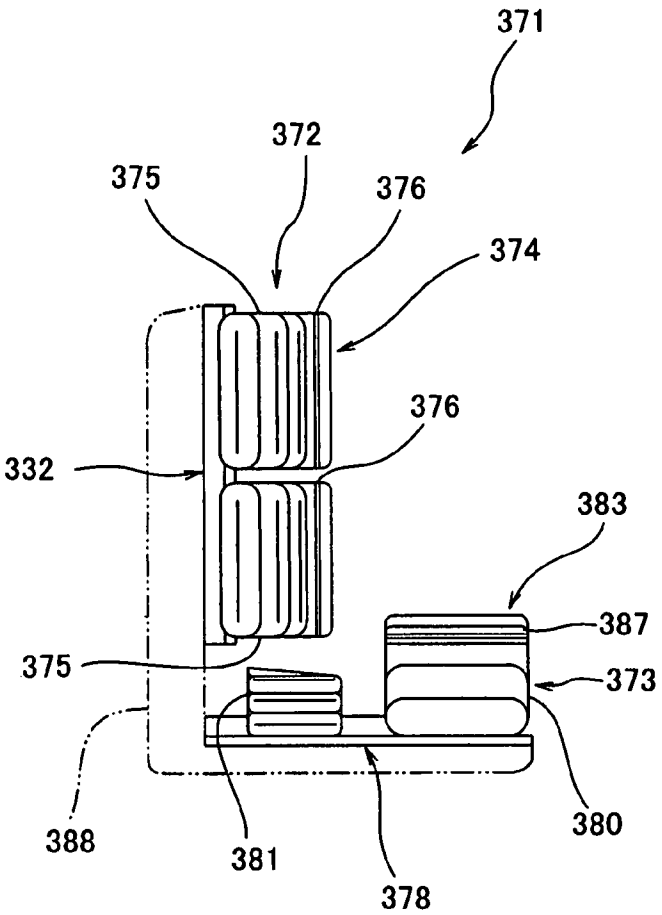
FIG. 68 is a side view showing a construction of the leg rest with the air cells in an expanded state according to the ninth embodiment of the present invention.
Figure 67:
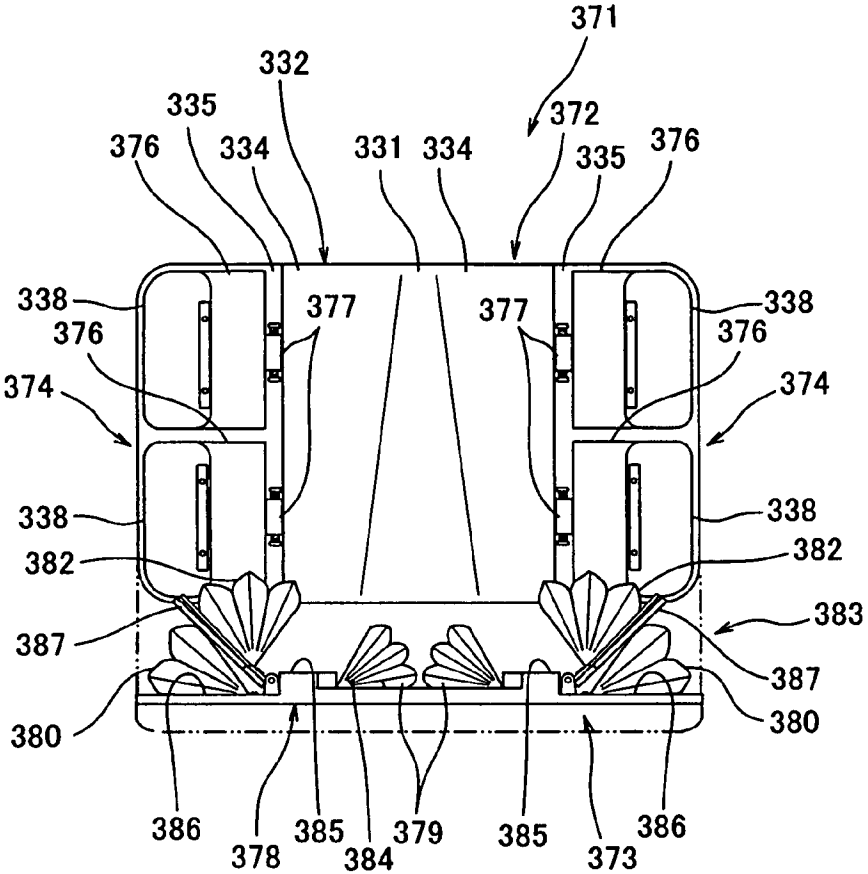
FIG. 67 is a front view showing a construction of the leg rest with the air cells in an expanded state according to the fourteenth embodiment of the present invention.

FIG. 67 is a front view showing a construction of the leg rest 371 with the air cells 379 to 382 expanded, and FIG. 68 is a side view thereof. With the sole of an adult user with a standard frame placed on the foot massaging unit 373, a part of the sole is placed on the support surface 385 and a remaining part is placed on the air cell 379 and the vibrator. Under this condition, by expanding the air cells 380 and 382, a top surface of the foot of the user is pressed from above by the air cell 382 as shown in FIGS. 67 and 68. Thus, the top surface of the foot of the user is massaged. In addition, when the air cells 379 and 381 or the vibrator operate with the foot of the user pressed from above, the foot of the user is inhibited from disengaging by the pressing force or the vibration.

By expanding the air cell 379, the tip portion of the foot is pressed over a range from a bottom region to an inner region. By expanding the air cell 381, ankle (malleolus) of the user is pressed. By operating the vibrator, vibrational stimulation is applied to the top surface of the foot of the user.

By repeating expansion and contraction of the air cells 379 to 382 independently or in synchronization with each other, or by operating the vibrator independently or in synchronization with these air cells 379 to 382, comfortable stimulation is applied to the user while the foot is massaged.

As shown by two-dotted line in FIGS. 65 to 68, the lower leg massaging unit 372 and the foot massaging unit 373 may be coupled by a frame 388 to configure the leg rest 371. In this case, the frame 388 may be provided with an expansion and contraction system to vary a distance between the lower leg massaging unit 372 and the foot massaging unit 373. Alternatively, instead of coupling the lower leg massaging unit 372 to the foot massaging unit 373 by the frame 388 or other element, only the lower leg massaging unit 372 may be pivotally mounted on the seat portion 102, and the foot massaging unit 373 may be placed on a floor surface under the lower leg massaging unit 372 during use.

The above mentioned configuration of the lower leg massaging unit 372 is merely exemplary, and may be configured as in the leg rest of any of the eleventh to thirteenth embodiments. In addition, the above mentioned configuration of the foot massaging unit 373 is merely exemplary, and the foot massaging unit 373 may alternatively be configured in such a manner that the air cells 380 and 382 and the receiver plate 387 may be omitted, and/or one or a plurality of the air cells 379 and 381 and the vibrator may be omitted, other air bags or vibrators may be provided separately from the air cells 379 to 382 and the vibrator, or otherwise one or a plurality of the air cells 379 to 382 and the vibrator may be placed at positions different from those mentioned above.

Since other configurations, functions, and effects of the chair-type massaging apparatus of the fourteenth embodiment are identical to those of the chair-type massaging apparatus 301 of the eleventh embodiment, the same components are identified by the same reference numerals and their configurations, functions, and effects will not be further described.

As in the fourth embodiment, the number and size of the rear air cells 375, the receiver plates 376 and the front air cells 338 are not intended to be limited to those illustrated in the fourteenth embodiment. Also, the rear air cell 375, the receiver plate 376, and the front air cell 338 need not be superimposed with the receiver plate 376 interposed between them. For example, each of the rear air cell 375 and the front air cell 338 may include only one air bag or may be superimposed without the receiver plate 376. Furthermore, they may include three or more air bags superimposed.

Embodiment 15

Figure 69:
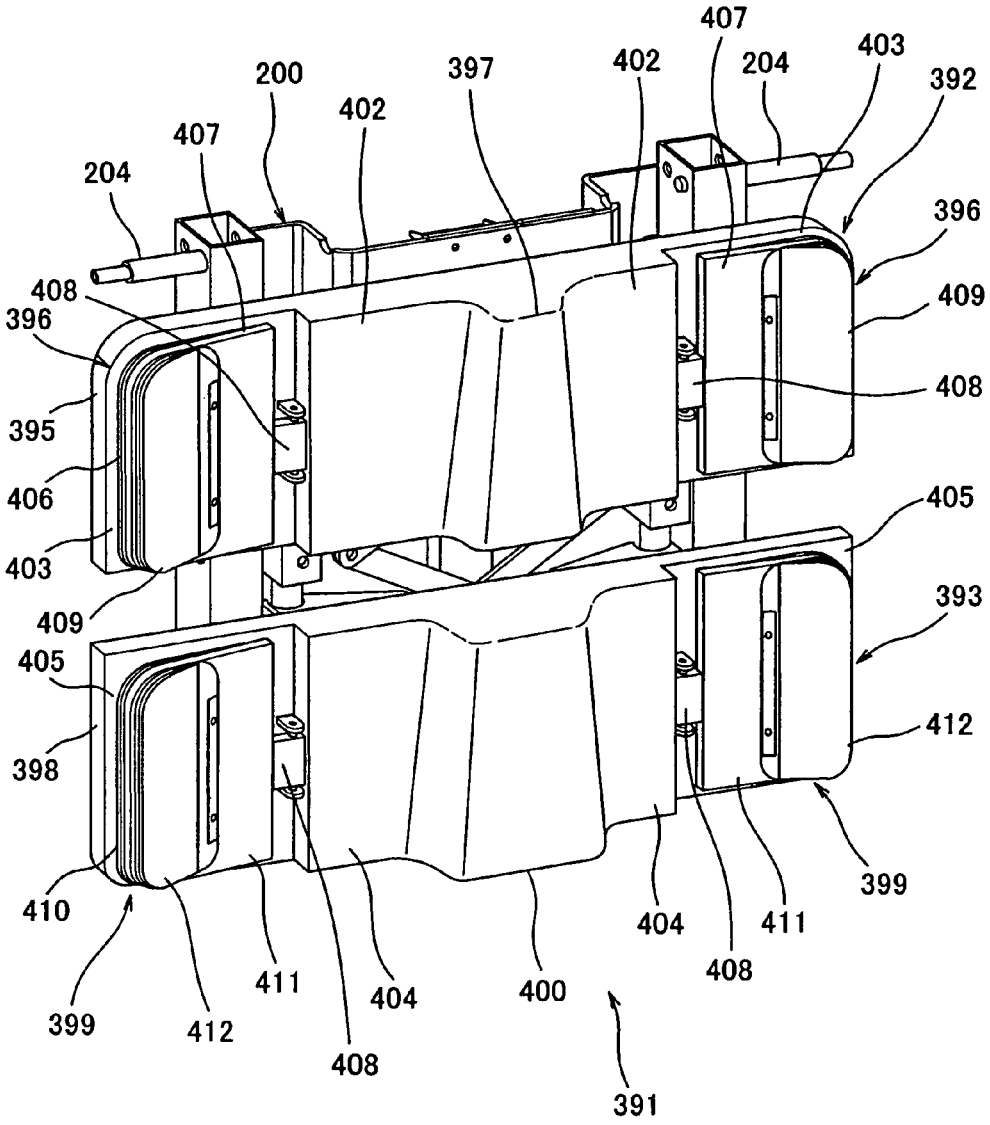
FIG. 69 is a perspective view showing a construction of a leg rest included in a chair-type massaging apparatus according to a fifteenth embodiment of the present invention.

FIG. 69 is a perspective view showing a construction of a chair-type massaging apparatus according to a fifteenth embodiment of the present invention. As described below, for the simplicity of explanation, a leg rest 391 is illustrated as extended substantially downward from a front end of a seat surface 102*b*, except for a case specifically described.

The leg rest 391 of the fifteenth embodiment mainly includes an upper unit 392, a lower unit 393, and an expansion and contraction system (distance changing device) 200. The upper unit 392 includes an upper support portion 395, massaging portions 396, and a support protrusion 397. The lower unit 393 mainly includes lower support portion 398, massaging portions 399 and a support protrusion 400. A support portion of the present invention is constructed of the upper support portion 395 and the lower support portion 398.

The upper unit 392 is positioned in front of and under the seat surface 102*b* of the seat portion 102, and the lower unit 393 is positioned under the upper unit 392. The upper unit 392 and the lower unit 393 are mounted to be arranged in the vertical direction on a front side of the expansion and contraction system 200 mounted to a front side of an upper portion of the seat portion 102 to be rotatable around a pivot 204. In other words, as in the configuration in which the lower leg massaging unit 372 of the fourteenth embodiment is divided in two in the vertical direction, the upper unit 392 and the lower unit 393 are arranged in the vertical direction such that they move toward and away from each other.

The upper support portion 395 of the upper unit 392 is of a substantially plate shape. The upper support portion 395 is structured such that the support protrusion 397 protrudes forward from a substantially intermediate region in the width direction thereof. Support surfaces 402 are provided on right and left sides outside the support protrusion 397 of the upper support portion 395 and configured to allow the right and left calves of the legs of the user to be supported thereon. Mounting surfaces 403 are provided outside the support surfaces 402 and configured to allow the massaging portion 396 to be mounted thereon. The support surface 402 and the mounting surface 403 are parallel to each other, and the mounting surface 403 is formed lower than the support surface 402. Thus, there is a step between the mounting surface 403 and the support surface 402.

Alternatively, the mounting surfaces 403, 405 and the respective support surface 402, 404 may form respective flat surfaces.

A rear air cell 406 is mounted to each of the right and left mounting surfaces 403. The rear air cell 406 expands in fan-shaped form from a substantially flat state by inflowing air thereto as in the rear air cell 135 and the front air cell 137 described in the fourth embodiment. The rear air cell 406 has a main surface portion which is slightly smaller than the mounting surface 403, and is fixed on the mounting surface 403 as in the rear air cell 135 of the fourth embodiment in such a manner that its unexpandable end is oriented inward, i.e., toward the support surface 402, and its expandable end is oriented outward.

The receiver plate 407 is mounted in front of the rear air cell 406. The receiver plate 407 has a substantially rectangular plate shape having an area slightly larger than that of a main surface portion of the rear air cell 406, and is mounted in front of the rear air cell 406 to entirely cover the rear air cell 406. The receiver plate 407 is mounted on the mounting surface 403 by a hinge 408 as in the receiver plate 136 of the fourth embodiment, which will not be further described. As in the receiver plate 136 of the fourth embodiment, the receiver plate 407 and a receiver plate 411 described later may be made of a relatively hard material such as metal, or a relatively flexible material such as synthetic resin.

A front air cell 409 is mounted to a front surface of the receiver plate 407. A main surface portion of the front air cell 409 is of a substantially rectangular shape having an area substantially equal to that of an outer half region of the main surface of the receiver plate 407. The front air cell 409 is mounted to a substantially outer half region of the front surface of the receiver plat 407 as in the front air cell 137 of the fourth embodiment in such a manner that its unexpandable end is oriented inward and its expandable end is oriented outward.

In the manner described above, the massaging portion 396 is constructed of the rear air cell 406, the receiver plate 407, and the front air cell 409.

The support protrusion 397 is formed to have a width between both lateral ends thereof that increases in a downward direction. While the support protrusion 397 is formed to have a width that increases in a downward direction, it may alternatively be structured such that the both lateral ends are parallel to each other to form a substantially rectangular shape in a front view.

The lower unit 393 mainly includes a lower support portion 398, and a massaging portion 399 that is mounted to the mounting surface 405 of the lower support portion 398 and is comprised of a rear air cell 410, a receiver plate 411, and a front air cell 412. A support protrusion 400 protrudes forward from a substantially intermediate region in the width direction of the lower support portion 398 to have a width that increases in a downward direction. The support protrusion 400 is configured in such a manner that the width thereof is larger than that of the support protrusion 397 and increases in a downward direction, and tilting angles of the lateral ends of the support protrusion 400 with respect to the longitudinal direction are equal to those of the support protrusion 397 so that the ends of the protrusions 397 and 400 which are located on the same side extend in a straight line shape when the upper unit 392 and the lower unit 393 are moved close to each other. Support surfaces 404 are provided on right and left sides outside the support protrusion 400 of the lower support portion 398 and configured to allow the right and left calves of the user to be supported thereon. Since the other configuration of the lower unit 393 is identical to that of the upper unit 392, it will not be further described.

The above constructed upper unit 392 and lower unit 393 are mounted to the expansion and contraction system 200 described in the tenth embodiment in such a manner that they are relatively movable toward and away from each other. Since the configurations, functions, and effects of the expansion and contraction system 200 are identical to those described in the tenth embodiment, the same reference numerals are used to designate the same or corresponding parts, which will not be further described.

With the above mentioned configuration, the leg rest 391 is pivotable forward and backward around the pivot 204, and is contractable by changing the distance between the upper unit 392 and the lower unit 393. By thus expanding and contracting the leg rest 391, the upper unit 392 is moved to a position where the upper unit 392 supports the upper portion of the lower leg of the user and the lower unit 393 is moved to a position where the lower unit 393 supports the lower portion of the lower leg, independent of the specific frame of the user.

Since the support protrusions 397 and 400 are configured to have the widths that increase downward, they contact a longitudinally larger region of the lower legs of the user. As a result, the support protrusions 397 and 400 contacting only a longitudinal part of the calves of the user is avoided.

Since other configurations, functions, and effects of the chair-type massaging apparatus of the fifteenth embodiment are identical to those of the chair-type massaging apparatus 301 of the eleventh embodiment, the same components are identified by the same reference numerals and their configurations, functions, and effects will not be further described.

The configurations of the upper unit 392 and the lower unit 393 are not intended to be limited to the above, and the leg rest of any of the eleventh to fourteenth embodiments may be divided in two in the vertical direction. As in the fourth embodiment, the number and size of the rear air cells 406, 410, the receiver plates 407, 411 and the front air cells 409, 412 are not intended to be limited to those illustrated in the fifteenth embodiment. Also, the rear air cells 406, 410 and the front air cells 409, 412 need not be superimposed with the respective receiver plate 407, 411 interposed between them. For example, each of the rear air cells 406, 410 and the front air cells 409, 412 may include only one air bag or may be superimposed without a corresponding receiver plate 407, 411. Furthermore, they may include three or more air bags superimposed.

Embodiment 16

Figure 70:
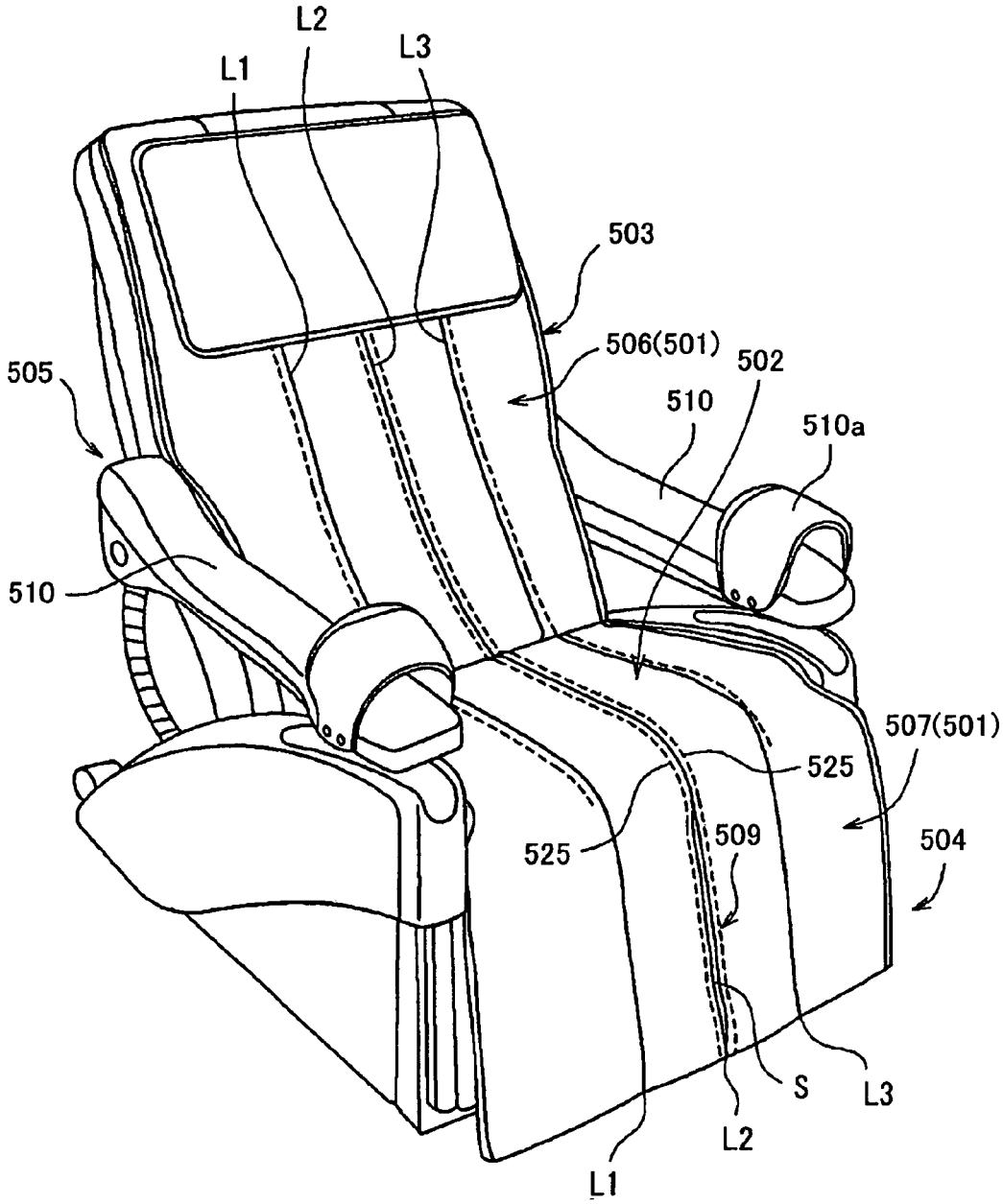
FIG. 70 is a perspective view of a chair-type massaging apparatus with a cover according to a sixteenth embodiment of the present invention attached thereto.

FIG. 70 is a perspective view of a massaging apparatus with a massaging apparatus cover 501 attached thereover according to a sixteenth embodiment of the present invention. The massaging apparatus comprises a chair body 505 including a seat portion 502 in which the user is seated, a back rest 503 on which a back of the user is supported, a leg rest 504 on which legs are placed, and right and left arm rests 510.

The cover 501 is attached over the chair-type massaging apparatus. The cover 501 includes a back rest cover 506 that covers the back rest 503, and a lower cover 507 that is separable from the back rest cover 506, and covers the seat portion 502 and the leg rest 504. Alternatively, a separate leg rest cover may be configured to cover only the leg rest 504, instead of an integral cover that covers the seat portion 502 and the leg rest 504.

A mounted state of the cover 501 will be described. The back rest cover 506 covers substantially the entire surface of the back rest 503 on which the body of the user is placed, and its upper end portion and both side end portions are folded backward with respect to the back rest 503. The back rest cover 506 is fixed to a back surface of the back rest 503 by fasteners at the folded end portions. A region of the lower cover 507 that covers the seat portion 502 is fixed to the seat portion 502 by tape fasteners at a peripheral region of the seat portion 502.

A region of the lower cover 507 that covers the leg rest 504 functions as the cover for the leg rest 504. As shown in the cross-sectional view of FIG. 71, right and left end portions 530 are folded back and located on the rear side. Upper and lower peripheral regions of the both end portions 530 and upper and lower peripheral regions of a front portion of an intermediate foldable portion 509 which are opposed to the upper and lower peripheral regions of the both end portions 530 are stitched up together. Thereby, pocket-shaped bag portions 532 are formed on right and left end portions of the intermediate foldable portion 509 (see FIG. 71). Each of the right and left bag portions 532 has an opening that opens inward in the rightward and leftward direction on the rear surface side of the intermediate foldable portion 509. A protrusible plate 513, an upper air cell 515, a receiver plate 522, and a pressing element 523 are inserted into the bag portion 532 through the opening. The protrusible plate 513 is able to rise up inward in the rightward and leftward direction as described later, and in this state, the above elements are inserted into the bag portion 532. After the insertion, by lowering and retracting the protrusible plate 513 outward in the rightward and leftward direction, each of the end portions 530 is sandwiched between the lower air cell 514 and the protrusible plate 513. In this manner, the region of the lower cover 507 that covers the leg rest 504 is attached to the leg rest 504 without using means such as the fasteners. Since the bag portion 532 accommodates the protrusible plate 513 and other elements, the lower cover 507 is configured not to disengage from the leg rest 504. Thereby, a leg rest cover that is easily removably attachable is achieved.

The cover 501 is configured such that the back rest cover 506 and the lower cover 507 are respectively removable.

An arch-shaped hand accommodating portion 510*a* is provided on a front portion of each of the arm rests 510 on right and left sides of the chair-type massaging apparatus to allow a palm or other portion of a hand to be inserted into the accommodating portion 510*a*. A massaging system such as air cells (not shown) is provided on an inner surface of the hand accommodating portion 510*a* to allow the hand to be massaged.

Figure 78:
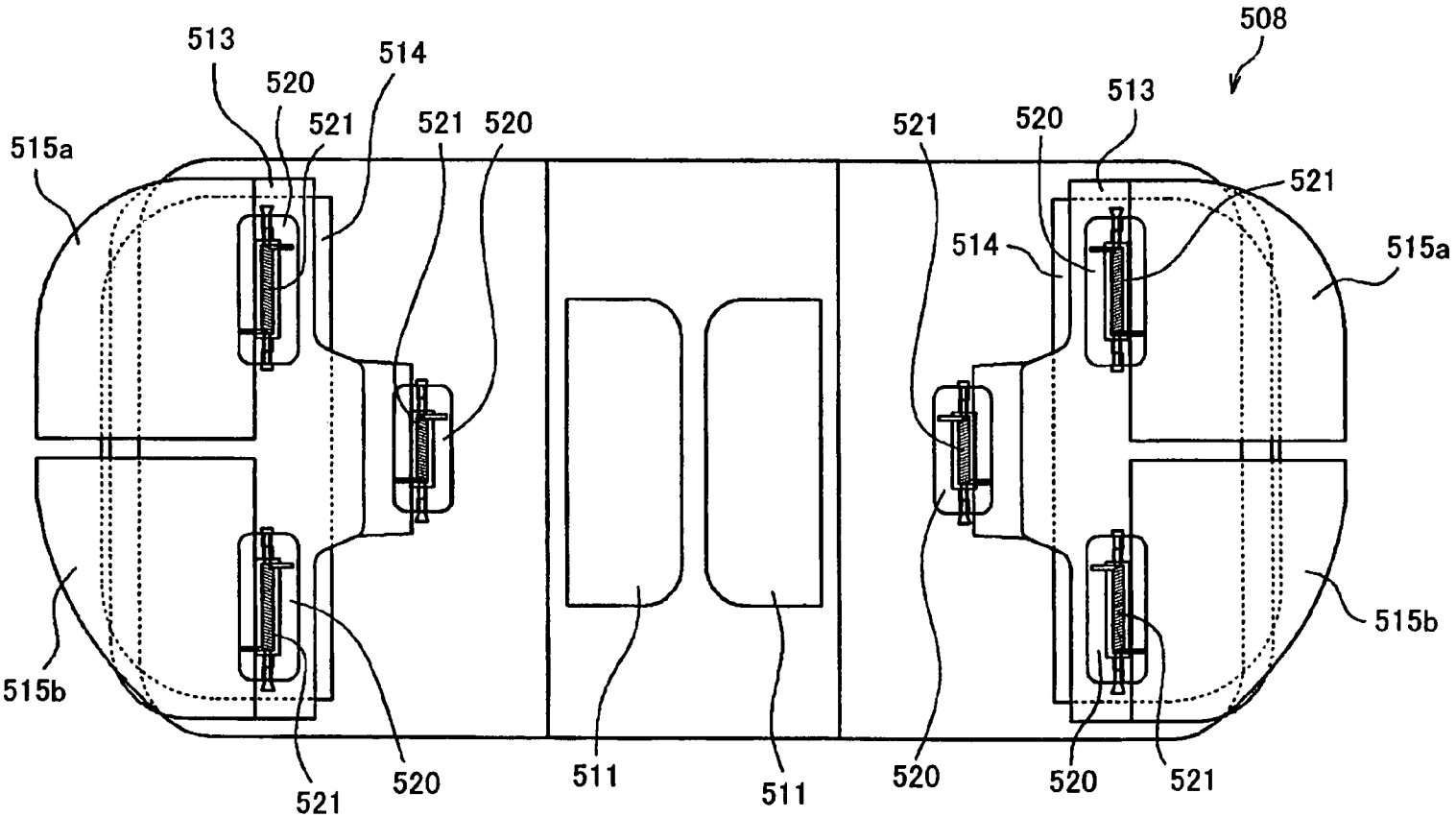
FIG. 78 is a front view of the leg massaging system.
Figure 79:
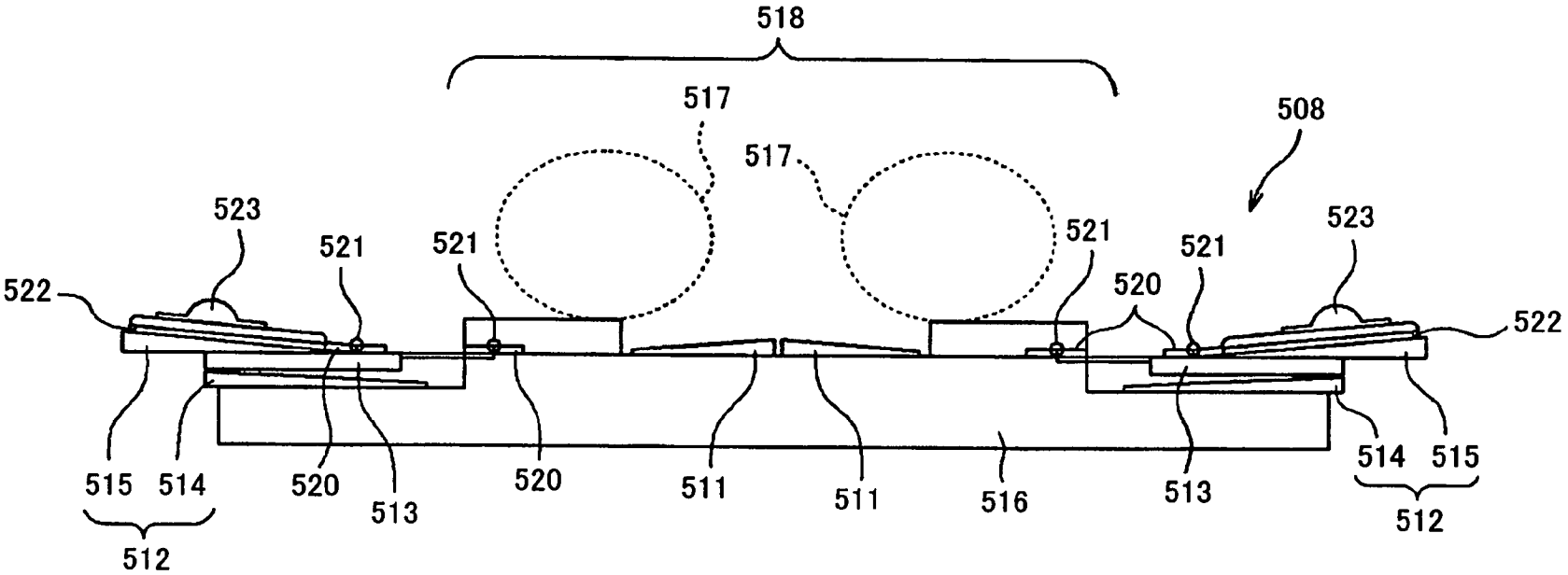
FIG. 79 is a plan view of the leg massaging system in a retracted state.
Figure 80:
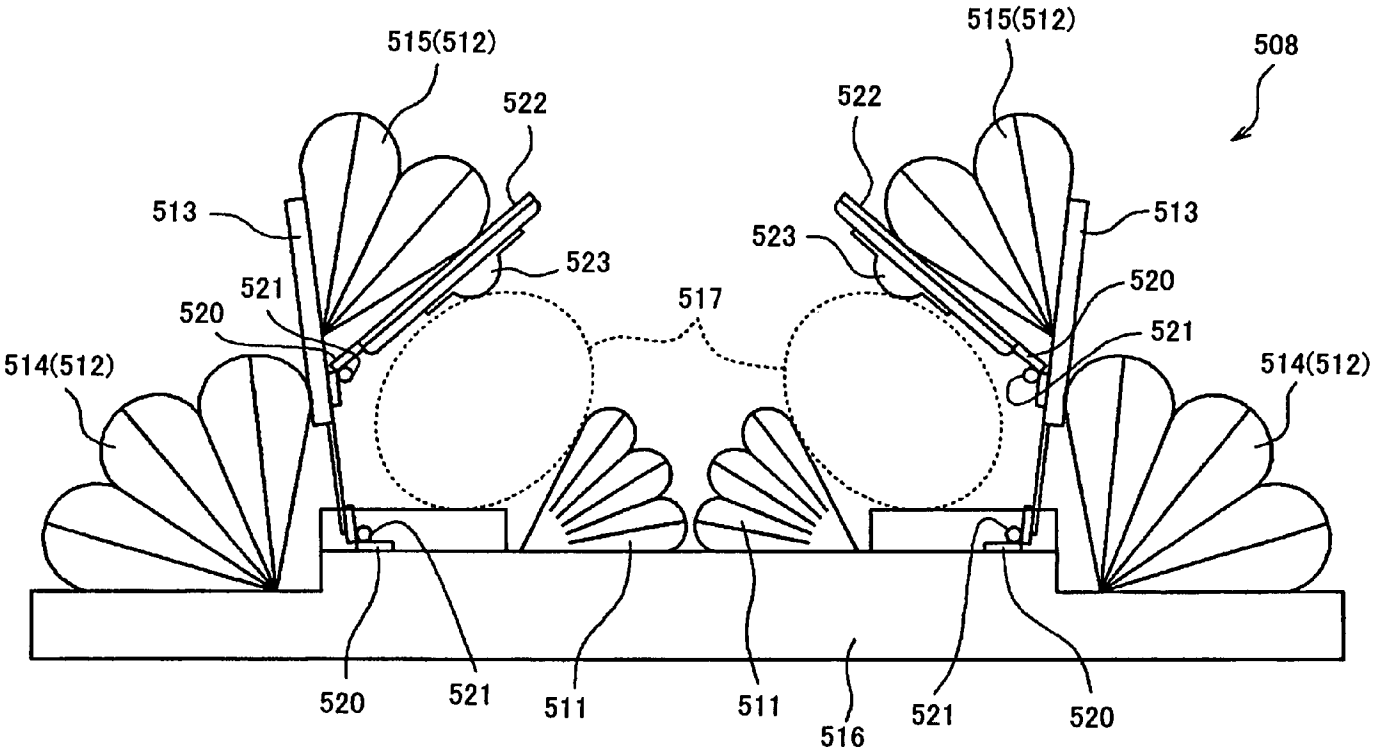
FIG. 80 is a plan view of the leg massaging system in a protruded state.

As shown in FIG. 79, the leg rest 504 of the chair body 505 includes a support surface 518 on which the right and left legs of the user are supported with the user seated on the chair body 505, and a protrusible and retractable system 508 configured to protrude and retract toward the legs within the support surface 518. FIG. 79 is a plan view of the protrusible and retractable system 508, in which the air cells are in an unexpanded (retracted) state and FIG. 80 is a plan view of the protrusible and retractable system 508, in which all the air cells are in expanded (protruded) state. FIG. 78 is a front view of the protrusible and retractable system 508.

As shown in FIGS. 79 and 80, the protrusible and retractable system 508 includes intermediate air cells 511 located at an intermediate region in the rightward and leftward direction of the protrusible and retractable system 508, and right and left air cells 512 located at both peripheral regions in the rightward and leftward direction. Each of the right and left air cells 512 includes the lower air cell 514 placed under (on a rear surface side of) the protrusible plate 513 and the upper air cell 515 placed on (on a front surface side) of the protrusible plate 513. The legs of the user are massaged with each of the legs placed between the intermediate air cell 511 and the air cells 512. In FIGS. 79 and 80, the contours of the right and left legs 517 are indicated by broken lines.

As shown in FIGS. 78 to 80, a hinge 520 is mounted on an inner side in the rightward and leftward direction of the protrusible plate 513, and the protrusible plate 513 is mounted to a base 516 by the hinge 520. The hinge 520 enables the protrusible plate 513 to rise up inward in the rightward and leftward direction. A torsion spring 521 is mounted to the hinge 520. The torsion spring 521 causes the protrusible plate 513 to be biased outward in the rightward and leftward direction. Therefore, in a state in which no external force is applied by the air cells, the protrusible plates 513 retracts as shown in FIG. 79.

A receiver plate 522 is mounted on an upper side (front side) of the protrusible plate 513 by a hinge 520. The hinge 520 is positioned on inner side in the rightward and leftward direction of the receiver plate 522. Thereby, the receiver plate 522 is able to fall inward in the rightward and leftward direction. A torsion spring 521 causes the protrusible plate 513 to be biased outward in the rightward and leftward direction. Therefore, in a state in which no external force is applied by the air cells, the protrusible plate 513 retracts as shown in FIG. 79. As should be appreciated, the support surface 518 on which the legs of the user are supported, and the protrusible and retractable system 508 are substantially flat in a retracted state.

All the air cells 511, 514, and 515 have a fan-shaped form in cross-section and expand in a fan-shaped form as shown in FIG. 80.

As shown in a front view of FIG. 78, the two intermediate air cells 511 have a substantially rectangular shape that is vertically elongated as seen in a plan view, and are placed to be symmetric in the rightward and leftward direction. As shown in FIG. 80, the intermediate air cells 511 are placed such that centers of the fan-shaped forms in cross-section are oriented outward in the rightward and leftward direction.

With the intermediate air cells 511 expanded, they protrude outward in the rightward and leftward direction.

Right and left lower air cells 514 are each placed between each of right and left peripheral regions of the base 516 and the protrusible plate 513, and are placed in such a manner that centers of the fan-shaped forms are oriented inward as shown in FIG. 80. When the lower air cells 514 expand, they protrude inward in the rightward and leftward direction so as to press the protrusible plates 513 from rearward, causing the protrusible plate 513 to rise up inward in the rightward and leftward direction. When the upper air cell 515 further expands, the upper air cell 515 presses the receiver plate 522 from rearward, causing the receiver plates 522 to fall inward in the rightward and leftward direction. A pressing element 523 that protrudes in a substantially hemispherical shape is mounted on a front side of the receiver plate 522. Right and left legs 517 are each sandwiched between the pressing element 523 and the intermediate air cell 511 and massaged. Since the center of the fan-shaped form of the upper air cell 515 is oriented toward the hinge 520 by which the receiver plate 522 is mounted, the receiver plate 522 is pressed efficiently by the expansion of the upper air cell 515 in fan-shaped form.

As shown in FIG. 78, each upper air cell 515 is divided in two in the vertical direction to include a calf air cell 515*a* and an ankle air cell 515*b*, which are independently protrusible and retractable. In the front view of FIG. 78, the receiver plates 522, the pressing elements 523, and other elements are appropriately omitted.

Figure 71:
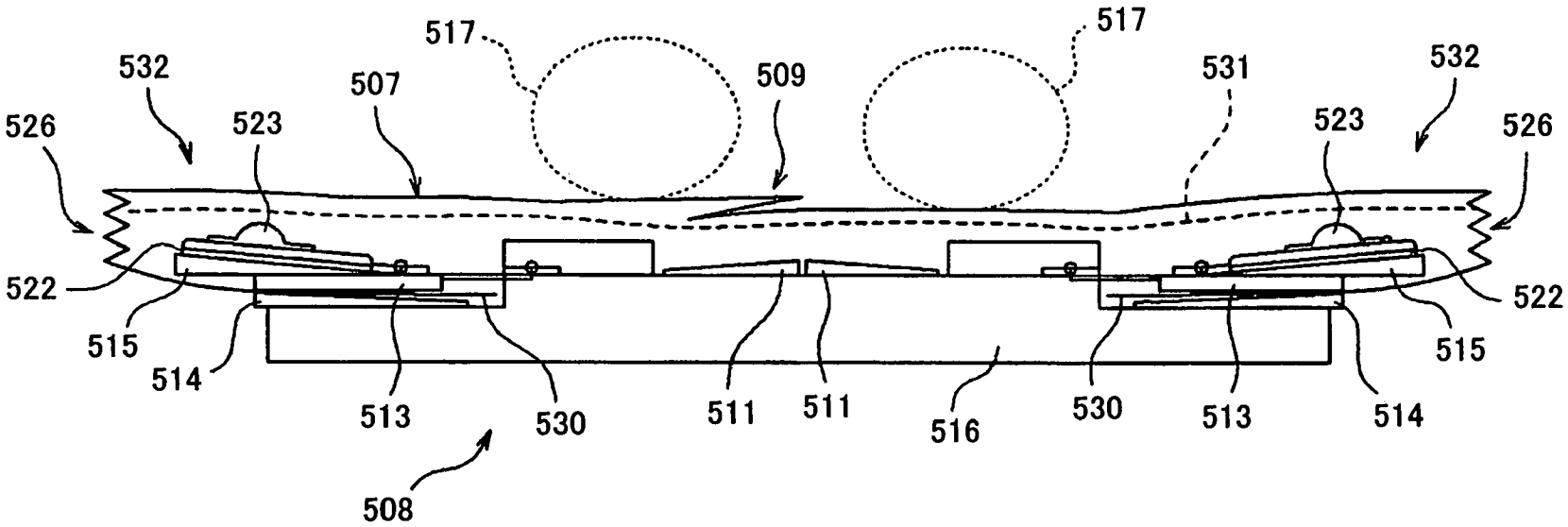
FIG. 71 is a cross-sectional view showing a state in which the cover of the sixteenth embodiment of the present invention covers a leg massaging system.

As described above, the leg rest 504 of the chair body 505 is provided with the protrusible and retractable system 508 which is covered with the lower cover 507 of the cover 501. FIG. 71 is a cross-sectional view showing a state in which the lower cover 507 covers the protrusible and retractable system 508. As shown in FIG. 71, the lower cover 507 includes an intermediate foldable portion 509 in an intermediate region in the rightward and leftward direction, which is expandable according to protrusion (expansion) of the intermediate air cells 511.

Figure 72:
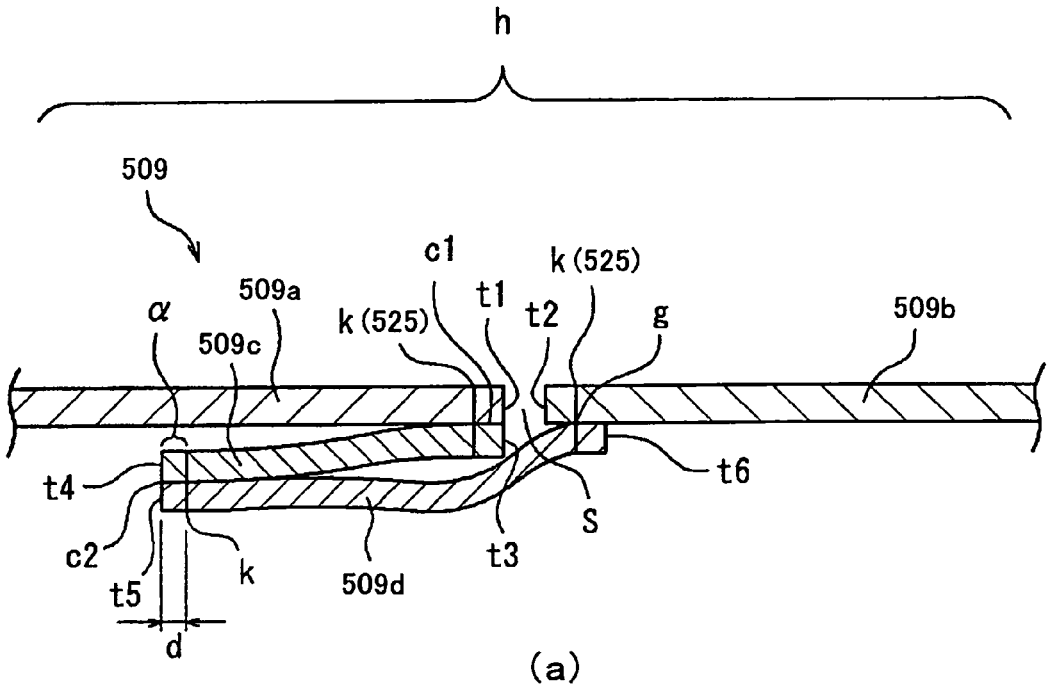
FIG. 72(*a*) is an enlarged cross-sectional view of a foldable portion of the cover according to the sixteenth embodiment of the present invention and FIG. 72(*b*) is an enlarged cross-sectional view of an alternative.
Figure 72:
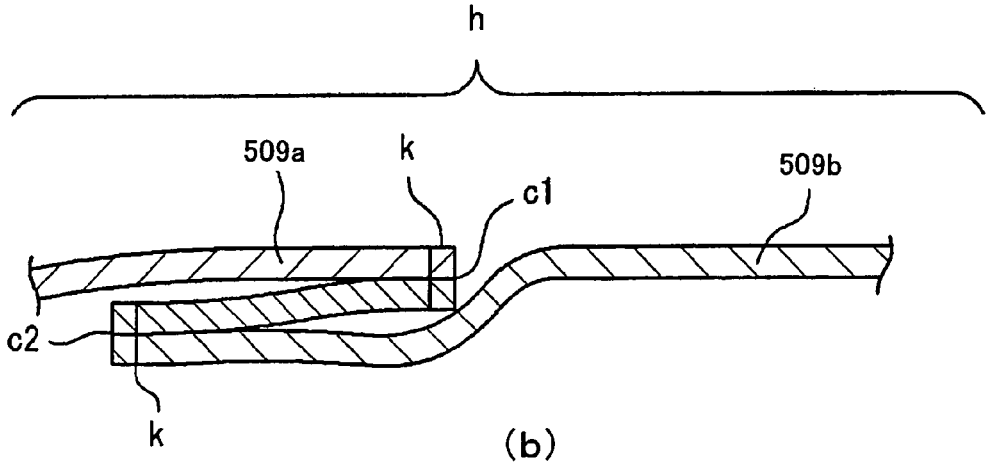

FIG. 72(*a*) is an enlarged cross-sectional view of the intermediate foldable portion 509 in a folded state with the protrusible and retractable system 508 retracted. As shown in FIG. 72(*a*), the intermediate foldable portion 509 includes first and second surface portions 509*a* and 509*b* that form a surface portion of the lower cover 507, a first superimposed portion 509*c* placed on the rear side of the first surface portion 509*a*, and a second superimposed portion 509*d* placed on the rear side of the first superimposed portion 509*c*. An inner end t1 in the rightward and leftward direction of the first front surface portion 509*a* and an inner end t2 in the rightward and leftward direction of the second front surface portion 509*b* are butted against each other with a slit (gap) S between them. As shown in FIG. 70, the slit S extends in the vertical direction between the right and left legs. With the intermediate foldable portion 509 folded, the first superimposed portion 509*c* and the second superimposed portion 509*d* are covered by the first front surface portion 509*a* and the second front surface portion 509*b* and are therefore invisible from outside. (It shall be appreciated that only a part of the second superimposed portion 509*d* is visible through the slit S.)

For improved external appearance, the width of the slit S is made as small as possible, and is desirably substantially zero during design of the dimensions of the lower cover 507.

Figure 73:
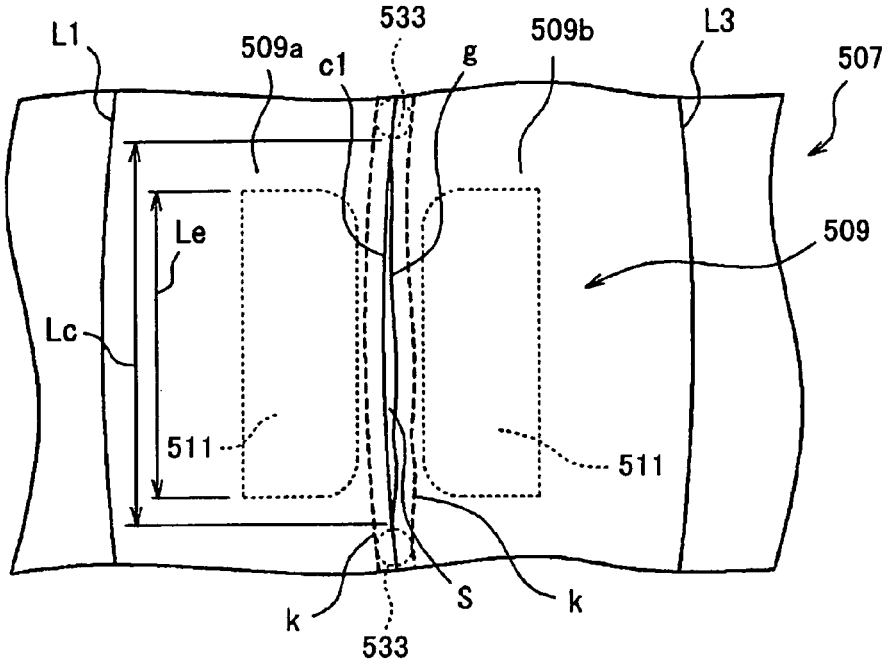
FIG. 73(*a*) is a view showing an external appearance of a state in which a foldable portion of the cover of the sixteenth embodiment is folded, and FIG. 73(*b*) is a view showing an external appearance of an expanded state of the foldable portion.
Figure 73:
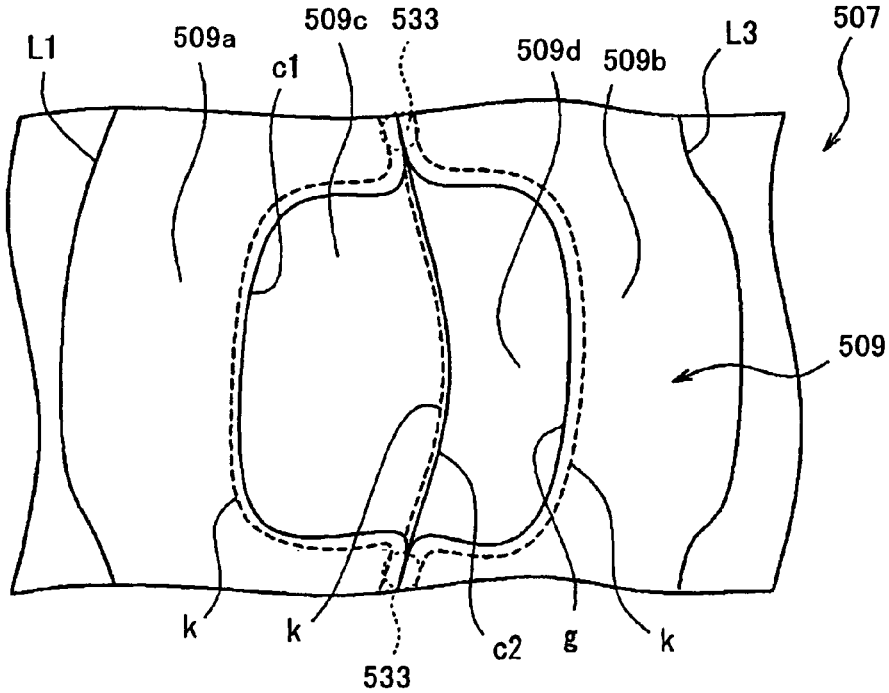

When the intermediate air cells 511 protrusively expand, the intermediate foldable portion 509 expands in the rightward and leftward direction so as to increase an area of the cover surface. FIGS. 73(*a*) and 73(*b*) are views showing how the intermediate foldable portion 509 expands. As shown in FIG. 73(*a*), with the intermediate foldable portion 509 folded, the first and second superimposed portions 509*c* and 509*d* are invisible from outside except for a region corresponding to the slit S having a small gap.

When the intermediate air cells 511 protrusively expand, the intermediate foldable portion 509 expands, causing the first and second superimposed portions 509*c* and 509*d* to be exposed on the front side of the cover. Thereby, the region of the lower cover 507 that covers the leg rest 504 extends in the rightward and leftward direction so as to increase the area of the cover surface.

Thus, since the cover extends according to expansion of the intermediate foldable portion 509, the cover need not be made of elastic materials but may be made of non-elastic material such as artificial leather or genuine leather. If the cover is made of elastic material, expansion and contraction of the elastic material is less, because the cover extends according to the expansion of the foldable portion. Therefore, even when the cover is made of the elastic material, durability improves and external appearance is maintained. Further, elastic material is typically more expensive than non-elastic materials such as artificial leather, and thus a low cost is achieved by using the non-elastic material. In view of this, the cover is suitably made of artificial leather.

As shown in cross-sectional view of FIG. 72(*a*), the four cover elements, i.e., the first front surface portion 509*a*, the second front surface portion 509*b*, the first superimposed portion 509*c*, and the second superimposed portion 509*d*, which form the intermediate foldable portion 509, are separate from each other within the intermediate foldable portion 509. The integral lower cover 507 is formed by coupling end portions of the separate cover elements suitably by stitching them up together. Specifically, a region near one end t3 of the first superimposed portion 509*c* and a region near the inner end t1 of the first front surface portion 509*a* are stitched up together to form a first coupled portion c1. A region near an opposite end t4 of the first superimposed portion 509*c* and a region near one end t5 of the second superimposed portion 509*d* are stitched up together to form a second coupled portion c2. Furthermore, a region near an opposite end t6 of the second superimposed portion 509*d* and a region near an inner end t2 in the rightward and leftward direction of the second front surface portion 509*b* are stitched up together to form a joint g.

In this embodiment and embodiments below, stitching is employed as a coupling method of the coupled portions and the joints, but is merely exemplary. It shall be appreciated that when the cover elements are stitchable, stitching is desirable as the coupling method because of its high coupling strength and low cost.

The first and second coupled portions c1 and c2 and the joint g have different configurations. Specifically, in the cross-sectional view of FIG. 72(*a*), the two elements to be stitched up together extend from the coupled portions c1 and c2 in the same direction, while two elements to be stitched up together extend from the joint g in opposite directions. In such a configuration, the first superimposed portions 509*c* and the second superimposed portion 509*d* are folded toward the same side (left side in FIG. 72(*a*)), the first superimposed portion 509*c* is placed on the rear side of the first front surface portion 509*a*, and the second superimposed portion 509*d* is placed on the rear side of the first superimposed portion 509*c*.

In the folded state, the first front surface portion 509*a*, the first superimposed portion 509*c*, the second superimposed portion 509*d*, and the second front surface portion 509*b* are all substantially parallel to a cover surface h. As used herein, the term "cover surface" refers to a region of the intermediate foldable portion 509 that forms an outer surface of the cover, and in the embodiment of FIG. 72(*a*), an outer surface of the first front surface portion 509*a* and an outer surface of the second front surface portion 509*b* in the intermediate foldable portion 509 form the cover surface h.

FIG. 72(*b*) shows an alternative of the intermediate foldable portion 509. Here, the second front surface portion 509*b* which is integral, including the second front surface portion 509*b* and the second superimposed portion 509*d*, which are separate in the embodiment of FIG. 72(*a*), is employed, thus omitting the joint g of the embodiment of FIG. 72(*a*). In this case, the coupled portion or the joint which is visible from outside in the folded state is only the first joint c1, and thereby, external appearance advantageously improves because of the absence of the slit S.

In the embodiment of FIG. 72(*a*), the first coupled portion c1 and the second coupled portion c2 are provided and the cover elements 509*a*, 509*c*, and 509*d* which are folded substantially in parallel and superimposed are coupled in the thickness direction at the regions in the vicinity of the coupled portions c1 and c2. Since the coupled state of the superimposed cover elements causes a restricting force, the foldable portion which expands by protrusion of the protrusible and retractable system easily returns to its folded state when the protrusible and retractable system retracts. The detail of effects caused by the restricting force will be described later.

In the structure in which the joint g is provided as shown in FIG. 72(*a*), since the second front surface portion 509*b* and the second superimposed portion 509*d* which are superimposed in parallel in the region k near the joint g are coupled to each other in the thickness direction as described above, rigidity in the region superimposed in parallel increases. As a result, after expanding, the foldable portion easily returns to its folded state. Since the joint g is provided along with the first coupled portion c1, the first front surface portion 509*a* and the second front surface portion 509*b* are butted against each other with the slit S interposed between them, and tend to be flush with each other, decreasing a step in the cover surface in the folded state. As a result, external appearance improves and the step, which may be an obstruction to the user, is minimized.

By providing the joint g, external design appearance advantageously improves. In the perspective view of FIG. 70, stitch lines 525 are provided to extend on both sides of the slit S in the intermediate foldable portion 509. These two stitch lines 525 extend from the back rest 503, through the seat portion 502, through both sides of the intermediate foldable portion 509, and to a lowermost portion of the leg rest 504, along with a center line L2 in the rightward and leftward direction.

One of the stitch lines 525 on both sides of the intermediate foldable portion 509 is a stitch line at the joint g in FIG. 72 between the second front surface portion 509*b* and the second superimposed portion 509*d* of FIG. 72. By stitching the cover elements up in the vicinity of the joint g, the two stitch lines 525 continuously extend from a region of the lower cover 507 which covers the seat portion to a lowermost portion of the leg rest that is covered. As result, external design appearance improves. As shown in FIG. 72(*b*), without the joint g, the stitch line, along which the second front surface portion 509*b* and the second superimposed portion 509*d* in FIG. 72(*a*) are stitched up together, is omitted. Therefore, only one stitch line 525, along which the first front surface portion 509*a* and the first superimposed portion 509*c* are stitched up together, extends along the slit S in the intermediate foldable portion 509, rather than the stitch lines 525 extending on both sides of the slit S in FIG. 70. Nonetheless, the stitch lines provided on right and left sides of the slit S by providing the joint g, improve external design appearance. In this manner, the respective cover elements of the foldable portion 509 are coupled by stitching and by providing the stitch line continuously with another stitch line. As a result, external design appearance improves.

Furthermore, since the second front surface portion 509*b* and the second superimposed portion 509*d* are separate rather than integral, the first front surface portion 509*a* and the second front surface portion 509*b* are equal in size, and hence the same cut pattern may be advantageously used.

As shown by a broken line of FIG. 71, a rear cover 531 is provided between the lower cover 507 and the support surface 518 of the leg rest 504, and the rear cover 531 and the lower cover 507 are stitched up together. The rear cover 531 is made of elastic material, for example a material formed into a wet suit. The rear cover 531 allows the intermediate foldable portion 509 to return to its folded state more easily. Furthermore, since the protrusible and retractable system 508 does not directly contact the lower cover 507, events in which a strong stress is applied to the lower cover 507 due to engagement of the lower cover 507 with the protrusible and retractable system 508 do not take place when the protrusible and retractable system 508 is protruding. As a result, durability of the lower cover 507 improves.

The stitching position in the region k near the coupled portion c1 or c2 is desirably set such that a distance d (see FIG. 72(*a*)) between the end position of the two elements to be stitched together and the stitching position is between 3 to 7 mm. If the distance d is too small, then a superimposed and stitched region α decreases, causing the foldable portion 509 to be less likely to return to is folded state. Conversely, if the distance d is too large, then the cover elements are wasted.

The material of the cover elements is not specifically limited, but the cover elements having bending rigidity with a predetermined degree or more is desirably used to enable the foldable portion to easily return to its folded state. Nonetheless, if the bending rigidity is too high, then the foldable portion is difficult to expand, and therefore, leather (artificial leather or genuine leather) with a thickness of 0.4 mm to 1 mm, more preferably 0.5 mm to 0.75 mm, is used.

Since the intermediate foldable portion 509 is folded to extend in parallel with the cover surface h of the intermediate foldable portion 509 and the support surface 518 of the intermediate foldable portion 509 is substantially flat in retraction, the intermediate foldable portion 509 protrudes outward least and becomes substantially flat. Therefore, the user easily places legs 517 on the lower cover 507 without being disturbed by the intermediate foldable portion 509. Also, the lower cover 507 improves external appearance.

The protrusible and retractable system 508 covered by the lower cover 507 forms the support surface 518 (see FIG. 79) which is substantially flat in retraction, and the intermediate foldable portion 509 covers a part of the support surface 518. In this case, the intermediate foldable portion 509 is folded in parallel with the substantially flat support surface 518, and flatness of the support surface 518 is not substantially reduced by the intermediate foldable portion 509. Therefore, the intermediate foldable portion 509 of the lower cover 507 does not interfere with the legs 517 of the user placed on the support surface 518. In addition, the intermediate foldable portion 509 does not interfere with the leg rest 504 which is used as a simple leg rest. As described above, since the flatness of the substantially flat support surface 518 is not substantially reduced, its external appearance of the cover improves.

As shown in FIG. 70, three lines L1, L2, and L3 are provided on the cover 501 covering the chair body 505 to extend in the vertical direction from the back rest cover 506 to the lower cover 507 in order to improve external design appearance. The intermediate foldable portion 509 extends along a lower region of the center line L2 in the rightward and leftward direction, and the first coupled portion c1 and the joint g (see FIG. 72(*a*)) of the intermediate foldable portion 509 form the lower portion of the center line L2. The stitch lines 525 are positioned on right and left sides of the center line L2 to extend to the lowermost region of the lower cover 507.

As shown in FIG. 73, in regions 533 near the intermediate foldable portion 509 which are positioned on both sides of an extended line of a line including the coupled portion c1 of the intermediate foldable portion 509, the respective cover elements (first front surface portion 509*a*, the second front surface portion 509*b*, the first superimposed portion 509*c*, and the second superimposed portion 509*d*) are stitched up together so as not to expand. Thereby, expansion of the intermediate foldable portion 509 is restricted at both end positions in the direction of the line formed by the coupled portion. Therefore, the intermediate foldable portion 509 is restricted to be in the folded state, and easily returns to its folded state during retraction of the intermediate air cell 511. While in this embodiment, regions near the both ends in the direction of the line formed by the coupled portion of the foldable portion 509 are unexpandable, only one side in the direction of the line formed by the coupled portion may alternatively be expandable.

The positions of the unexpandable regions 533 of the intermediate foldable portion 509 are set in association with placement of the intermediate air cells 511. As shown in FIG. 73(*a*), a length Lc in the direction of the line formed by the coupled portion c1 forming the slit S is set larger than a length Le in the direction of the line formed by the coupled portion of the intermediate air cell 511 which is the protrusible and retractable system mounted in the vicinity of the intermediate foldable portion 509. Thereby, the intermediate air cell 511 is protrusible substantially without restriction by the unexpandable regions 533.

In this case, the intermediate air cell 511 which is the protrusible and retractable system is desirably placed at the center position in the direction of the line formed by the coupled portion of the intermediate foldable portion 509. In this case, since the distance between the intermediate air cell 511 and the unexpandable region (533) is equal on both sides of the intermediate air cells 511 and therefore a restricting force is applied evenly.

The leg rest 504 is vertically slidable according to the positions of the legs 517 of the user, and a vertical relative position of the lower cover 507 and the intermediate air cell 511 may be variable. In this case, it is desirable to set the length Lc larger than the length Le so that vertical both ends of the intermediate air cell 511 are inward (closer to the center in the vertical direction) relative to vertical both ends of the intermediate foldable portion 509 in a sliding range of the intermediate air cell 511.

As shown in FIG. 70, in this embodiment, the three lines L1, L2, and L3 extend. As shown in FIG. 71, a foldable portion is not formed in a region of the lower cover 507 that covers the leg rest 504, which corresponds to the lines L1 and L3. That is, the lines L1 and L3 located on right and left sides of the intermediate foldable portion 509 are typically provided to meet design requirements.

As shown in FIG. 71, the intermediate foldable portion 509 is positioned to avoid the right and left legs 517 of the body of the user, i.e., between the right and left legs 517. In such a configuration, since the intermediate foldable portion 509 is not located between the legs 517 and the protrusible and retractable system 508 (massaging apparatus), it is smoothly expandable during protrusion and expansion of the intermediate air cells 511. In addition, discomfort caused by the intermediate foldable portion 509 expanding between the legs 517 and the protrusible and retractable system 508 is avoided.

As should be appreciated from the above, the foldable portion is desirably placed at the position where the body of the user is not placed. As used herein, the "position where the body of the user is not placed" refers to those positions other than positions where the body is placed when the leg rest is used as the massaging apparatus.

The intermediate foldable portion 509 is placed in the vicinity of the intermediate air cells 511 so as to cover the intermediate air cells 511. If the intermediate foldable portion 509 is distant from the intermediate air cells 511, the cover moves in the direction from the intermediate foldable portion 509 toward the intermediate air cells 511 according to the expansion of the intermediate air cells 511. In this case, if the leg 517 is placed on the moving cover, an external force which is irrelevant to a force to be applied to the leg 517, may be applied to the leg 517, causing discomfort. In addition, since the cover moves to a large extent by the expansion of the intermediate foldable portion 509, the expansion does not take place smoothly. In this embodiment, since the intermediate foldable portion 509 is positioned in the vicinity of the intermediate air cells 511, it is possible to minimize the movement of the cover when the intermediate foldable portion 509 expands. Therefore, the intermediate foldable portion 509 is expandable smoothly, and the user does not suffer discomfort which may otherwise be caused by the movement of the cover between the body and the massaging apparatus.

Thus, the foldable portion is positioned preferably in the vicinity of the protruding range of the protrusible and retractable system, more preferably within the protruding range of the protrusible and retractable system. In this case, the region of the cover that may move according to expansion of the cover is minimized. As a result, the foldable portion is smoothly expandable, and the user does not suffer discomfort which may otherwise be caused by the movement of the cover between the body and the massaging apparatus.

In the folded state, the first superimposed portion 509*c* and the second superimposed portion 509*d* of the intermediate foldable portion 509 are accommodated on the rear surface side of the cover surface h, i.e., on the rear surface side (inside) of the first front surface portion 509*a* and the second front surface portion 509*b*. In other words, the intermediate foldable portion 509 is folded to be accommodated on the rear surface side of the cover surface h. Since the first superimposed portion 509*c* and the second superimposed portion 509*d* are accommodated in the folded state on the rear surface side of the cover, they are therefore less conspicuous, resulting in improved external appearance. Furthermore, the user is not disturbed by the first superimposed portion 509*c* and the second superimposed portion 509*d* which are loosely folded and exposed on the front side (outer side).

As shown in FIG. 71, bellows-like foldable portions 526 are provided at both end portions in the rightward and leftward direction of the lower cover 507 of the sixteenth embodiment. The bellows-like foldable portions 526 expand when the lower air cell 514 and the upper air cell 515 of the protrusible and retractable system 508 expand to cause the protrusible plate 513 and the receiver plate 522 to protrude. As described above, since the lower cover 507 is not fixed to the leg rest 504, the lower cover 507 is unable to move according to protrusion of the receiver plates 522 (or expansion of the upper air cells 515) without the bellows-like foldable portion 526, causing the lower cover 507 to disengage from the leg rest 504, or to displace from a position where the lower cover 507 covers the leg rest 504. Nonetheless, disengagement or displacement of the lower cover 507 is inhibited because of the presence of the bellows-like foldable portion 526.

Figure 74:
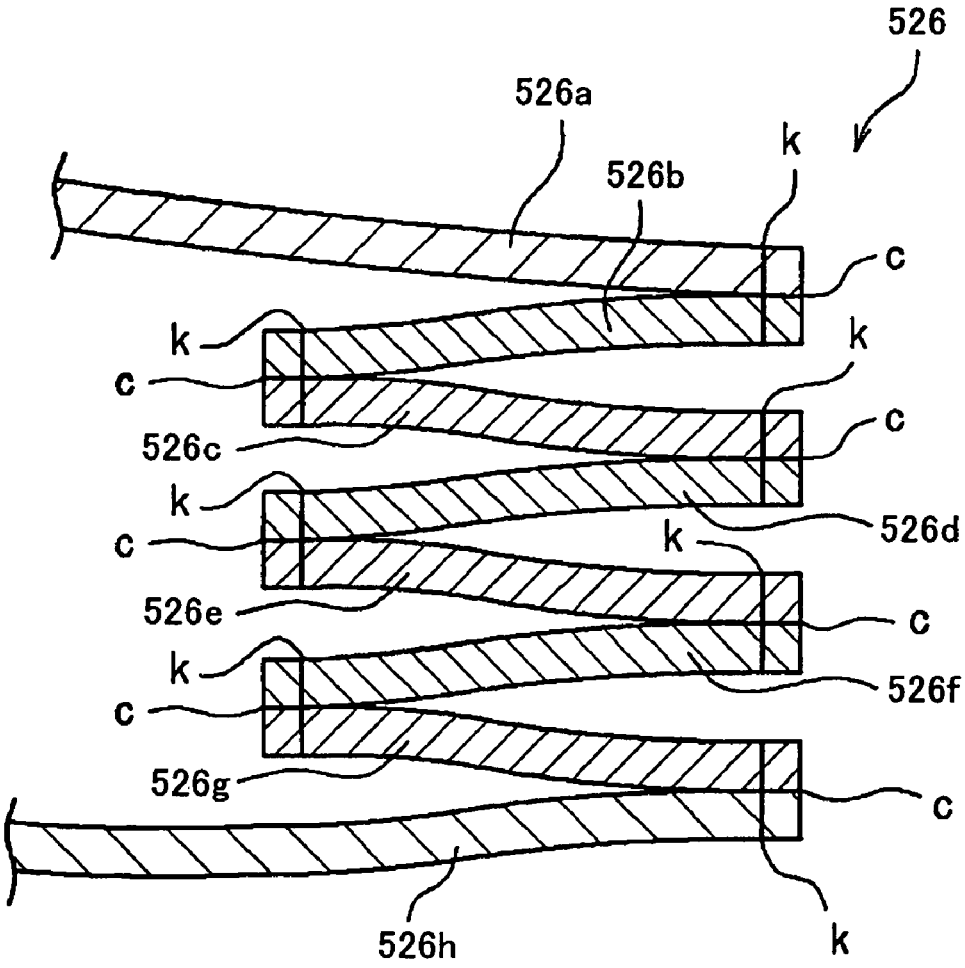
FIG. 74 is an enlarged cross-sectional view of a bellows-like foldable portion.

Unlike general bellows-like covers, the bellows-like foldable portion 526 easily returns to its folded state. FIG. 74 is an enlarged cross-sectional view of the bellows-like foldable portion 626. As shown in FIG. 74, in its folded state, a front surface portion 526*a*, a first superimposed portion 526*b*, a second superimposed portion 526*c*, a third superimposed portion 526*d*, a fourth superimposed portion 526*e*, a fifth superimposed portion 526*f*, a sixth superimposed portion 526*g*, and a rear portion 526*h*, which are cover elements forming the bellows-like foldable portion 526, are folded substantially in parallel with the support surface 518 of the protrusible and retractable system 508 in retraction. The cover elements 526*a* to 526*h* in a folded state are coupled (stitched together) in the thickness direction in regions k near the coupled portions c. Therefore, as in the above mentioned intermediate foldable portion 509, the bellows-like foldable portion 526 easily returns to its folded state in retraction of the protrusible and retractable system 508. As a result, external appearance is improved.

Embodiment 17

Figure 75:
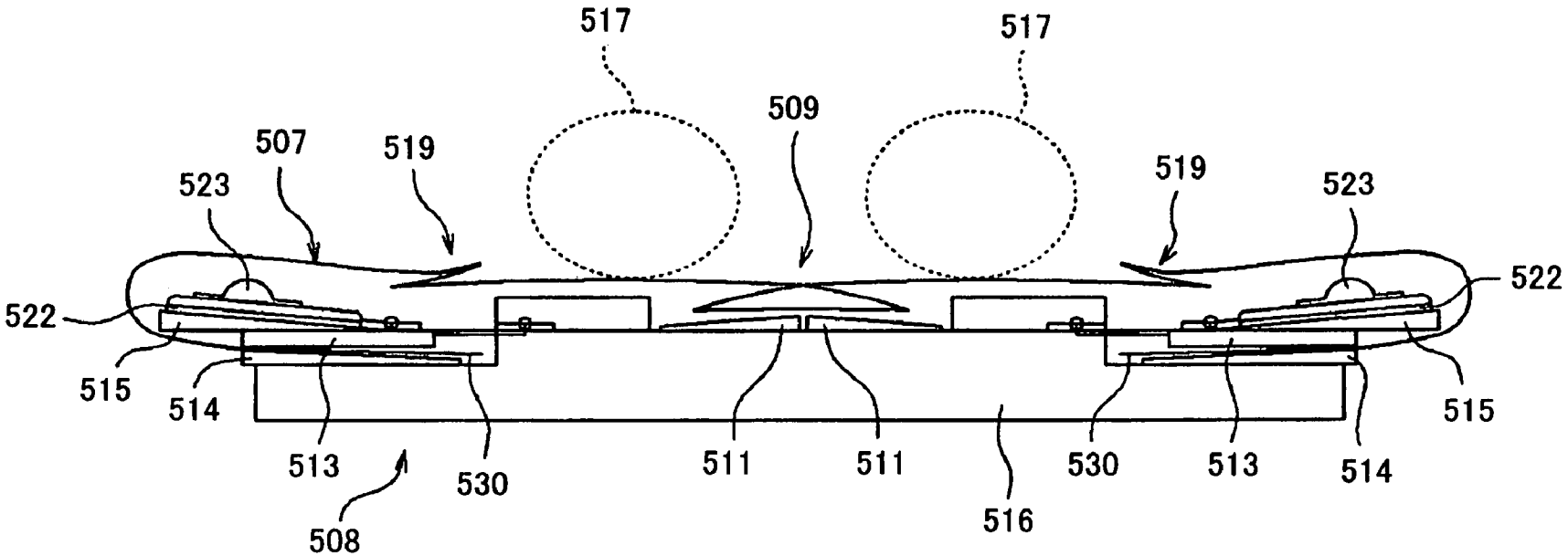
FIG. 75 is a cross-sectional view showing a state in which a cover according to a seventeenth embodiment of the present invention covers the leg massaging system.

FIG. 75 is a cross-sectional view showing a state in which a lower cover 507 according to a seventeenth embodiment of the present invention covers a protrusible and retractable system 508. In the seventeenth embodiment, in addition to the intermediate foldable portion 509, right and left foldable portions 519 are provided as foldable portions which are folded substantially in parallel with the support surface 518 on the support surface 518 of the protrusible and retractable system 508. In addition, the bellows-like foldable portions 526 of the sixteenth embodiment are omitted.

Figure 76:
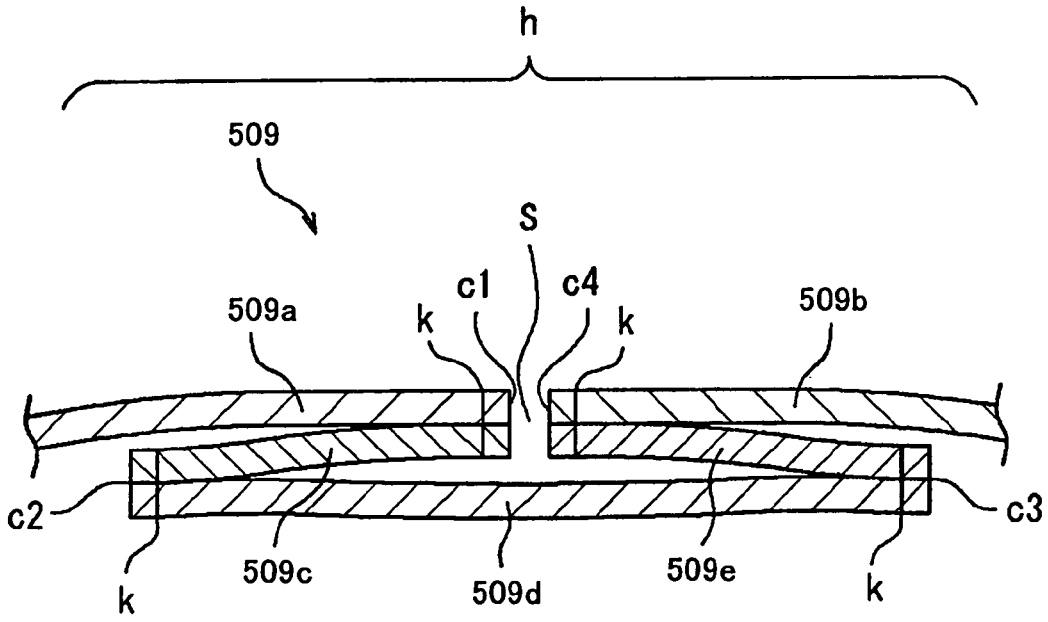
FIG. 76 is an enlarged cross-sectional view of an intermediate foldable portion in the cover according to the seventeenth embodiment of the present invention.

FIG. 76 is an enlarged cross-sectional view of the intermediate foldable portion 509 of the seventeenth embodiment. The intermediate foldable portion 509 of the seventeenth embodiment is structured such that the first front surface portion 509*a* and the second front surface portion 509*b* are butted against each other with the slit S interposed between them. An end portion on the slit S side of the first front surface portion 509*a* and an end portion on the slit S side of the first superimposed portion 509*c* are stitched up together to form a first coupled portion c1. An end portion on the slit S side of the second front surface portion 509*b* and an end portion on the slit S side of the third superimposed portion 509*e* are stitched up together to form a fourth coupled portion c4. Further, end portions on the opposite side of the slit S side of the superimposed portions 509*c* and 509*e* and the both end portions of the second superimposed portion 509*d* are stitched up together to form a second coupled portion c2 and a third coupled portion c3, respectively The first superimposed portion 509*c* and the third superimposed portion 509*e* have an equal width in the rightward and leftward direction, and the second superimposed portion 509*d* has a width in the rightward and leftward direction which is approximately twice as large as that of these superimposed portions 509*c* and 509*e*. In the folded state, all the cover elements 509*a* to 509*e* are substantially parallel to the cover surface h.

The right and left foldable portions 519 have a folded structure shown in the embodiment of FIG. 72(*b*). The perspective view of the lower cover 507 of FIG. 75 is shown in FIG. 70. The lower cover 507 of FIG. 75 is provided with three lines L1 to L3 extending in the vertical direction, among which the lines L1 and L3 positioned on right and left sides of the intermediate foldable portion 509 are slits including the first coupled portions c1 (see FIG. 72(*b*)) of the right and left foldable portions 519.

In this manner, by providing the lines including the coupled portions of the foldable portion in the folded state on extended lines of another lines on the cover 501, the lines including the coupled portions are integral with the other lines and are less conspicuous. In addition, external design appearance improves. When a plurality of foldable portions are provided, other lines which are visible on the cover 501 may be provided on extended lines of the lines including the coupled portions resulting from a plurality of foldable portions. The number and direction of the lines including the coupled portions and lines partially including these lines of the coupled portions are not specifically limited.

In this embodiment, as in the intermediate foldable portion 509 of the sixteenth embodiment, the intermediate foldable portion 509 is configured to easily return to its folded state during retraction of the protrusible and retractable system 508. All the cover elements 509*a* to 509*e* are separate at the stitching positions, and all the coupled portions c1 to c4 are formed by stitching, in the thickness direction, the cover elements 509*a* to 509*e* superimposed in the folded state in parallel with each other in the regions k near the coupled portions c1 to c4. Therefore, the foldable portion 509 of the seventeenth embodiment easily returns to its folded state as in the intermediate foldable portion 509 of the sixteenth embodiment.

Since in the folded state, the first superimposed portion 509*c*, the second superimposed portion 509*d*, and the third superimposed portion 509*e* which are folded and become deformed are accommodated on the rear side of the cover surface h, i.e., on the rear side of the first and second front surface portions 509*a* and 509*b*, their external appearance improves and the deformed regions do not interfere with the user.

Figure 81:
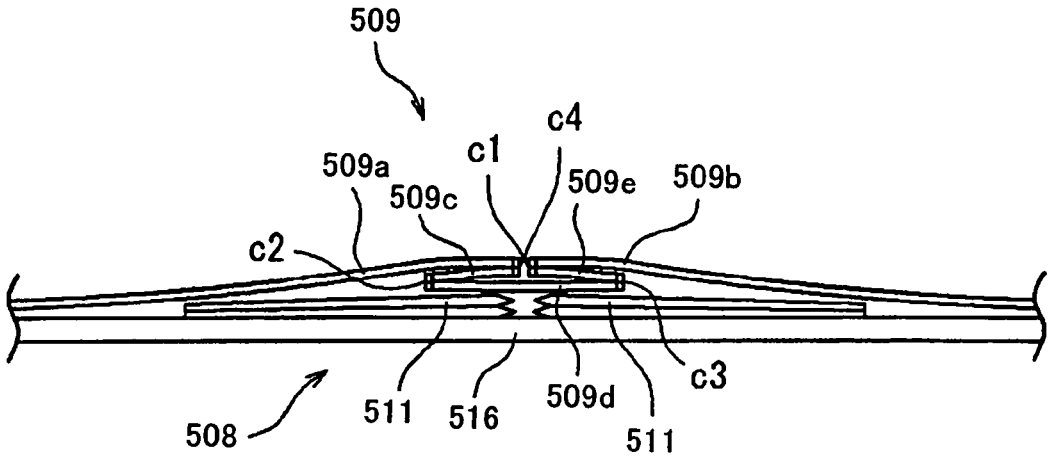
FIG. 81 is a view showing how an intermediate foldable portion expands.
Figure 81:
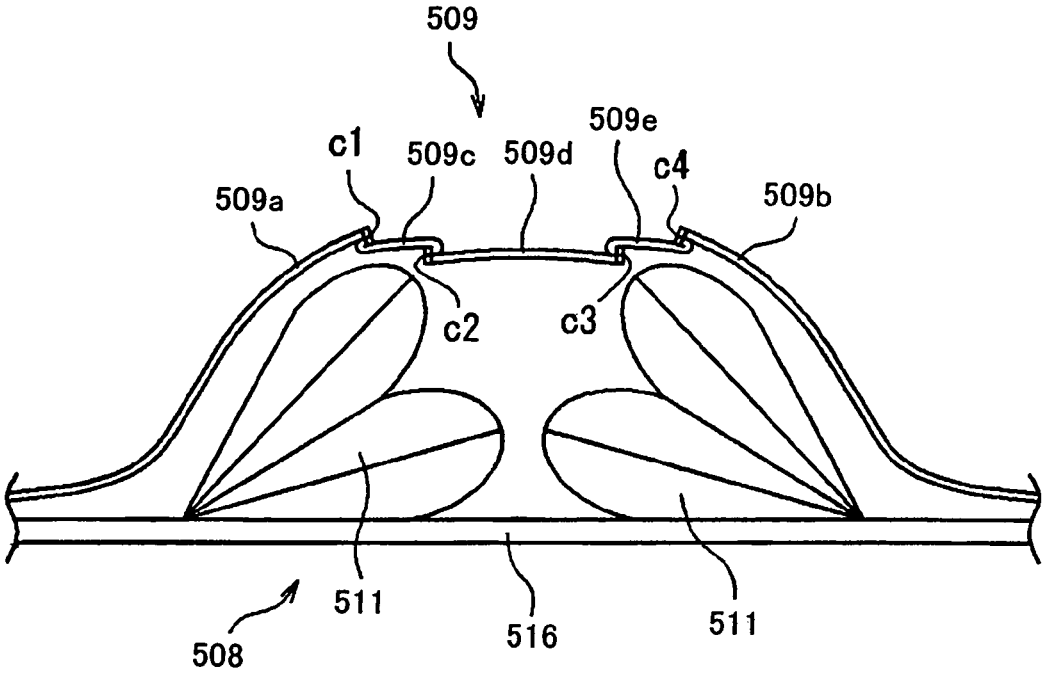

Subsequently, how the cover 507 of the seventeenth embodiment expands when the protrusible and retractable system 508 protrudes and retracts will be described. In a contracted (retracted) state of the intermediate air cells 511, the intermediate foldable portion 509 is folded as shown in FIG. 81(*a*). On the other hand, in an expanded (protruded) state of the intermediate air cell 511, the intermediate foldable portion 509 expands as shown in FIG. 81(*b*). Therefore, the lower cover 507 is expandable according to the expansion (protrusion) of the intermediate air cells 511.

As described above, the intermediate foldable portion 509 is structured such that the cover elements 509*a* to 509*e* superimposed in the folded state substantially in parallel are stitched up together in the thickness direction in the regions near the first to fourth coupled portions c1 to c4. The restricting force resulting from this stitching causes the first superimposed portion 509*c* to be curved in substantially U-shape at right and left end regions (near the first coupled portion c1 and the second coupled portion c2), in the expanded state of FIG. 81(*b*). The restricting force causes the third superimposed portion 509*e* to be also curved in substantially U-shape at right and left end regions (near the third coupled portion c3 and the fourth coupled portion c4). The cover elements such as the first superimposed portion 509*c* and the third superimposed portion 509*e* have bending rigidity of a predetermined value, and a force for causing these cover elements to return to its substantially flat state is exerted when they are bent.

When a bending degree (curvature) is larger as in the above mentioned curved state, the force for causing the cover elements to return its substantially flat state becomes larger. Since the restricting force resulting from the stitching increases the curvature of the cover element during expansion, the cover elements are more likely to return to its folded state. When the intermediate air cell 511 re-contracts from the expanded state of FIG. 81(*b*), the intermediate foldable portion 509 easily return to its folded state.

Figure 82:
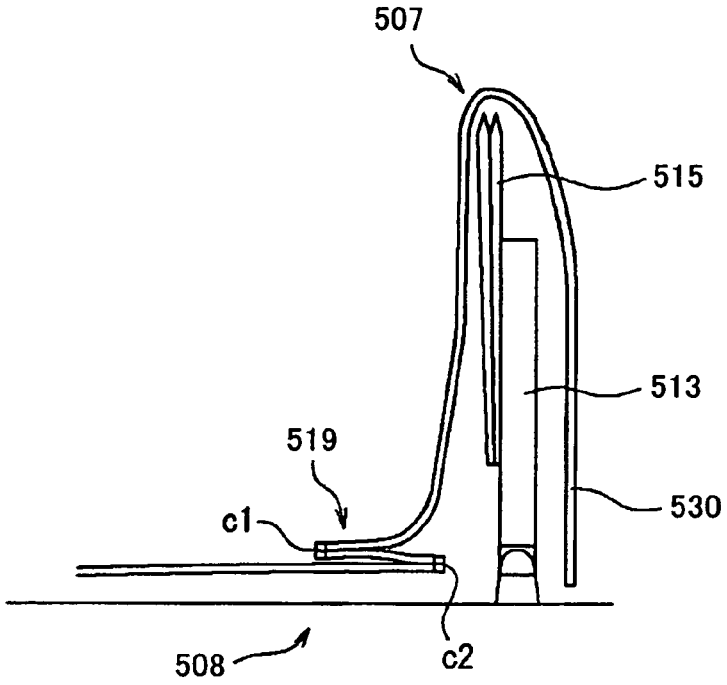
FIG. 82 is a view showing how a right or left foldable portion expands.
Figure 82:
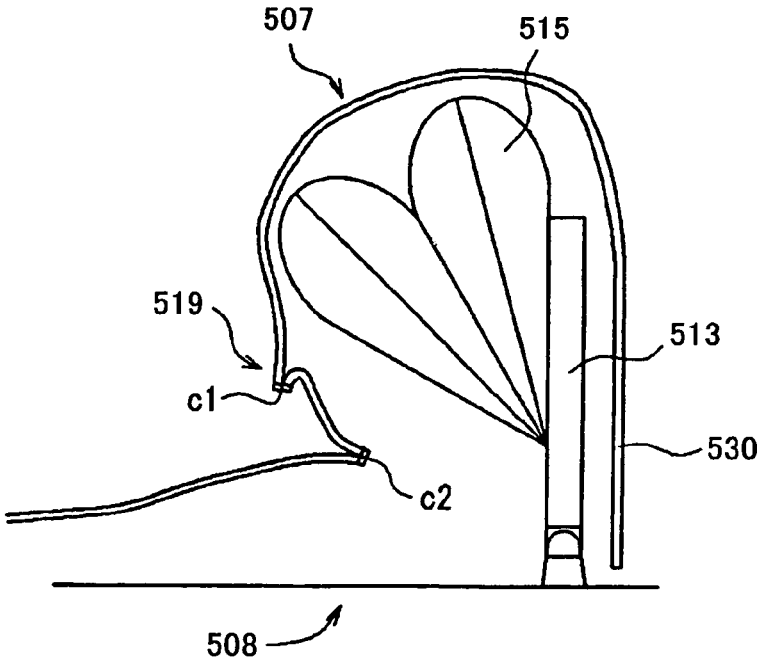

The right and left foldable portions 519 expand according to the expansion (protrusion) of the upper air cells 515 of the right and left air cells 512. FIG. 82 shows how each of the right and left foldable portions 519 expands. In FIG. 82, the lower air cell 514, the receiver plate 522, the pressing element 523, and other elements are suitably omitted.

With the protrusible plate 513 protruding by expansion of the lower air cell 514 (not shown) as shown in FIG. 82(*a*), each of the right and left foldable portions 519 does not substantially expand. This is because each of the end portions 530 of the lower cover 507 is sandwiched between the protrusible plate 513 and the lower air cell 514, and not fixed to the leg rest 504 side, so that the lower cover 507 is not pulled by protrusion of the protrusible plate 513. When the upper air cell 515 expands (protrudes) as shown in FIG. 82(*b*), each of the right and left foldable portions 519 expands. If the right and left foldable portions 519 are not provided, the end portions 530 of the lower cover 507 tend to move according to the expansion of the upper air cell 515, causing the lower cover 507 to disengage and displace from the leg rest 504. This does not occur because the right and left foldable portions 519 expand.

In the expanded state of FIG. 82(*b*), the cover elements are curved in the vicinity of the first coupled portion c1 and the second coupled portion c2 of each of the right and left foldable portions 519. Therefore, the force for causing the foldable portion 519 to return to the substantially folded state is exerted, causing the foldable portion 519 to easily to return its folded state.

Figure 83:
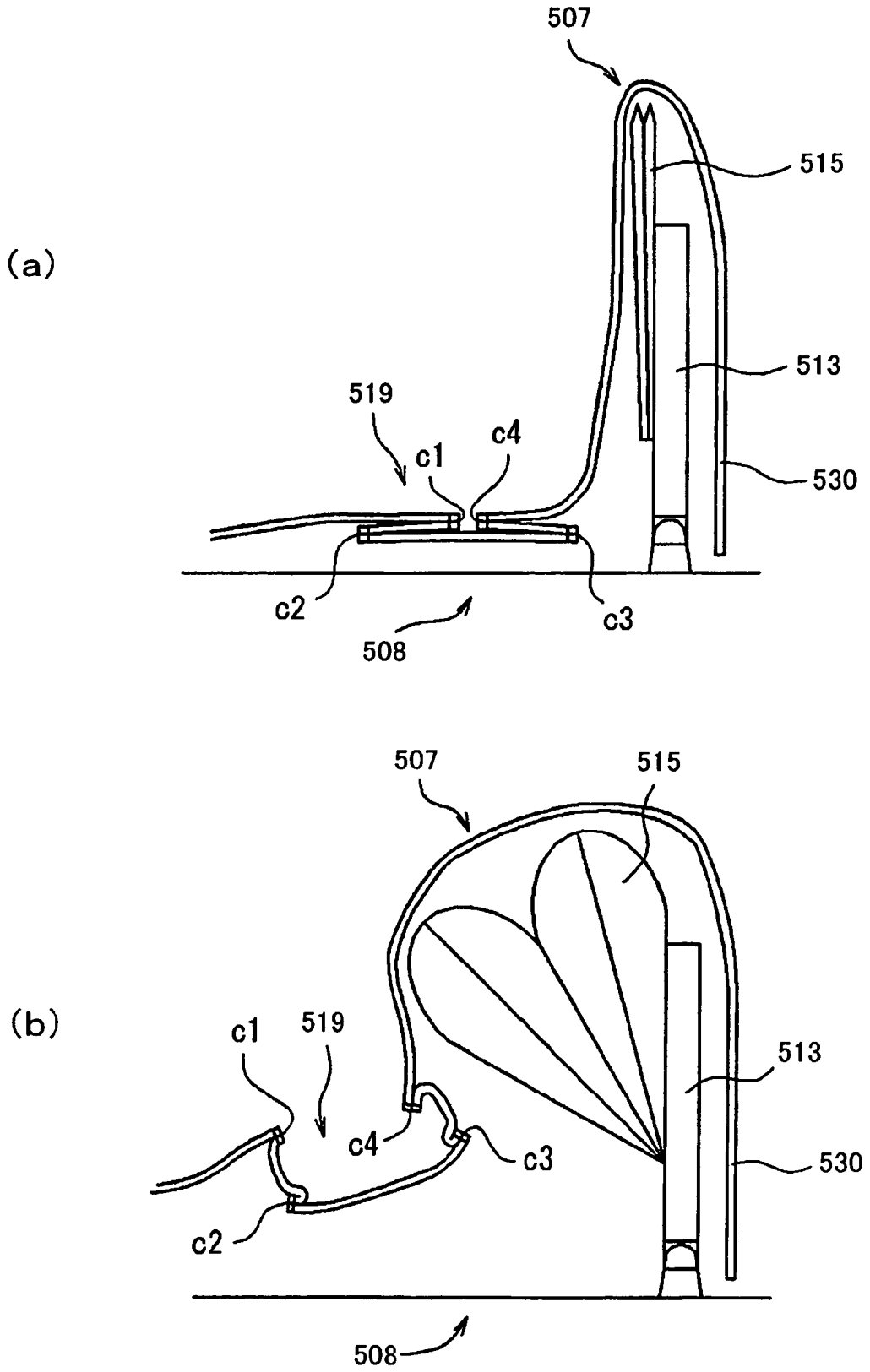
FIG. 83 is a view showing how an alternative of the right or left foldable portion expands.

FIG. 83 shows how an alternative of the foldable portion 519 expands. The alternative of the foldable portion 519 is configured as in the intermediate foldable portion 509 in the embodiment of FIG. 76. Since the foldable portion 519 expands as shown in FIG. 83(*b*) during expansion of the upper air cell 515, and the cover elements are curved at the coupled portions c1 to c4, it easily returns to its folded state by the force causing the foldable portion 519 to return its initial state.

Since intermediate foldable portion 509 of the seventeenth embodiment of FIG. 76 is symmetric in the rightward and leftward direction, it easily expands evenly rightward and leftward. Therefore, as shown in FIG. 75, by causing a protrusion symmetric axis of the two intermediate air cells 511 which is the protruding system that is protrusible evenly rightward and leftward to conform to a symmetric axis of the foldable portion 509, the foldable portion 509 becomes expandable more smoothly.

Figure 77:
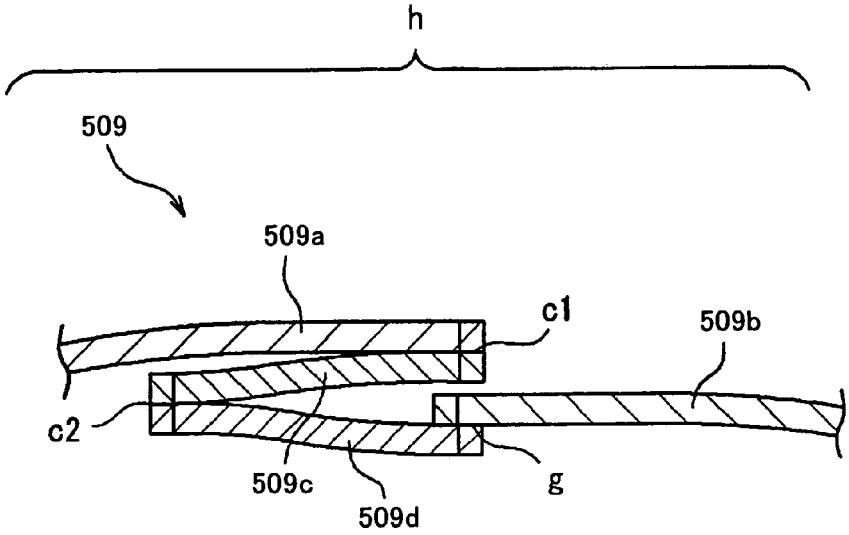
FIG. 77 is an enlarged cross-sectional view of an alternative of a foldable portion.
Figure 77:
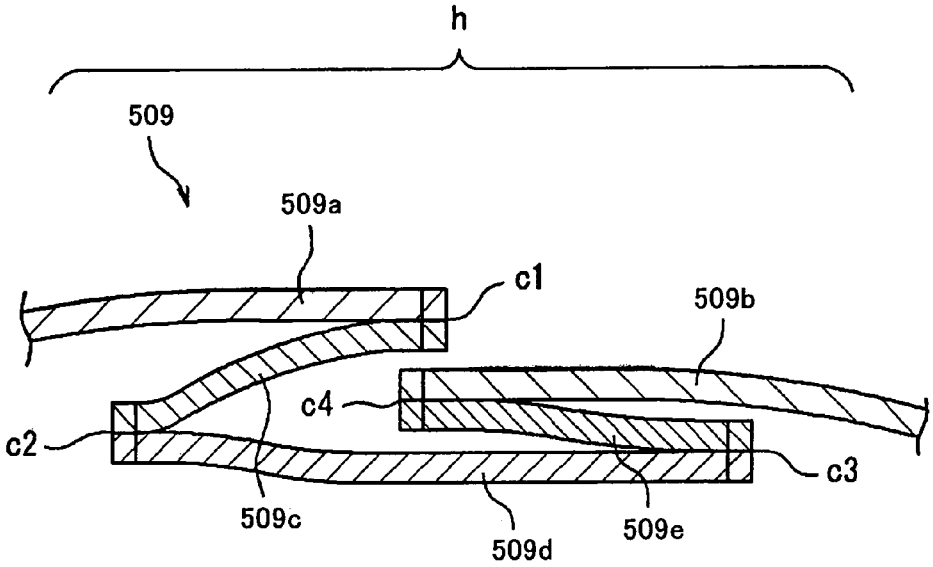

FIGS. 77(*a*) and 77(*b*) show alternatives of the intermediate foldable portion 509. As a matter of course, these foldable structures may be employed in all foldable positions such as the right and left foldable portions 519.

As compared to the embodiment of FIG. 72(*a*), the joint g is located on the rear side (lower side) of the first front surface portion 509*a* and the first superimposed portion 509*c* in the embodiment of FIG. 77(*a*). The joint g is accommodated on the rear side of the cover surface h. In such a structure, since the joint g hides behind in the folded state, only one coupled portion c1 is visible and the slit S (see FIG. 72(*a*)) does not occur. It shall be appreciated that, unlike the embodiment of FIG. 72(*a*), the first front surface portion 509*a* and the second front surface portion 509*b* are not butted against each other and a step is formed at the first coupled portion c1.

The embodiment of FIG. 77(*b*) is similar to that of FIG. 76, and has coupled portions c1 to c4. The embodiment of FIG. 77(*b*) is different from that of FIG. 76 in that the fourth coupled portion c4 is located on the rear side (lower side) of the first front surface portion 509*a* and the first superimposed portion 509*c*, and is accommodated on the rear surface side of the cover surface 76. In this structure, the first coupled portion c1 and the fourth coupled portion c4 are not butted against each other unlike the embodiment of FIG. 76, and there is a step at the first coupled portion c1. On the other hand, since the fourth coupled portion c4 hides behind in the folded state, only one coupled portion c1 is visible from outside, and therefore, the slit S (see FIG. 76) does not occur advantageously.

When the maximum number of the superimposed cover elements in the folded state is four or less, or three or less, the protruding amount of the foldable portion in the folded state desirably becomes minimized. In the intermediate foldable portion 509 of FIG. 72(*a*), the maximum number is three (i.e., first front surface portion 509*a*, the first superimposed portion 509*c*, and the second superimposed portion 509*d*). Likewise, the intermediate foldable portion 509 includes three cover elements in the embodiment of FIG. 76. The foldable portion of FIG. 77(*a*) includes four cover elements (i.e., the first front surface portion 509*a*, the first superimposed portion 509*c*, the second superimposed portion 509*d*, and the second front surface portion 509*b*), while the foldable portion of FIG. 77(*b*) includes five cover elements. If the maximum number of the superimposed cover elements increases, then the cover is swollen greatly, so that the body is difficult to place thereon and its external appearance degrades. Since it is typically necessary to superimpose three or more cover elements to form the foldable portion, the maximum number of the superimposed elements is preferably three or four, more preferably three in order to improve flatness of the cover.

The above described massaging apparatus in the respective embodiments is provided with the leg rest 504 including the support surface 518 on which the right and left legs are supported, and the protrusible and retractable system 508 configured to protrude and retract with respect to the legs 517, and the cover 501 configured to cover the support surface 518 and including the intermediate foldable portion 509 configured to expand according to protrusion and to be folded according to retraction. In this massaging apparatus, the support surface 518 that supports the body and has the protrusible and retractable system is covered with the cover. Because of the presence of the foldable portion that is capable of expanding and being folded according to the protrusion and retraction, the cover need not be made of an elastic material, and its amount of expansion and contraction decreases if the cover is made of the elastic material. The elastic material decreases elasticity and becomes deformed after repeated expansion and contraction during use. In accordance with the above configuration, since the cover need not be made of the elastic material, and its expansion and contraction amount decreases if it is made of the elastic material, its external appearance is maintained.

In the above mentioned embodiments, the region of the lower cover 507 that covers the leg rest 504 functions as the cover for the leg rest. The cover for the leg rest is configured to cover the leg rest 504 including the support surface 518 on which the right and left legs are supported, and the protrusible and retractable system is configured to protrude and retract with respect to the legs 517 within the support surface 518. The cover includes the intermediate foldable portion 509 which is an expandable and contractable portion that is placed on the intermediate region in the rightward and leftward direction of the support surface 518 and is capable of expanding and retracting according to protrusion and retraction.

In order to enable the leg rest 504 to massage the right and left legs, a separating wall is typically provided between these legs to allow these legs to be supported from inward, because the legs are required to be respectively massaged. The separating wall makes it difficult to place the legs on the leg rest 504. It is therefore desirable to provide the protrusible and retractable system configured to protrude between the right and left legs, because the separating wall is omitted and thus the legs are easily placed thereon. In this case, by placing the expandable and contractable portion on the intermediate region in the rightward and leftward direction of the support surface 518, the cover expands according to protrusion and contracts according to retraction in the intermediate region. Since the cover contracts according to retraction, it does not substantially interfere with the legs during retraction. In addition, since the expandable and contractable portion is positioned in the intermediate region in the rightward and leftward direction between the right and left legs 517 so as to avoid the positions of the legs 517, it is expandable and contractable smoothly, and discomfort felt by the user is minimized.

Furthermore, since the support surface 518 of the leg rest 504 is substantially flat in retraction of the protrusible and retractable system 508, the legs are placed on the leg rest 504 more easily and its external appearance improves.

The expandable and contractable portion may be made of, for example, various types of elastic materials. It shall be understood that the elastic material decreases elasticity and becomes deformed after its repeated expansion and contraction. In order to maintain the external appearance, the foldable portion is desirably made of non-elastic material such as leather (e.g., artificial leather) and is desirably the intermediate foldable portion 509. Since the foldable portion is configured to be foldable substantially in parallel with the cover surface h, a protruding amount of the cover on the support surface 518 of the leg rest 504 becomes minimized, and the cover allows the legs to be easily placed thereon while maintaining its external appearance. As mentioned previously, these effects are enhanced when the support surfaces 518 are substantially flat.

The above mentioned foldable structures of the intermediate foldable portion 509 or the right and left foldable portions 519 are not intended to be employed in only the regions that cover the leg rest 504, but may be applied to foldable portions at all positions of the massaging apparatus, for example, the back rest 503, the arm rest 510, the seat portion 502, and other elements. The present invention is applicable to massaging apparatus associated with protruding and retracting operations other than the chair-type massaging apparatus mentioned above. Moreover, the protruding and retracting operations are not intended to be massage operations.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

INDUSTRIAL APPLICABILITY

A chair-type massaging apparatus, a cover for a massaging apparatus, a cover for a leg rest, and a massaging apparatus of the present invention are useful as a chair-type massaging apparatus comprising a leg rest on which lower legs of a user are supported, a cover for a massaging apparatus or a leg rest that is configured to massage a body such as legs, and a massaging apparatus comprising these covers.

The invention claimed is:

1. A chair-type massaging apparatus comprising:

a leg rest including a support portion configured to support a lower leg of a user; and an expandable portion which is protrusible forward from the support portion to press the lower leg of the user and is retractable;

wherein the leg rest is configured such that the support portion and the expandable portion form a substantially flat surface with the expandable portion retracted;

wherein the support portion has two support surfaces arranged rightward and leftward and configured to allow right and left lower legs of the user to be respectively supported thereon, mounting surfaces that are respectively located outside the support surfaces in a rightward direction and a leftward direction and are substantially parallel to the support surfaces, and a support protrusion mounted between the two support surfaces to protrude forward further than the support surfaces and configured to support inner regions of calves of legs of the user;

wherein the expandable portion includes a massaging portion configured to press the lower leg of the user;

wherein the massaging portion includes:

a rear air bag that is mounted to one of the mounting surfaces and is configured to expand and contract by inflowing and outflowing air;

a receiver plate that is positioned forward of the rear air bag and is pivotally mounted to a region of the support portion between one of the support surfaces and a mounting position of the rear air bag by a pivot extending substantially vertically; and a front air bag which is positioned forward of the receiver plate in such a manner that one end thereof, which is expandable in a bellows-like manner, is distant from the pivot in a plane parallel to a surface of the receiver plate and an opposite end thereof, which is unexpandable, is closer to the pivot in the plane parallel to the surface of the receiver plate, the front air bag being configured to expand in a fan-shaped form from a substantially flat state by inflowing air thereto;

wherein the massaging portion is configured in such a manner that with the rear air bag and the front air bag contracted, the massaging portion and the one of the support surfaces form a substantially flat surface, while, with the rear air bag and the front air bag in an expanded state, the front air bag is configured to press an outer region of a shin of the lower leg of the user substantially backward, and wherein the rightward direction, the leftward direction, forward, and backward are directions from a perspective of the user seated in the chair-type massaging apparatus.

2. The chair-type massaging apparatus according to claim 1, wherein the support protrusion is configured to have a width that increases in a downward vertical direction.

3. The chair-type massaging apparatus according to claim 1, wherein the massaging portion is a first massaging portion and is mounted at an end portion of the support portion in the rightward direction so that the first massaging portion corresponds to the right lower leg of the user, and further comprising a second massaging portion mounted at an end portion of the support portion in the leftward direction so that the second massaging portion corresponds to the lower leg of the user.

4. The chair-type massaging apparatus according to claim 3, wherein the rear air bag is mounted to the one of the mounting surfaces in such a manner that one end portion thereof which is expandable in a bellows-like manner is positioned distant from the one of the support surfaces in a rightward and leftward direction when the rear air bag is retracted, and an opposite end thereof which is unexpandable is positioned closer to the one of the support surfaces in the rightward and leftward direction, the rear air bag being configured to expand in a fan-shaped form from a substantially flat surface by inflowing air thereto.

5. The chair-type massaging apparatus according to claim 4, wherein the support portion is configured in such a manner that the mounting surfaces are positioned backward with respect to the support surfaces to form respective steps between the mounting surfaces and the support surfaces.

6. The chair-type massaging apparatus according to claim 4, wherein the massaging portion is configured to be controlled to operate in such a manner that the front air bag repeats expansion and contraction with the rear air bag expanded.

7. The chair-type massaging apparatus according to claim 4, wherein the first massaging portion further includes a convex massaging element that is mounted forward of the front air bag when the front air bag and receiver plate are retracted, the convex massaging element configured to contact and press the lower leg of the user.

8. The chair-type massaging apparatus according to claim 4, wherein the receiver plate is configured such that an outer end portion thereof is curved forward with respect to the front air bag and receiver plate, when the front air bag and receiver plate are retracted.

9. The chair-type massaging apparatus according to claim 4, wherein the support portion includes an upper support portion and a lower support portion which are arranged in a vertical direction;

wherein the first massaging portion is mounted to each of the upper support portion and the lower support portion; and wherein the leg rest further includes a distance changing device configured to change a distance between the upper support portion and the lower support portion.

10. A chair-type massaging apparatus comprising:

a leg rest including a support portion configured to support a lower leg of a user; and an expandable portion which is protrusible forward from the support portion to press the lower leg of the user and is retractable, forward being a direction from a perspective of the user positioned in the massaging apparatus;

wherein the leg rest is configured such that the support portion and the expandable portion form a substantially flat surface with the expandable portion retracted;

wherein the expandable portion includes protrusible portions which are mounted at both sides in a rightward and leftward direction of the support portion and are configured to be protrusible to rise up inward in the rightward and leftward direction and are retractable, and a massaging portion mounted on each of the protrusible portions, each massaging portion protrusible to press the lower leg of the user and retractable;

wherein with the protrusible portions and the massaging portions retracted, elements of the support portion which are located inward relative to the protrusible portions and the massaging portions in the rightward and leftward direction form a substantially flat surface;

wherein each of the protrusible portions includes a receiver plate;

wherein each receiver plate is rotatable around a first respective rotational axis positioned on an inner side of each receiver plate in the rightward and leftward direction and is configured to rotate by expansion and contraction of a rear air bag placed on a rear surface side of a respective receiver plate;

wherein each massaging portion includes a massaging plate;

wherein each massaging plate is rotatable around a second respective rotational axis positioned on an inner side of each massaging plate in the rightward and leftward direction, and is configured to rotate by expansion and contraction of an air bag placed between a respective receiver plate and a respective massaging plate; and wherein the rightward and leftward direction is a direction from a perspective of the user positioned in the massaging apparatus.

11. The chair-type massaging apparatus according to claim 10, wherein each first rotational axis and each second rotational axis are provided at different positions.

12. The chair-type massaging apparatus according to claim 11, wherein each second rotational axis is positioned outward in the rightward and leftward direction relative to the first rotational axis.

13. The chair-type massaging apparatus according to claim 10, wherein the rear air bag and the air bag placed between the receiver plate and the massaging plate are each expandable in a substantially fan-shaped form in cross-section, and are placed in such a manner that a center of each substantially fan-shaped form is positioned on an inner side in the rightward and leftward direction of the support portion.

14. The chair-type massaging apparatus according to claim 10, further comprising:

an intermediate massaging portion that is mounted in an intermediate region in the rightward and leftward direction of the support portion and is configured to protrude and retract, wherein with the protrusible portions, the massaging portions, and the intermediate massaging portion retracted, the elements of the support portion which are located inward relative to the protrusible portions and the massaging portions in the rightward and leftward direction form a substantially flat surface.

15. The chair-type massaging apparatus according to claim 14, wherein the intermediate massaging portion includes intermediate air bags;

wherein the intermediate air bags are positioned to be symmetric in the rightward and leftward direction with respect to an axis located at a center in the rightward and leftward direction of the support portion; and wherein the intermediate air bags are each expandable in a substantially fan-shaped form in cross-section and are each placed in such a manner that a center of the substantially fan-shaped form is positioned on an outer side in the rightward and leftward direction of the support portion.

16. The chair-type massaging apparatus according to claim 10, wherein the support portion has a support surface on which the lower leg of the user is supported, and a mounting surface that is located outside the support surface in a rightward and leftward direction and is substantially parallel to the support surface;

wherein the mounting surface is positioned backward with respect to the support surface to form a step between the mounting surface and the support surface; and wherein each massaging portion further includes a convex massaging element that is mounted forward of a respective massaging plate when that massaging plate is retracted and configured to press the lower leg of the user in contact with the lower leg of the user.

17. A chair-type massaging apparatus comprising:

a leg rest including a support portion configured to support a lower leg of a user; and an expandable portion which is protrusible forward from the support portion to press the lower leg of the user and is retractable, forward being a direction from a perspective of the user seated in the chair-type massaging apparatus;

wherein the leg rest is configured such that the support portion and the expandable portion form a substantially flat surface with the expandable portion retracted;

wherein the support portion has a support surface on which the lower leg of the user is supported, and a mounting surface that is located outside the support surface in a rightward and leftward direction and is substantially parallel to the support surface;

wherein the expandable portion includes a massaging portion configured to press the lower leg of the user; and wherein the massaging portion includes:

a rear air bag that is mounted to the mounting surface and is configured to expand and contract by inflowing and outflowing air;

a receiver plate that is positioned forward of the rear air bag when the rear air bag is contracted, the receiver plate pivotally mounted to a region of the support portion between the support surface and a mounting position of the rear air bag by a pivot extending substantially vertically; and a front air bag which is positioned forward of the receiver plate with the front air bag contracted, and positioned in such a manner that one end thereof which is expandable in a bellows-like manner is distant from the pivot in the rightward and leftward direction and an opposite end thereof which is unexpandable is closer to the pivot in the rightward and leftward direction, the front air bag being configured to expand in a fan-shaped form from a substantially flat state by inflowing air thereto;

wherein the massaging portion is configured in such a manner that with the rear air bag and the front air bag contracted, the massaging portion and the support surface form a substantially flat surface, while, with the rear air bag and the front air bag expanded, the front air bag is configured to press an outer region of a shin of the lower leg of the user substantially backward; and wherein the rightward and leftward direction is a direction from the perspective of the user seated in the chair-type massaging apparatus.

18. The chair-type massaging apparatus according to claim 17, wherein the massaging portion is a first massaging portion mounted on an end portion of the support portion in a rightward direction so that the first massaging portion corresponds to a right lower leg of the user, and further comprising a second massaging portion mounted at an end portion of the support portion in a leftward direction so as to correspond to a left lower leg of the user.

19. The chair-type massaging apparatus according to claim 18, wherein the rear air bag is mounted to the mounting surface in such a manner that one end portion thereof which is expandable in a bellows-like manner is distant from the support surface in the rightward and leftward direction and an opposite end thereof which is unexpandable is closer to the support surface in the rightward and leftward direction, the rear air bag being configured to expand in a fan-shaped form from a substantially flat state by inflowing air thereto.

20. The chair-type massaging apparatus according to claim 19, wherein the opposite end of the front air bag is positioned outward relative to the pivot in the rightward and leftward direction.

21. The chair-type massaging apparatus according to claim 19, wherein the support portion is configured in such a manner that the mounting surface is positioned backward with respect to the support surface to form a step between the mounting surface and the support surface.

22. The chair-type massaging apparatus according to claim 19, wherein the massaging portion is configured to be controlled to operate in such a manner that the front air bag repeats expansion and contraction with the rear air bag expanded.

23. The chair-type massaging apparatus according to claim 19, wherein the massaging portion further includes a convex massaging element that is mounted forward of the front air bag with the front air bag contracted, the convex massaging element configured to press the lower leg of the user when in contact with the lower leg of the user.

24. The chair-type massaging apparatus according to claim 19, wherein the receiver plate is configured such that an outer end portion thereof is curved forward.

25. The chair-type massaging apparatus according to claim 19, wherein the support portion has two support surfaces arranged rightward and leftward and configured to allow the right and left lower legs of the user to be supported thereon, and an intermediate mounting surface which is located between the two support surfaces and is substantially parallel to the support surfaces; the chair-type massaging apparatus further comprising:

an intermediate massaging portion including an intermediate air bag that is mounted to the intermediate mounting surface and is configured to contract to form a substantially flat surface with the support surfaces and to expand to protrude forward further than the support surfaces.

26. The chair-type massaging apparatus according to claim 25, wherein the support portion is configured in such a manner that the intermediate mounting surface is positioned backward with respect to the support surfaces to form respective steps between the intermediate mounting surface and the support surfaces, and the intermediate air bag in a contracted state and the support surfaces are substantially flush with each other.

27. The chair-type massaging apparatus according to claim 25, wherein the intermediate air bag is configured to have a width that increases in a downward vertical direction.

28. The chair-type massaging apparatus according to claim 25, wherein the massaging portion and the intermediate massaging portion are configured to be controlled to operate in such a manner that the front air bag and the intermediate air bag repeat expansion and contraction in synchronization with each other.

29. The chair-type massaging apparatus according to claim 25, wherein the massaging portion and the intermediate massaging portion are configured to be controlled to operate in such a manner that the rear air bag expands, then the front air bag and the intermediate air bag respectively expand in synchronization with each other, and then the rear air bag contracts to pull-massage the outer region of the shin of the lower leg of the user while maintaining expansion of the front air bag and the intermediate air bag.

30. The chair-type massaging apparatus according to claim 19, wherein the support portion has two support surfaces arranged rightward and leftward and configured to allow the right and left lower legs of the user to be supported thereon, and an intermediate mounting surface that is located between the two support surfaces and is substantially parallel to the support surfaces; the massaging apparatus further comprising:

an intermediate massaging portion including one pair or a plurality of pairs of intermediate air bags that are mounted to the intermediate mounting surface in such a manner that respective ends of the intermediate air bags that are expandable in a bellows-like manner are closer to each other in the rightward and leftward direction, and respective opposite ends of the intermediate air bags that are unexpandable are distant from each other in the rightward and leftward direction, the intermediate air bags being each configured to expand in a fan-shaped form from a substantially flat state by inflowing air thereto.

31. The chair-type massaging apparatus according to claim 30, wherein the one pair or the plurality of pairs of intermediate air bags of the intermediate massaging portion are mounted to the intermediate mounting surface in such a manner that a distance between intermediate air bags forming a pair increases in a downward vertical direction.

32. The chair-type massaging apparatus according to claim 19, wherein the support portion includes an upper support portion and a lower support portion which are arranged in a vertical direction;

wherein the massaging portion is mounted to each of the upper support portion and the lower support portion; and wherein the leg rest further includes a distance changing device configured to change a distance between the upper support portion and the lower support portion.

33. A cover for a massaging apparatus including a protrusible and retractable system configured to protrude and retract, the cover comprising:

a foldable portion configured to expand according to protrusion of the protrusible and retractable system and to be folded according to retraction of the protrusible and retractable system;

wherein the foldable portion includes a first front surface portion and a second front surface portion which are arranged in a rightward and leftward direction, and an expandable and contractable portion provided behind the first and second front surface portions and configured to connect the first and second front surface portions to each other, the expandable and contractable portion being configured to expand and contract according to protrusion and retraction of the protrusible and retractable system, the first and second front surface portions forming a substantially flat cover surface with the expandable and contractable portion contracted;

wherein the rightward and leftward direction is a direction from a perspective of a user positioned in the massaging apparatus;

wherein the foldable portion has a first coupled portion formed at an end region of the first front surface portion forming the substantially flat cover surface and a second coupled portion formed at an end region of the second front surface portion which forms the substantially flat cover surface, the second coupled portion separate from the first front surface portion; and wherein the second coupled portion is located backward of the first coupled portion.

34. The cover for the massaging apparatus according to claim 33, wherein the foldable portion has a plurality of coupled portions which are formed by coupling, in a thickness direction, cover elements superposed and folded substantially in parallel at regions in a vicinity of each of the plurality of coupled portions.

35. The cover for the massaging apparatus according to claim 34, wherein the foldable portion is configured in such a manner that expansion at an end position in a direction of a vertical line formed by at least one of the plurality of coupled portions is restricted.

36. A cover for a massaging apparatus including a support surface adapted to support a body of a user, and a protrusible and retractable system configured to protrude and retract with respect to the body on the support surface, the cover being configured to cover the support surface, the cover comprising:

a foldable portion configured to expand according to protrusion of the protrusible and retractable system and to be folded according to retraction of the protrusible and retractable system;

wherein the support surface is substantially flat in retraction of the protrusible and retractable system; and wherein the foldable portion includes a first front surface portion and a second front surface portion which are arranged in a rightward and leftward direction, and an expandable and contractable portion provided behind the first and second front surface portions and configured to connect the first and second front surface portions to each other, the expandable and contractable portion being configured to expand and contract according to protrusion and retraction of the protrusible and retractable system, the first and second front surface portions forming a substantially flat cover surface with the expandable and contractable portion contracted, wherein the rightward and leftward direction is a direction from a perspective of the user.

* * * * *